US011446710B2

(12) United States Patent
Shinozaki et al.

(10) Patent No.: US 11,446,710 B2
(45) Date of Patent: Sep. 20, 2022

(54) WASH AND DRY TOOL FOR ENCLOSED CHANNELS AND METHOD FOR USE

(71) Applicant: The Boeing Company, Chicago, IL (US)

(72) Inventors: John M. Shinozaki, Kenmore, WA (US); Tucker J. Rees, Mesa, AZ (US); Drake J. Nailon, Kirkland, WA (US)

(73) Assignee: The Boeing Company, Chicago, IL (US)

( * ) Notice: Subject to any disclaimer, the term of this patent is extended or adjusted under 35 U.S.C. 154(b) by 471 days.

(21) Appl. No.: 16/220,257

(22) Filed: Dec. 14, 2018

(65) Prior Publication Data

US 2020/0188966 A1 Jun. 18, 2020

(51) Int. Cl.

| | |
|---|---|
| ***B08B 3/08*** | (2006.01) |
| ***B08B 5/02*** | (2006.01) |
| ***B08B 3/04*** | (2006.01) |

(52) U.S. Cl.

CPC ..... *B08B 3/08* (2013.01); *B08B 3/04* (2013.01); *B08B 5/02* (2013.01)

(58) Field of Classification Search

CPC .... B08B 3/02; B08B 3/08; B08B 3/04; B08B 3/024; B08B 9/00; B08B 9/04; B08B 9/043; B08B 9/0433; B08B 9/045; B08B 9/049; B08B 9/051; B08B 9/0558; B08B 9/0436; B08B 9/047; B08B 9/0321; B08B 9/0553; B08B 9/0557; B08B 9/021; B08B 9/055; B08B 9/027; B08B 9/0328; B08B 9/093; B08B 5/02; B08B 2209/04; B08B 2209/055

USPC ..... 134/198, 167 C, 166 C, 22.12, 8, 22.11, 134/166 R, 168 C, 169 C, 22.1, 22.18

See application file for complete search history.

(56) References Cited

U.S. PATENT DOCUMENTS

| | | | | | |
|---|---|---|---|---|---|
| 2,248,742 | A * | 7/1941 | Burnham | B08B 9/0553 | 15/104.061 |
| 2,609,556 | A * | 9/1952 | Carver | B08B 9/0553 | 15/104.18 |
| 2,617,134 | A * | 11/1952 | Barton, Jr. | B08B 9/0558 | 15/104.063 |
| 2,636,202 | A * | 4/1953 | Hinzman | B08B 9/0553 | 15/104.18 |
| 2,860,356 | A * | 11/1958 | Matheny | F28G 1/166 | 15/104.061 |
| 2,974,932 | A * | 3/1961 | Xenis | B08B 9/049 | 15/186 |
| 3,056,155 | A * | 10/1962 | Harmes | B08B 9/0553 | 118/DIG. 10 |
| 3,078,823 | A * | 2/1963 | Cummings | B05C 7/08 | 118/317 |

(Continued)

*Primary Examiner* — David G Cormier
*Assistant Examiner* — Thomas Bucci
(74) *Attorney, Agent, or Firm* — Felix L. Fischer

(57) ABSTRACT

A cleaning tool system has a central body and a fore body extending from the central body and having a peripheral contour shaped to be closely received in an enclosed channel. The fore body has orifices to dispense a cleaning medium. A connection boss in the central body is configured to receive a supply line for the cleaning medium. A plurality of stabilizers each extend from the central body radially relative to a longitudinal axis to engage surfaces of the channel. A loop hook in the fore body is configured to attach a draw line to pull the fore body and central body through the channel along the longitudinal axis.

20 Claims, 48 Drawing Sheets

(56) References Cited

U.S. PATENT DOCUMENTS 3,135,629 A * 6/1964 McLean ..... B05C 7/08 118/DIG. 10
3,262,143 A * 7/1966 Reinhart ..... B08B 9/04 15/104.061
3,600,736 A * 8/1971 Smith ..... B08B 9/0553 15/104.061
3,604,041 A * 9/1971 Ver Nooy ..... B08B 9/0553 15/104.07
3,604,042 A * 9/1971 Bremner ..... B08B 9/045 15/104.31
3,643,280 A * 2/1972 Powers ..... B08B 9/0558 15/104.061
3,800,358 A * 4/1974 Ryan ..... B08B 9/049 15/312.1
3,835,587 A * 9/1974 Hall, Jr. ..... B24C 3/325 451/76
3,946,459 A * 3/1976 Armstrong ..... B08B 9/049 15/377
4,011,100 A * 3/1977 Ross ..... B08B 9/047 134/8
4,027,349 A * 6/1977 Clavin ..... B08B 9/051 15/88
4,249,475 A * 2/1981 Lindsey ..... B05C 7/08 118/DIG. 10
4,337,096 A * 6/1982 Clifford ..... E03F 9/002 134/8
4,369,713 A * 1/1983 Richardson ..... B08B 9/049 104/138.2
4,388,871 A * 6/1983 Braithwaite ..... G01M 3/005 73/866.5
4,413,370 A * 11/1983 Payne ..... B08B 9/0551 15/104.061
4,494,584 A * 1/1985 Rognoni ..... F16L 55/1283 34/104
4,559,960 A * 12/1985 Lanier ..... B08B 9/0436 134/198
4,563,841 A * 1/1986 Hart ..... B24C 3/325 451/100
4,622,709 A * 11/1986 Matsuda ..... B08B 9/035 451/36
4,774,905 A * 10/1988 Nobis ..... F16L 55/1645 427/236
4,852,391 A * 8/1989 Ruch ..... F16L 55/1283 73/40.5 R
4,887,585 A * 12/1989 Nutt ..... B28D 1/041 451/182
5,081,800 A * 1/1992 Ruholl ..... F16L 55/40 451/92
5,113,885 A * 5/1992 Ramsey ..... F16L 55/28 134/167 C
5,146,644 A * 9/1992 Crocco ..... B08B 9/045 15/104.31
5,309,947 A * 5/1994 Hinger ..... E03F 3/06 425/97
5,428,862 A * 7/1995 Sailer ..... B08B 9/043 15/387
5,617,604 A * 4/1997 Erich ..... B08B 9/055 15/104.063
5,699,577 A * 12/1997 Rankin ..... B08B 9/0557 15/104.061
5,875,803 A * 3/1999 Leitko ..... B08B 9/0553 134/167 C
5,903,946 A * 5/1999 Collins ..... B08B 9/051 15/104.061
5,913,977 A * 6/1999 Nichols ..... F16L 55/46 118/712
6,070,285 A * 6/2000 Geppert ..... B08B 9/0553 15/104.061
6,098,231 A * 8/2000 Smith ..... F16L 55/38 15/104.061
6,190,090 B1 * 2/2001 Campbell ..... B08B 9/0551 166/170
6,241,424 B1 * 6/2001 Bath ..... F16L 55/1608 15/104.061
6,374,838 B1 * 4/2002 Baugh ..... B08B 9/0551 134/167 C
6,390,105 B1 * 5/2002 Ramsey ..... B08B 9/0433 134/167 C
6,514,346 B1 * 2/2003 Nichols ..... F16L 55/1645 118/712
6,581,235 B1 * 6/2003 Stocco ..... B08B 9/0553 15/104.061
6,769,321 B1 * 8/2004 Appleton ..... F16L 55/34 73/866.5
6,944,902 B1 * 9/2005 Richter ..... B08B 9/0551 15/104.061
2002/0179123 A1 * 12/2002 Toward ..... B08B 3/02 134/167 R
2003/0039752 A1 * 2/2003 Winiewicz ..... B05B 13/0636 427/427.2
2003/0159776 A1 * 8/2003 Graham ..... F16L 55/26 156/391
2004/0025906 A1 * 2/2004 Bourrelly ..... B08B 9/049 134/22.12
2004/0025912 A1 * 2/2004 MacNeil ..... B08B 9/051 134/169 C
2005/0045210 A1 * 3/2005 Baugh ..... B08B 9/0551 134/42
2006/0042033 A1 * 3/2006 Filippovitch ..... B08B 9/0557 15/104.061
2006/0266134 A1 * 11/2006 MacMillan ..... F16L 55/30 73/865.8
2007/0174983 A1 * 8/2007 Smith ..... B08B 9/0551 15/104.061
2009/0199873 A1 * 8/2009 Pruett ..... B08B 9/055 134/22.12
2009/0307857 A1 * 12/2009 Hestenes ..... F16L 55/38 15/104.061
2010/0139019 A1 * 6/2010 Geppert ..... B08B 9/051 15/104.061
2010/0162503 A1 * 7/2010 Rosen ..... B08B 9/035 15/104.061
2012/0090498 A1 * 4/2012 Redpath ..... B08B 9/051 104/138.2
2012/0103153 A1 * 5/2012 MacNeil ..... B05B 13/0636 83/53
2013/0276828 A1 * 10/2013 Phipps ..... G01M 3/246 134/8
2014/0261559 A1 * 9/2014 MacNeil ..... B08B 9/0433 134/22.12
2016/0136700 A1 * 5/2016 Schaller ..... B08B 9/051 15/104.14
2017/0002970 A1 * 1/2017 McKaigue ..... B08B 9/045
2017/0081834 A1 * 3/2017 Benedid ..... E03F 9/002
2019/0126329 A1 * 5/2019 Urakami ..... B08B 9/032

* cited by examiner

WASH AND DRY TOOL FOR ENCLOSED CHANNELS AND METHOD FOR USE

BACKGROUND INFORMATION

Field

Implementations shown in the disclosure relate generally to tool systems for cleaning and drying enclosed channels such as composite structure hat stringers and more particularly to implementations for a tool having a body to be drawn through the channel with indexing by resilient supports for channel alignment.

Background

Many structures, including aircraft composite structures, have long runs of enclosed channels such as hat stringers. Composite structures in particular require very clean surfaces in such channels to provide desired performance including subsequent bonding and assembly operations during fabrication. Washing to flush the channel with cleaner to break free previous chemicals and trimmed dust, rinsing to flush the stringer with water to wash all chemicals, cleaners and solvent, and dry using wipers and high gas pressure to remove water and moisture, partially or completely, are required.

SUMMARY

Disclosed implementations provide a cleaning tool system with a central body and a fore body extending from the central body and having a peripheral contour shaped to be closely received in an enclosed channel. The fore body has orifices to dispense a cleaning medium. A connection boss in the central body is configured to receive a supply line for the cleaning medium. A plurality of stabilizers extend from the central body radially relative to a longitudinal axis to engage surfaces of the channel. A loop hook in the fore body is configured to attach a draw line to pull the fore body and central body through the channel along the longitudinal axis.

The disclosed implementations allow a method for cleaning an enclosed channel wherein a cleaning tool system, having a central body and a fore body extending from the central body, is inserted into an enclosed channel. A peripheral contour of the fore body is received into the enclosed channel to index the cleaning tool system. The enclosed channel is engaged with a plurality of stabilizers extending from the central body radially relative to a longitudinal axis. The fore body and central body are pulled through the channel along the longitudinal axis with a loop hook in the fore body attached to a draw line. A cleaning medium is dispensed from orifices in at least one of the fore body and central body.

BRIEF DESCRIPTION OF THE DRAWINGS

The features, functions, and advantages that have been discussed can be achieved independently in various implementations or combined in yet other implementations further details of which can be seen with reference to the following description and drawings.

DETAILED DESCRIPTION

The disclosed implementations described herein provide a cleaning tool system adaptable for wash, rinse and dry applications for an enclosed channel.

Figure 1A:
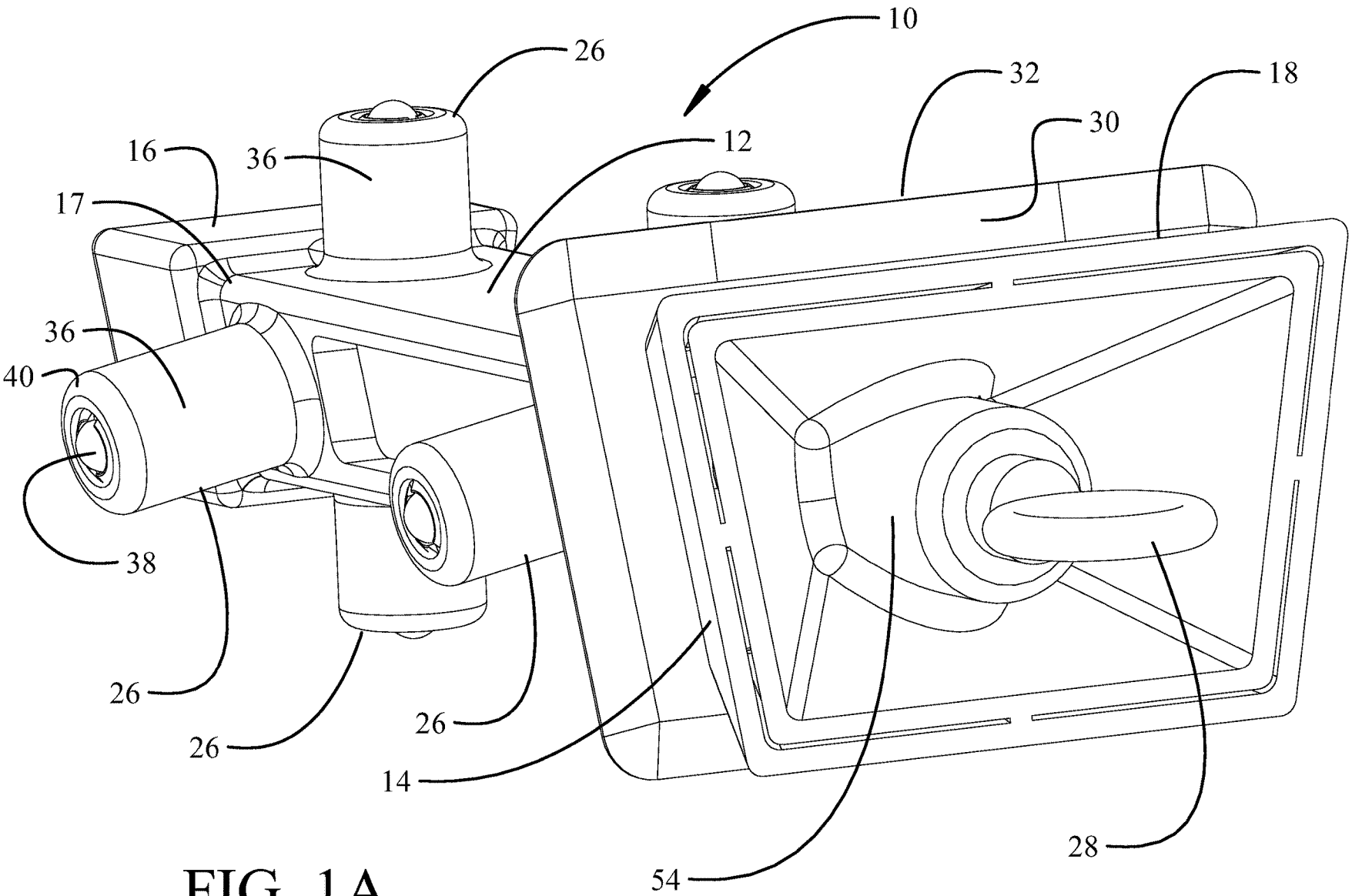
FIGS. 1A and 1B show an upper front pictorial representation and lower rear pictorial representation, respectively, of a first disclosed implementation of a tool system for a drying application.
Figure 1B:
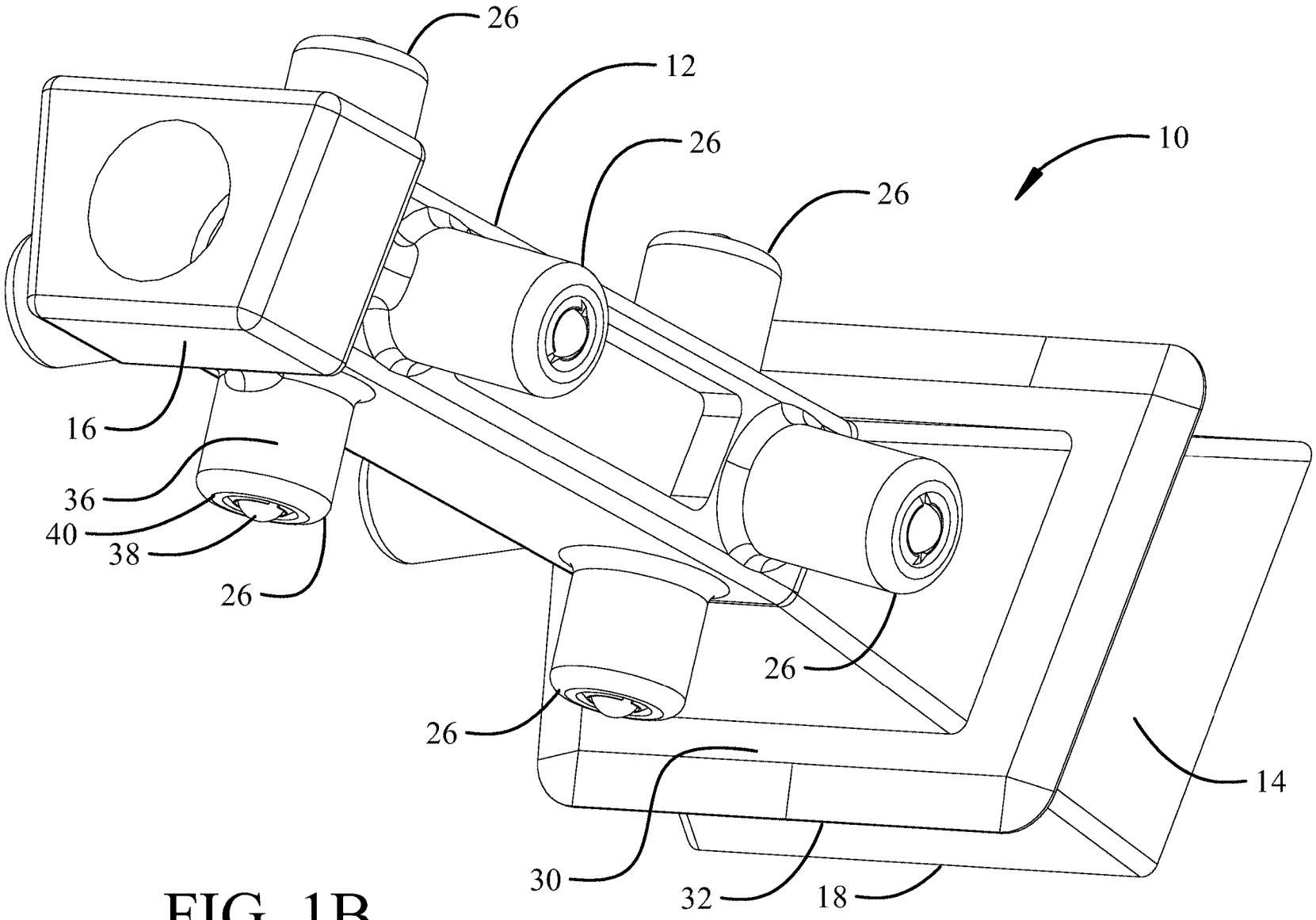
Figure 2A:
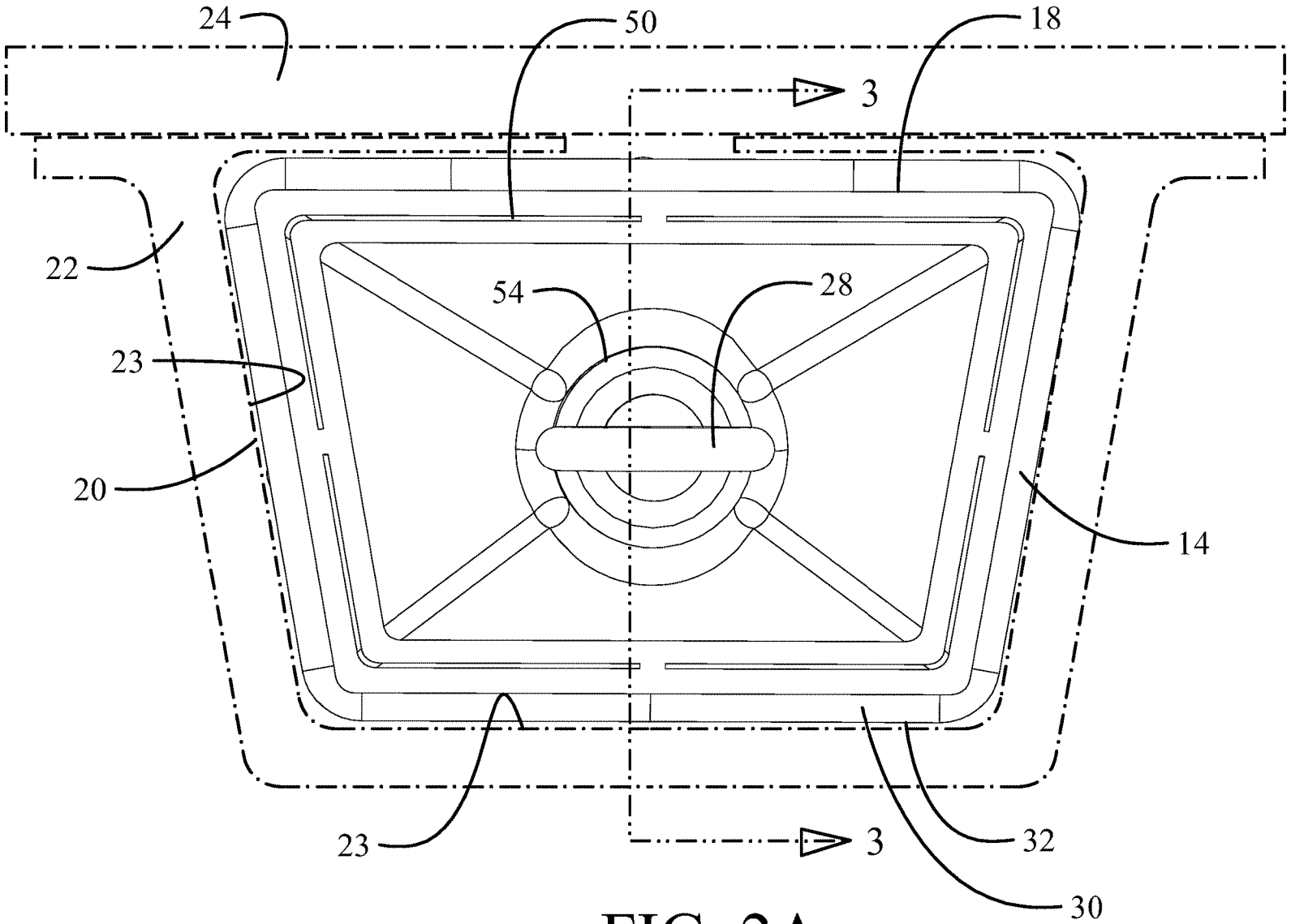
FIGS. 2A-2C show a front view, a side view, and rear view respectively, of the first implementation.
Figure 2B:
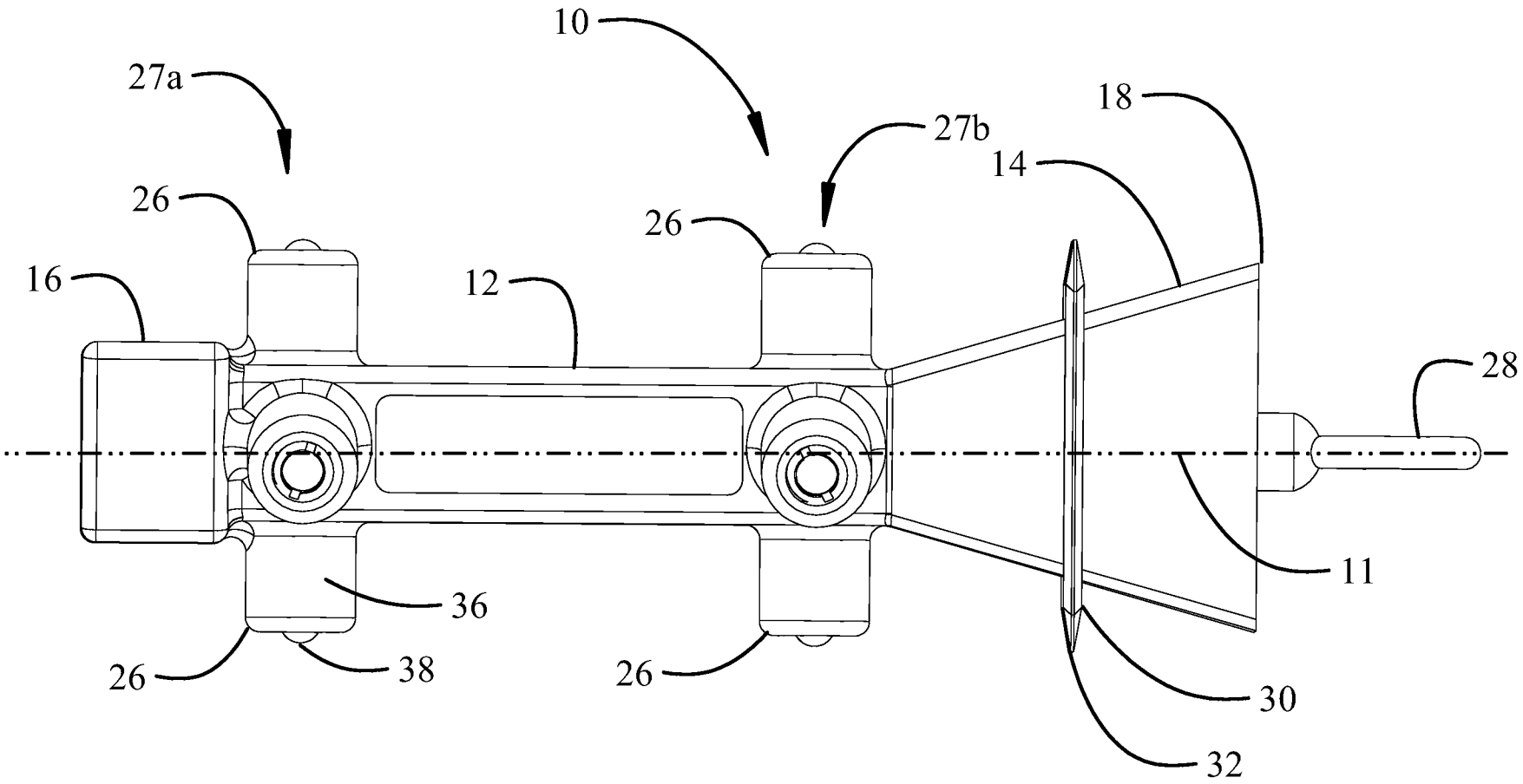
Figure 2C:
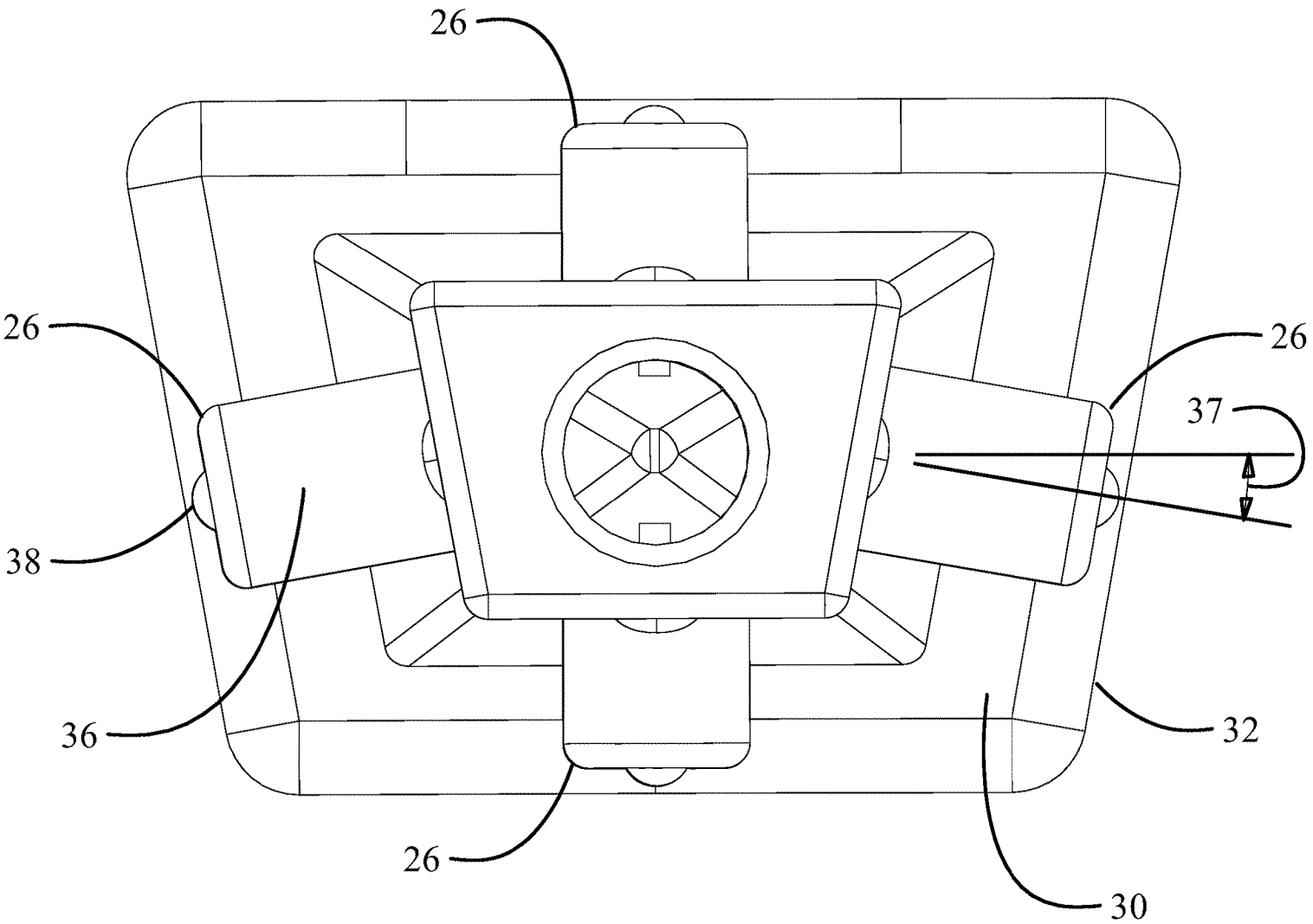

Referring to the drawings, FIGS. 1A and 1B show first disclosed implementation of a cleaning tool system 10 having a central body 12 and a fore body 14 extending from the central body. A connection boss 16 at an aft end 17 of the central body 12 provides an attachment interface for supply of a cleaning medium including water, solvents, degreased, cleaning fluids and drying air or other gas as will be described in greater detail subsequently. As best seen in FIG. 2A, the fore body 14 is has a peripheral contour 18 shaped to be closely received in an enclosed channel 20 such as a stringer 22 attached to a skin 24 with interior surfaces 23 and corners 25 (shown in phantom with exaggerated spacing for clarity of the system elements). The shaping of the peripheral contour 18 indexes the cleaning tool system 10 within the channel 20 maintaining a desired orientation as the cleaning tool system 10 is drawn through the channel. A plurality of stabilizers 26 extends radially relative to a longitudinal axis 11 from the central body 12 to engage surfaces of the channel 20 to support and index the cleaning tool system 10 in the channel 20 as seen in FIGS. 2B and 2C. A loop hook 28 is provided in the fore body 14 for attachment of a draw line to pull the cleaning tool system 10 through the channel along the longitudinal axis 11.

In the first implementation, the fore body 14 incorporates a wiper 30 having a resilient peripheral contour 32 concentric with the overall peripheral contour 18 (resilient peripheral contour 32 shown in an unflexed position). The peripheral contour 32 resiliently contacts surfaces 23 of the channel 20 to provide a wiping or squeegee effect as the cleaning tool system is drawn through the channel. The stabilizers 26 in the first implementation are support posts 36 extending from the central body 12 with roller balls 38 exposed at an outer end 40 to contact the surfaces 23. The support posts 36 for the disclosed implementation are fabricated with elastic material to be compliant. In other implementations, other types of materials that enable similar compliance are used. Alternatively or additionally, the roller balls 38 are mounted with springs 42 within the support posts 36 as seen in FIG. 3.

The channel 20 in which the first implementation is employed has a substantially trapezoidal cross section and the peripheral contours 18, 32 have a corresponding trapezoidal shape. Different geometric cross section of the channel are also accommodated in different implementations with modification of the contours 18, 32 and length and orientation of the stabilizers 26.

The resilient peripheral contour 32 of wiper 30 and the stabilizers 26 cooperatively prevent yaw and pitch of the cleaning tool system 10 while being drawn through the channel. For the disclosed implementation shown in the drawings two sets 27*a* and 27*b* of four stabilizers spaced longitudinally fore and aft on the central body 12 are employed. However, in alternative embodiments only an aft set of stabilizers in combination with resilient peripheral contour 32 of the wiper 30 provides sufficient resistance to yaw and pitch. As best seen in FIG. 2C, selected support posts 36 extend from the central body 12 at angles 37 predetermined based on the geometric shape of the channel 20 to provide substantially perpendicular orientation of the stabilizers 26 for contact of the roller balls 38 on the channel surfaces 23. For the disclosed implementation, the cross section of the central body 12 is also trapezoidal.

Figure 3:
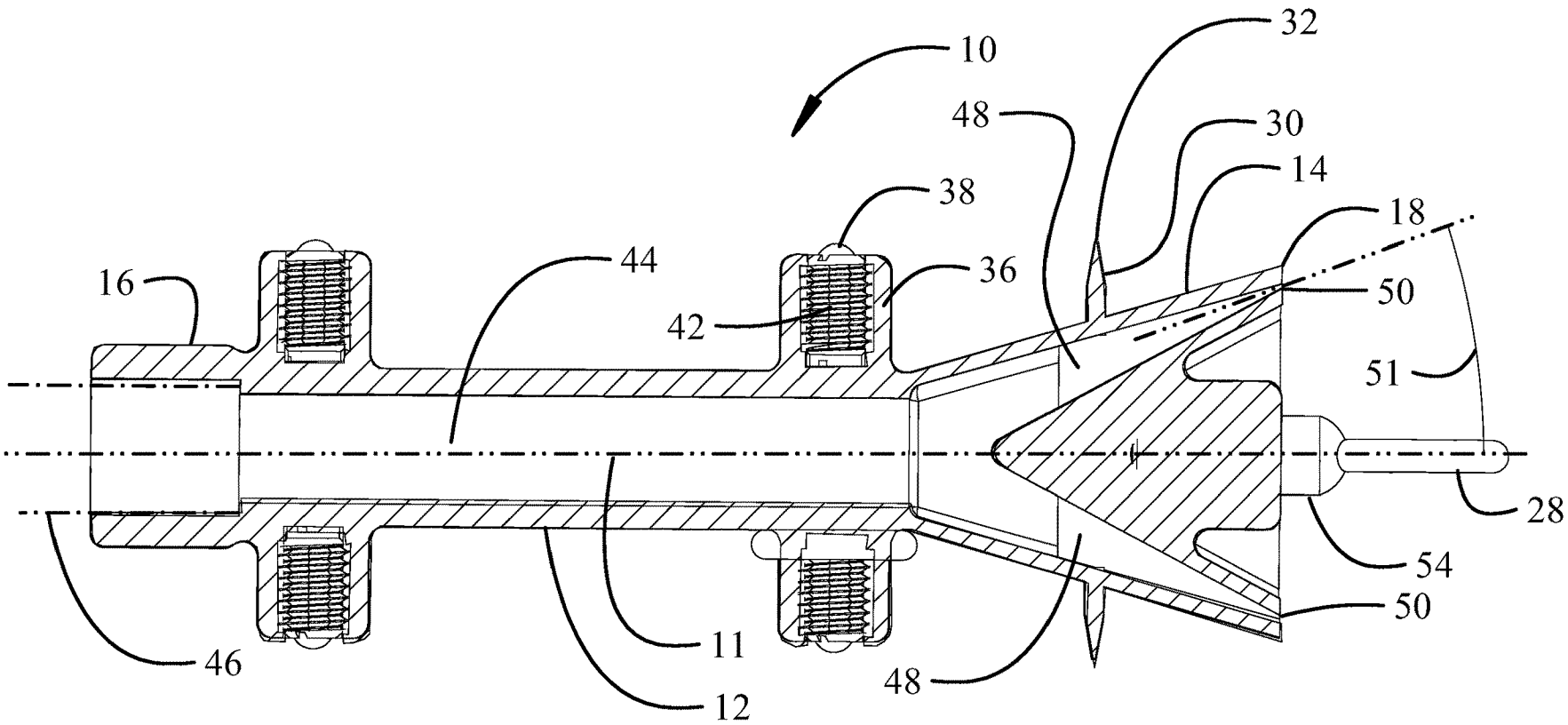
FIG. 3 shows a side section view of the first implementation.
Figure 4A:
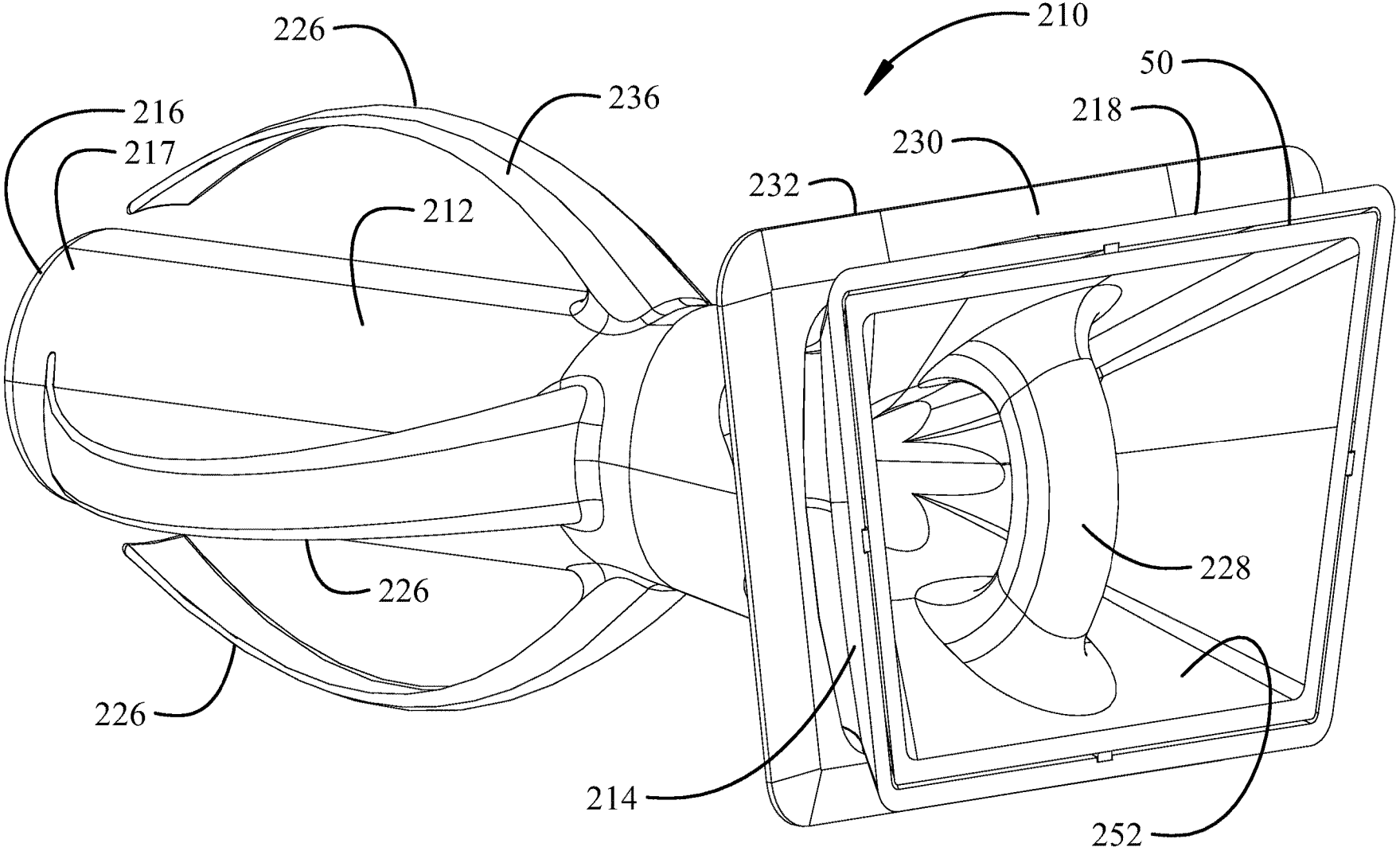
FIGS. 4A and 4B show an upper front pictorial representation and lower rear pictorial representation, respectively, of a second disclosed implementation of a tool system for a drying application.
Figure 4B:
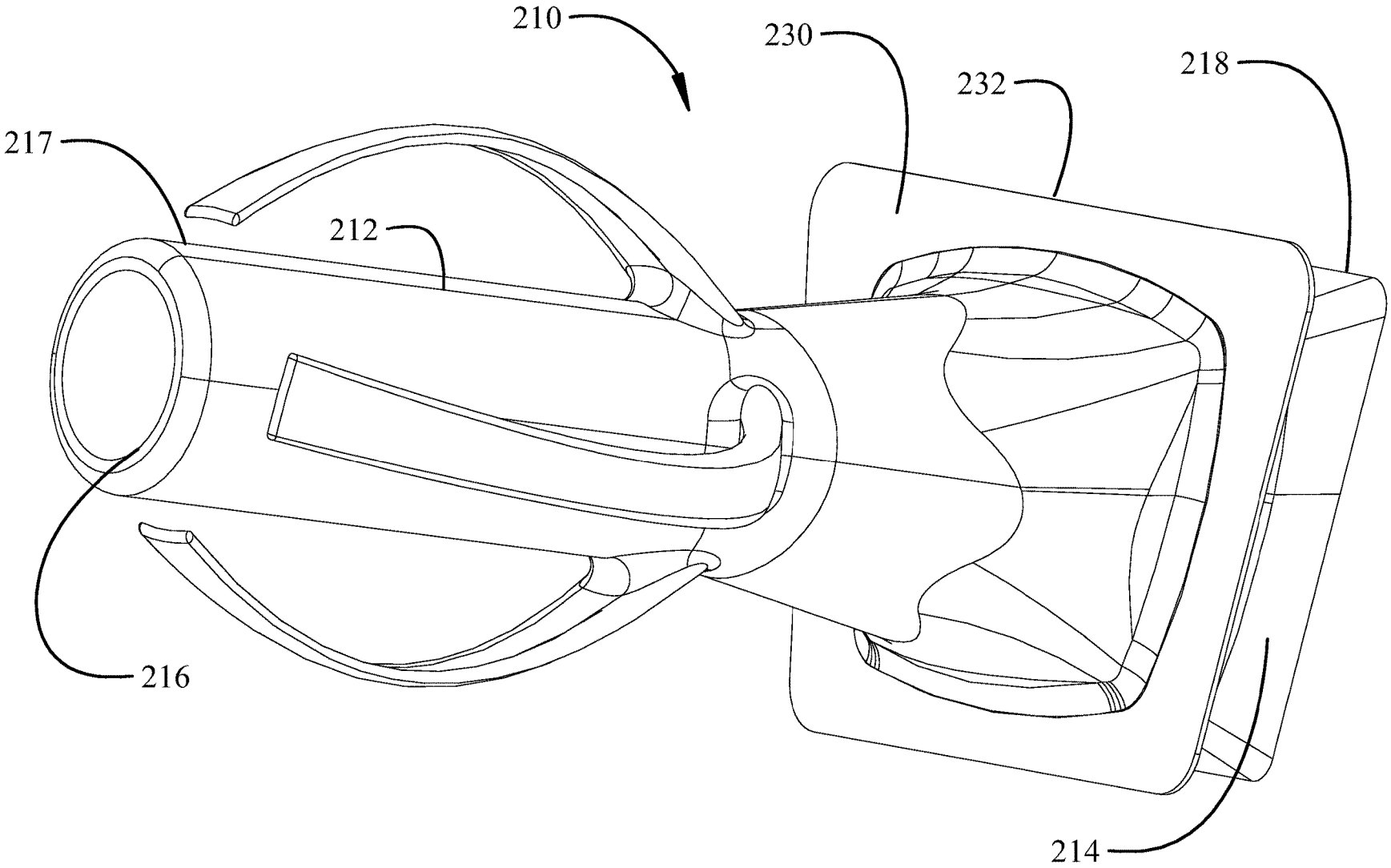

As seen in FIG. 3, the central body 12 incorporates a plenum 44. The first implementation is a drying tool and the plenum 44 receives pressurized gas as the cleaning medium from a supply line 46 engaged longitudinally in the connection boss 16. In some implementations, the gas is selected to be one or more of air, nitrogen or other inert gas depending on process requirements. The fore body 14 has vent channels 48 in fluid communication with the plenum 44 and terminating in one or more orifices 50 to distribute the pressurized gas as a first disclosed cleaning medium. In the disclosed implementation the vent channels 48 are constricting nozzles to increase gas flow velocity for ejection from the orifices 50, which have an elongated rectangular shape to enhance drying effect on the surfaces 23 of the channel 20. The vent channels 48 and orifices 50 are oriented to provide a flow having an angle 51 relative to the longitudinal axis to maximize impingement of the gas on the channel walls for a blowing or drying effect to expel water, or other fluids or accumulated matter from the stringer, or provide a drying effect for the surfaces. Depending on the implementations, the shapes of orifices 50 are selected to maximize the impingement of the gas. In some examples, orifices 50 are selected to be one or more or a combination of circular, semicircular, oval or adjacent rectangular slots (dashed slots). The cross sectional area and shape of the vent channels 48 is determined based on gas pressure available at the source and the vent channels 48 in certain implementations provide a spiral contour about the longitudinal axis to provide desirable airflow dynamics in the ejected flow. The loop hook 28 is connected to a central stub 54 in the first implementation.

Figure 5A:
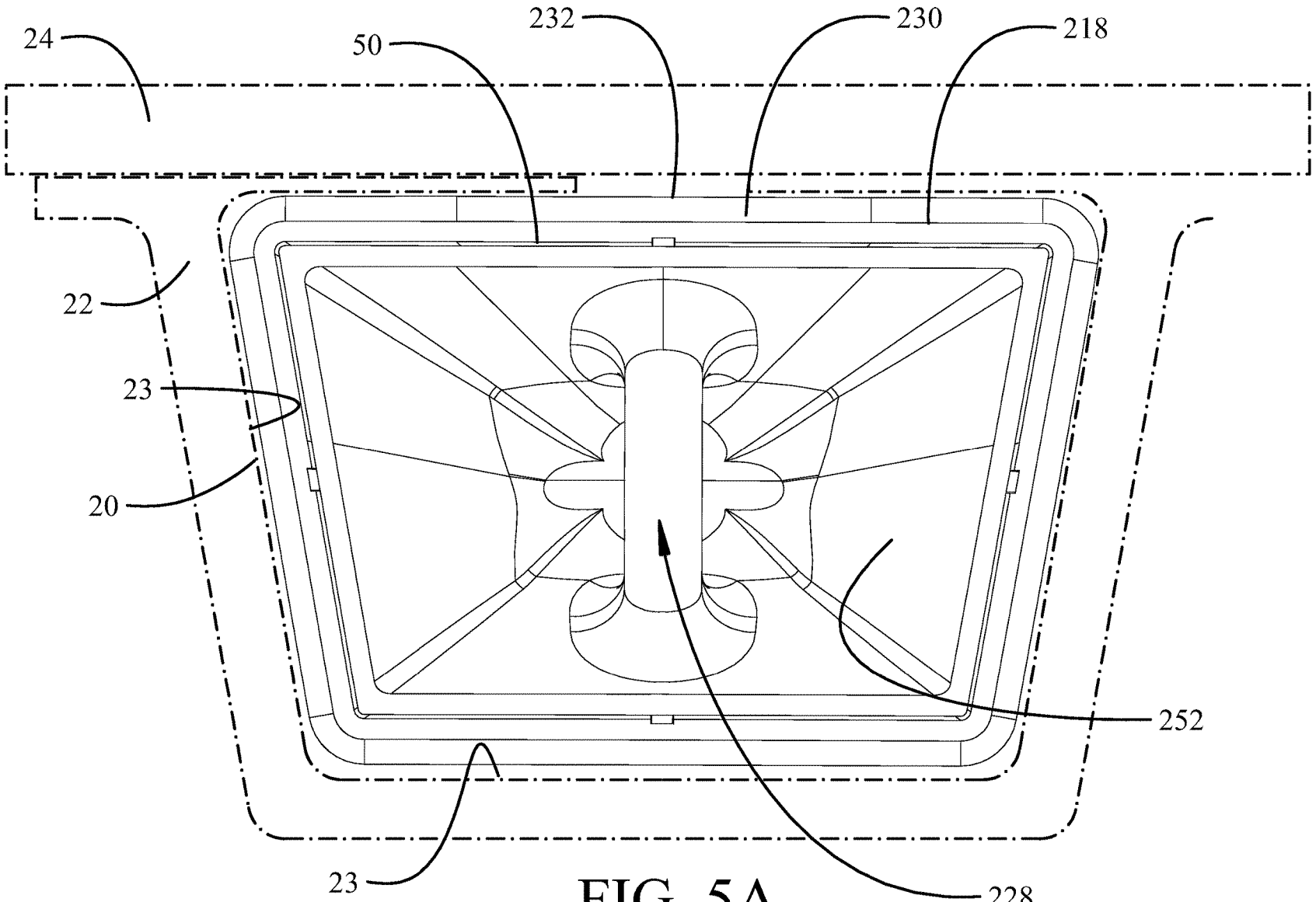
FIGS. 5A-5C show a front view, a side view, and rear view respectively, of the second implementation.
Figure 5B:
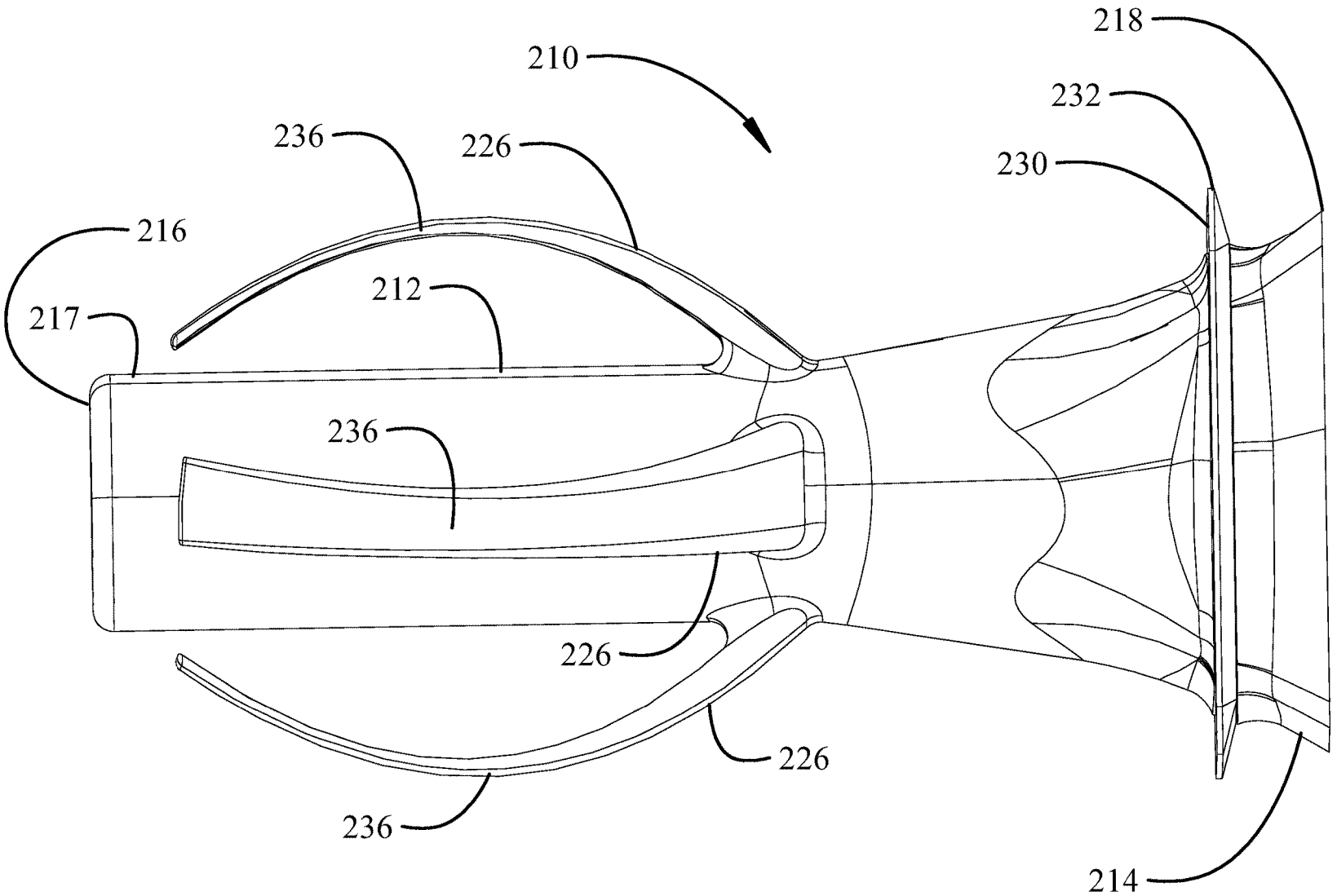
Figure 5C:
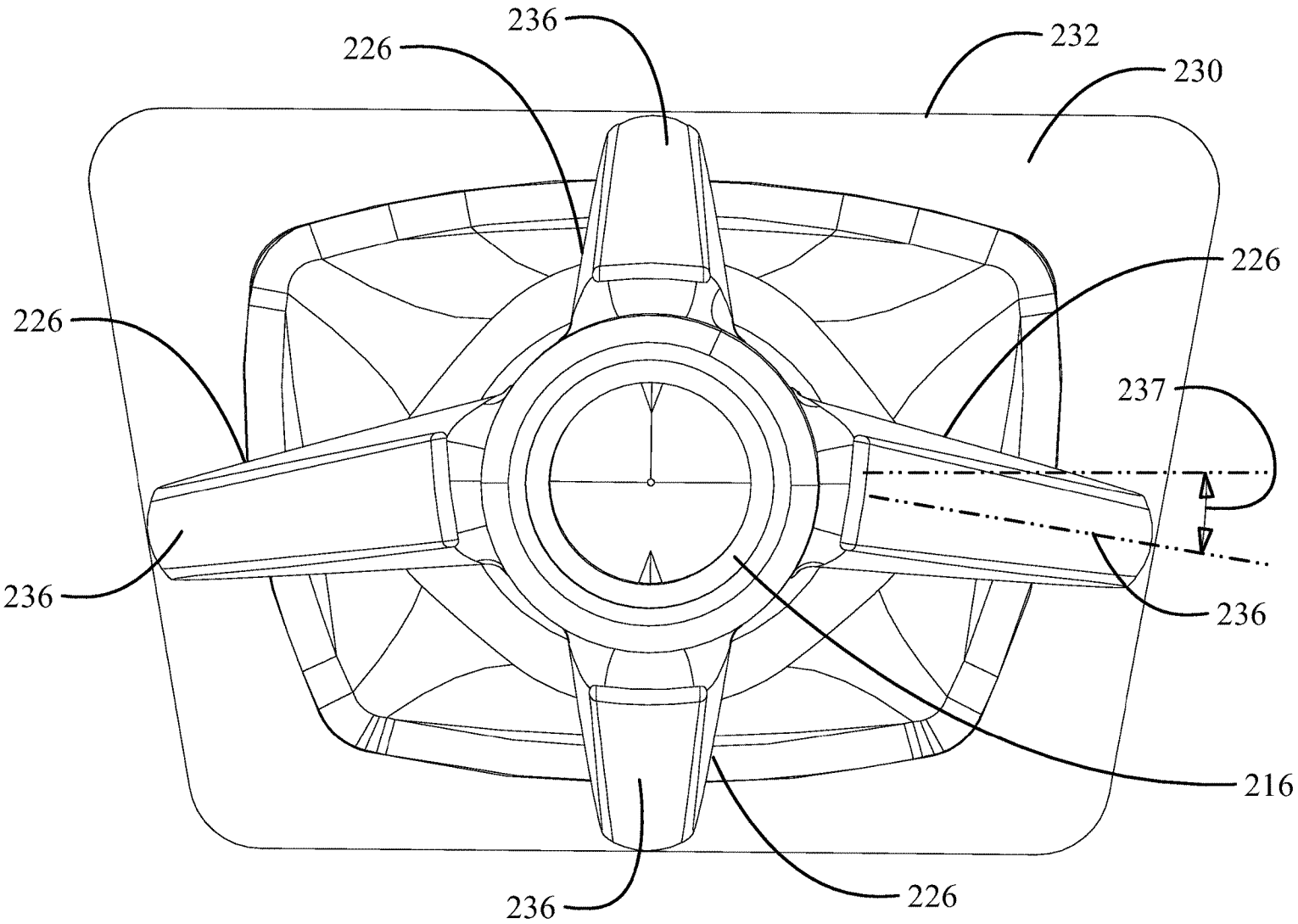
Figure 6:
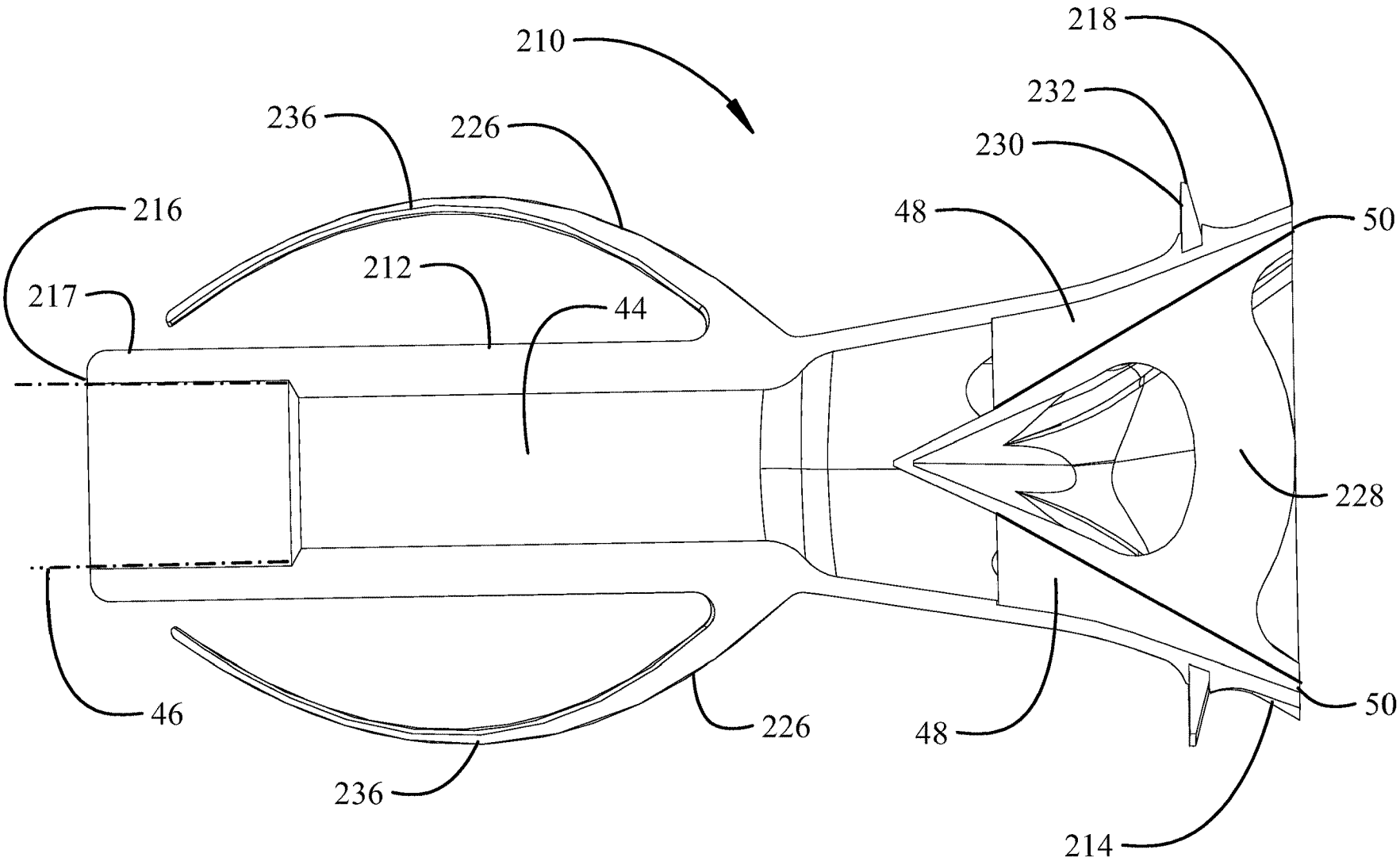
FIG. 6 shows a side section view of the second implementation.

A second disclosed implementation of a cleaning tool system 210 is shown in FIGS. 4A and 4B, 5A-C and 6. A central body 212 has a fore body 214 extending from the central body. A connection boss 216 at an aft end 217 of the central body 212 provides an attachment interface for a cleaning medium supply as in the first implementation. As seen in FIG. 5A in a substantially comparably structure to the first implementation, a peripheral contour 218 of the fore body 214 is shaped to be closely received in the enclosed channel 20. The shaping of the peripheral contour 218 is consistent with indexing of the cleaning tool system 210 within the channel 20 and provides placement of cleaning medium orifices in close proximity near and to the surfaces to be cleaned as will be described in greater detail subsequently. In the second implementation, plurality of flexing stabilizers 226 extends from the central body to engage surfaces of the channel 20 to support the cleaning tool system 10 in the channel 20 as seen in FIGS. 5B and 5C. A loop hook 228 is provided in the fore body 214 for attachment of a draw line to pull the cleaning tool system 210 through the channel.

As in the first implementation, the fore body 214 incorporates a wiper 230 having a resilient peripheral contour 232 concentric with the overall peripheral contour 218 (resilient peripheral contour 232 shown in an unflexed position) to resiliently contact surfaces 23 of the channel 20 for indexing of the cleaning tool system and to provide the desired wiping or squeegee effect. In one example, the wiper 230 additionally enhances yaw and pitch control of the cleaning tool system.

The stabilizers 226 in the second implementation are curved flexing arms 236 extending from the central body 212 proximate the fore body 214 and curving aft to resiliently contact the channel surfaces 23. The flexing arms 236 are fabricated with elastic material to be compliant and provide sliding engagement of the channel surfaces 23. Use of flexible arms or a compliant spring accommodates varying cross-sectional geometry of the channels from stringer to stringer and panel to panel.

As in the first implementation the channel 20 has a substantially trapezoidal cross section and the peripheral contours 218, 32 have a corresponding trapezoidal shape. As best seen in FIG. 5C, selected flexing arms 236 are angularly oriented to extend from the central body 12 at angles 237 predetermined based on the geometric shape of the channel 20 to provide substantially coincident planar orientation of the arms 236 for contact on the channel surfaces 23. For the second implementation the central body 212 is circular in cross section.

In the second implementation, plenum 44, vent channels 48 in fluid communication with the plenum 44 and orifices 50 are configured for operation substantially identically to the first implementation. The fore body 214 has a truncated pyramidal cavity 252, best seen in FIG. 4A, to provide access to the loop hook 228. The loop hook 228 is connected to opposing sides of the pyramidal cavity 252.

Figure 7A:
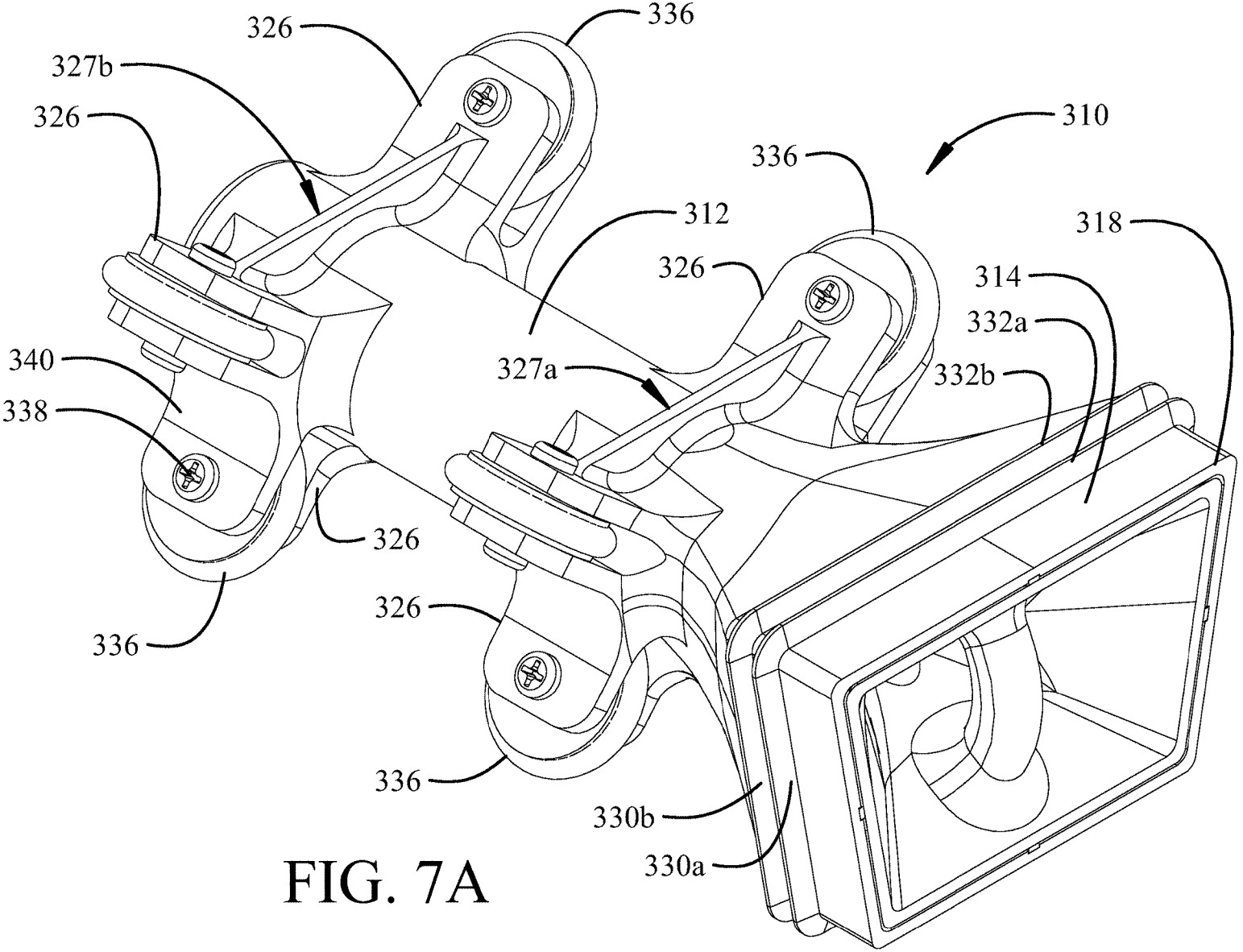
FIGS. 7A and 7B show an upper front pictorial representation and lower rear pictorial representation, respectively, of a third disclosed implementation of a tool system for a drying application.
Figure 7B:
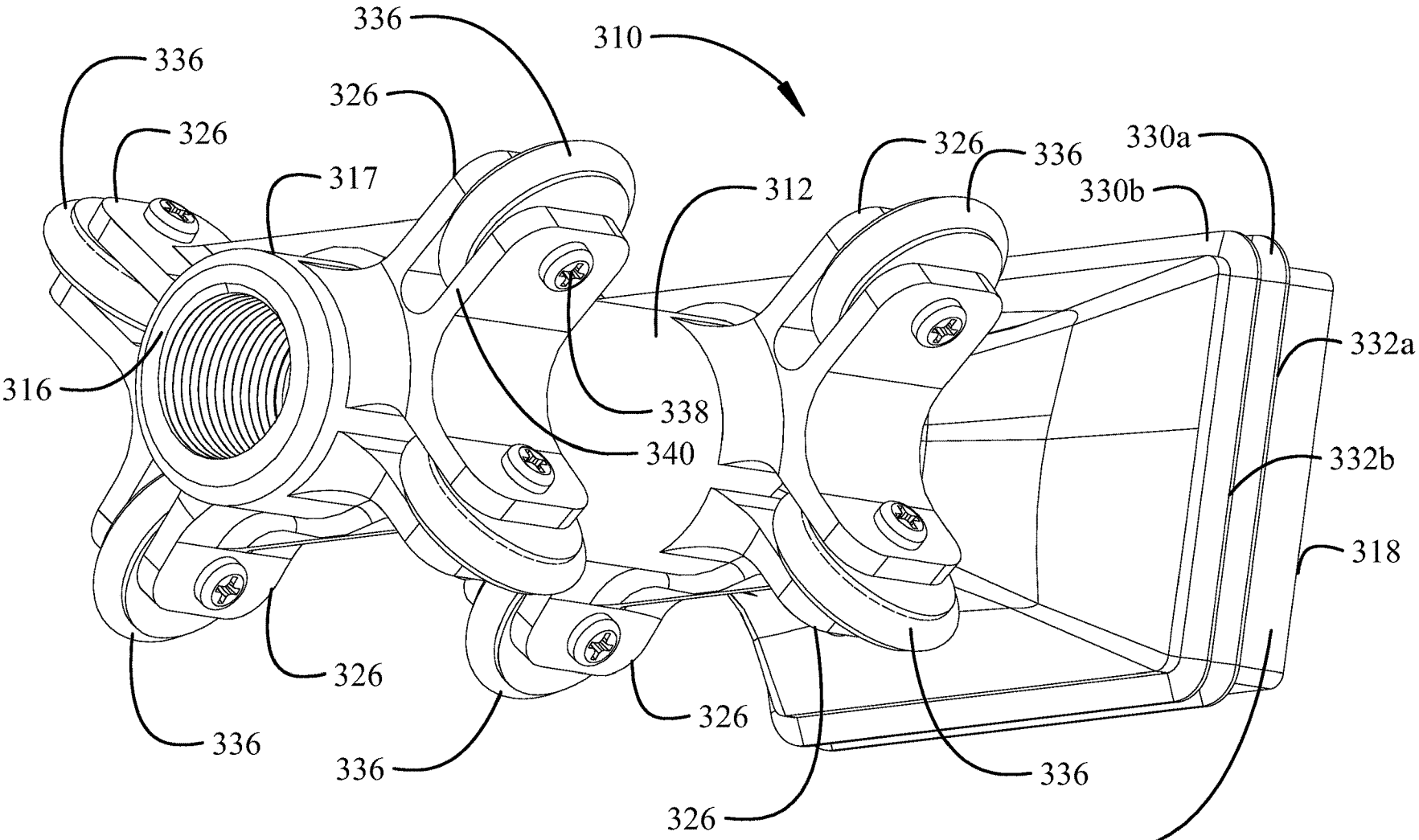

A third disclosed implementation of a cleaning tool system 310 is shown in FIGS. 7A and 7B, 8A-C and 9. A central body 312 has a fore body 314 extending from the central body. A connection boss 316 at an aft end 317 of the central body 312 provides an attachment interface for cleaning medium supply as in the prior implementations. As seen in FIG. 7A in a substantially comparably structure to the first implementation, a peripheral contour 318 of the fore body 314 is shaped to be closely received in the enclosed channel 20. The shaping of the peripheral contour 318 is consistent with indexing of the cleaning tool system 310 within the channel 20 and provides placement of cleaning medium orifices in close proximity near and to the surfaces to be cleaned.

In the third implementations, the fore body 314 incorporates two wipers 330*a* and 330*b* having concentric resilient peripheral contour 332*a*, 332*b*. Resilient peripheral contours 332*a* and 332*b* are also concentric with the overall peripheral contour 318 (the resilient peripheral contours 332*a* and 332*b* shown in an unflexed position) and resiliently contact surfaces 23 of the channel 20 to provide the desired wiping or squeegee effect.

Figure 8A:
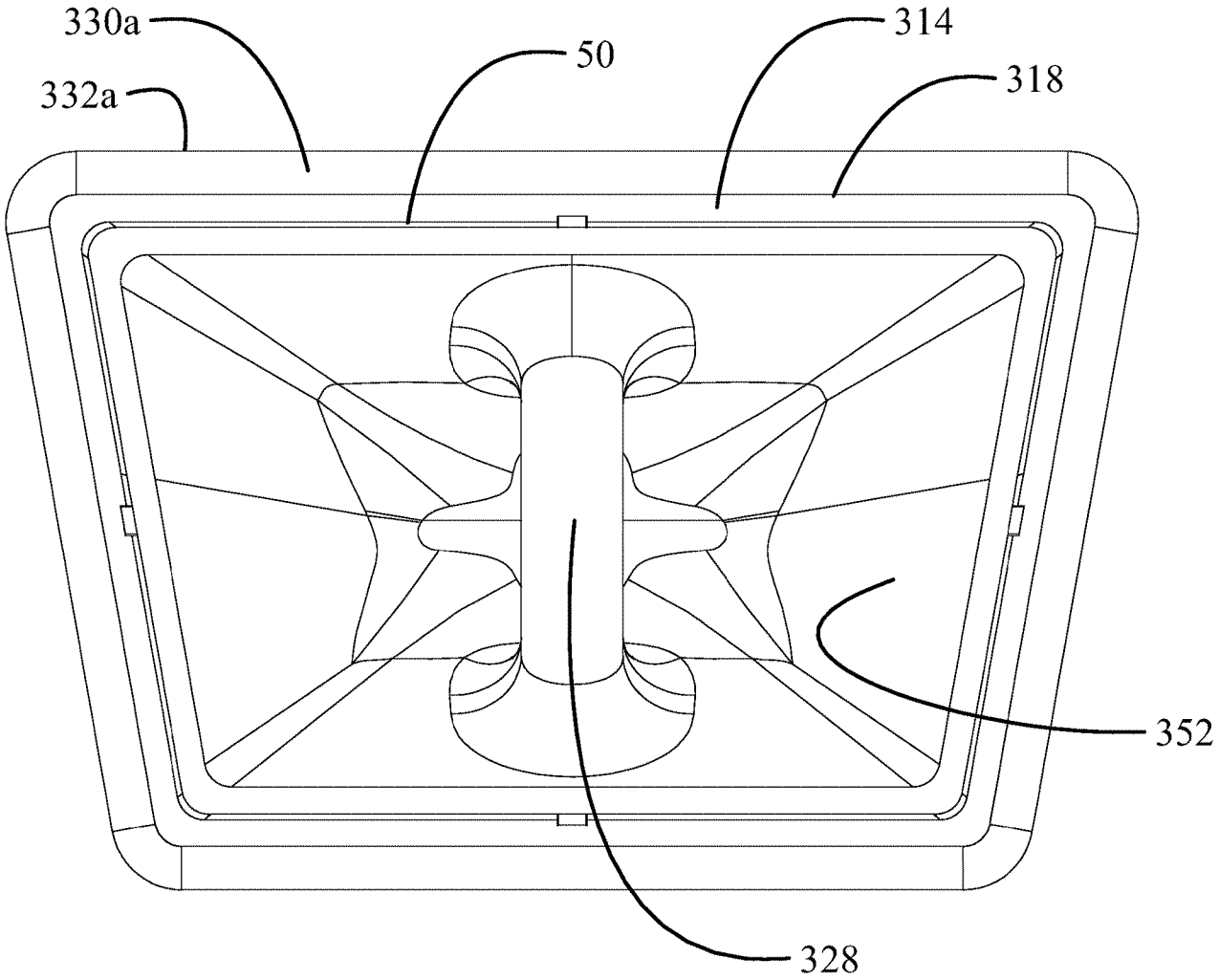
FIGS. 8A-8C show a front view, a side view, and rear view respectively, of the third implementation.
Figure 8B:
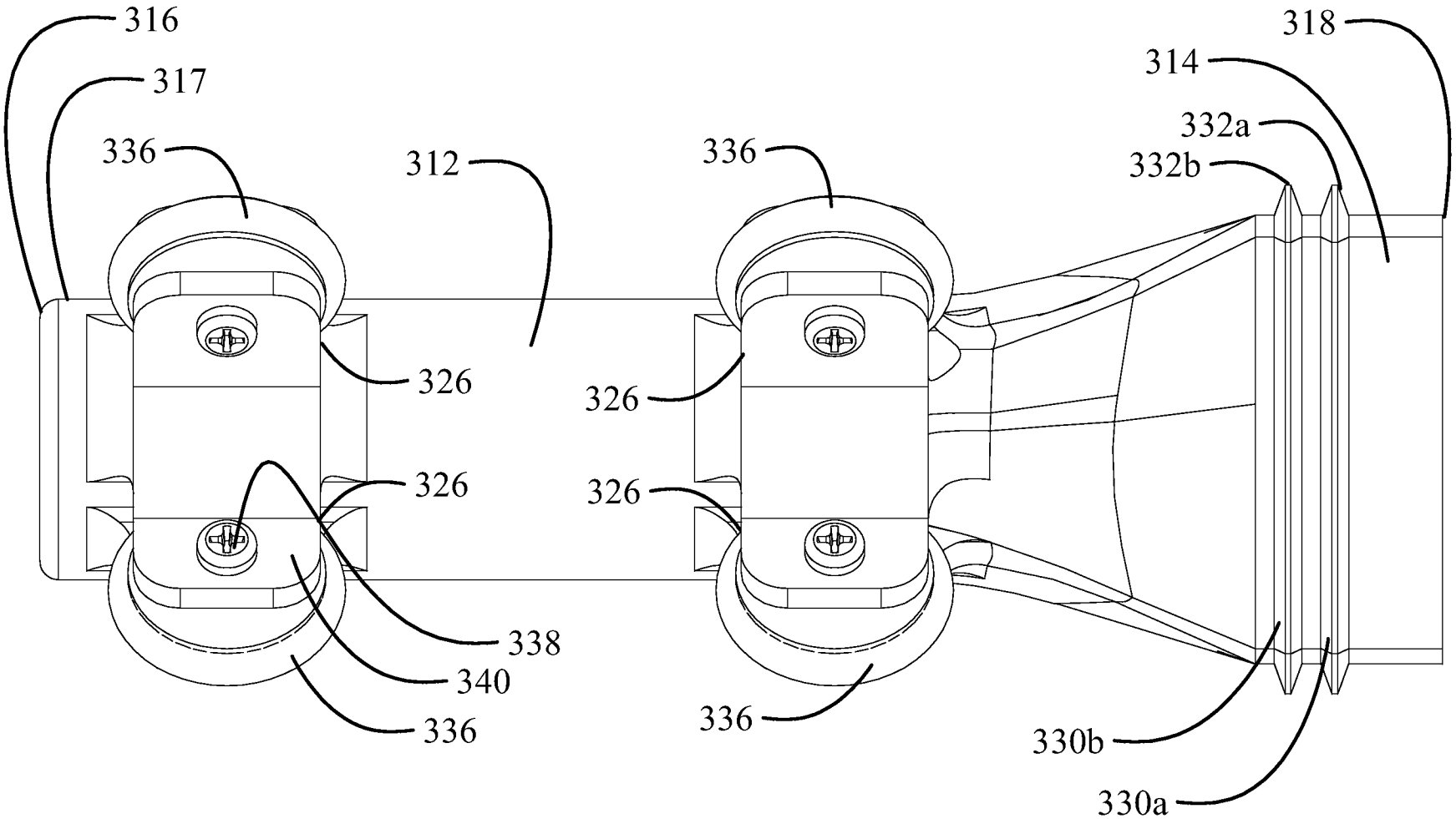
Figure 8C:
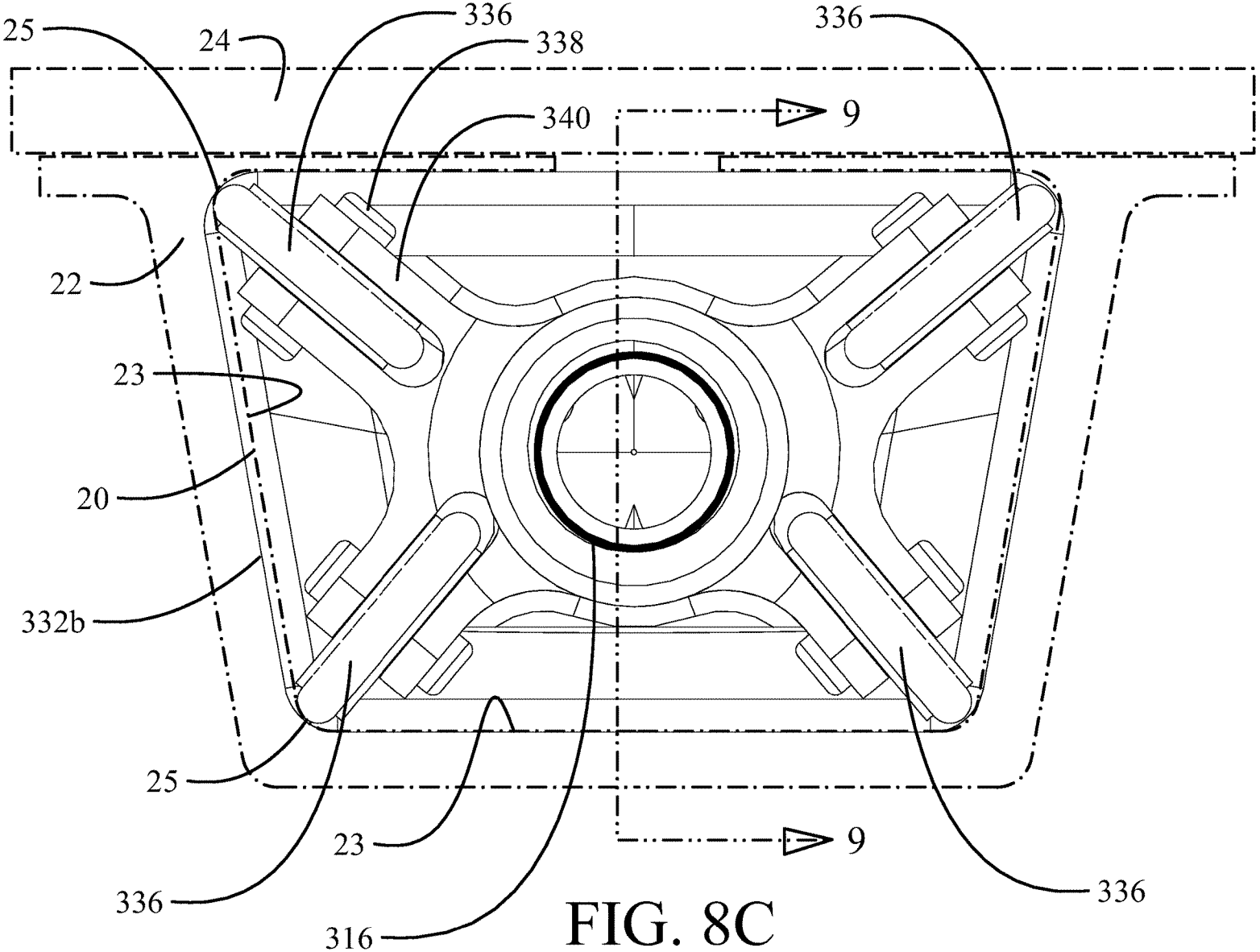
Figure 9:
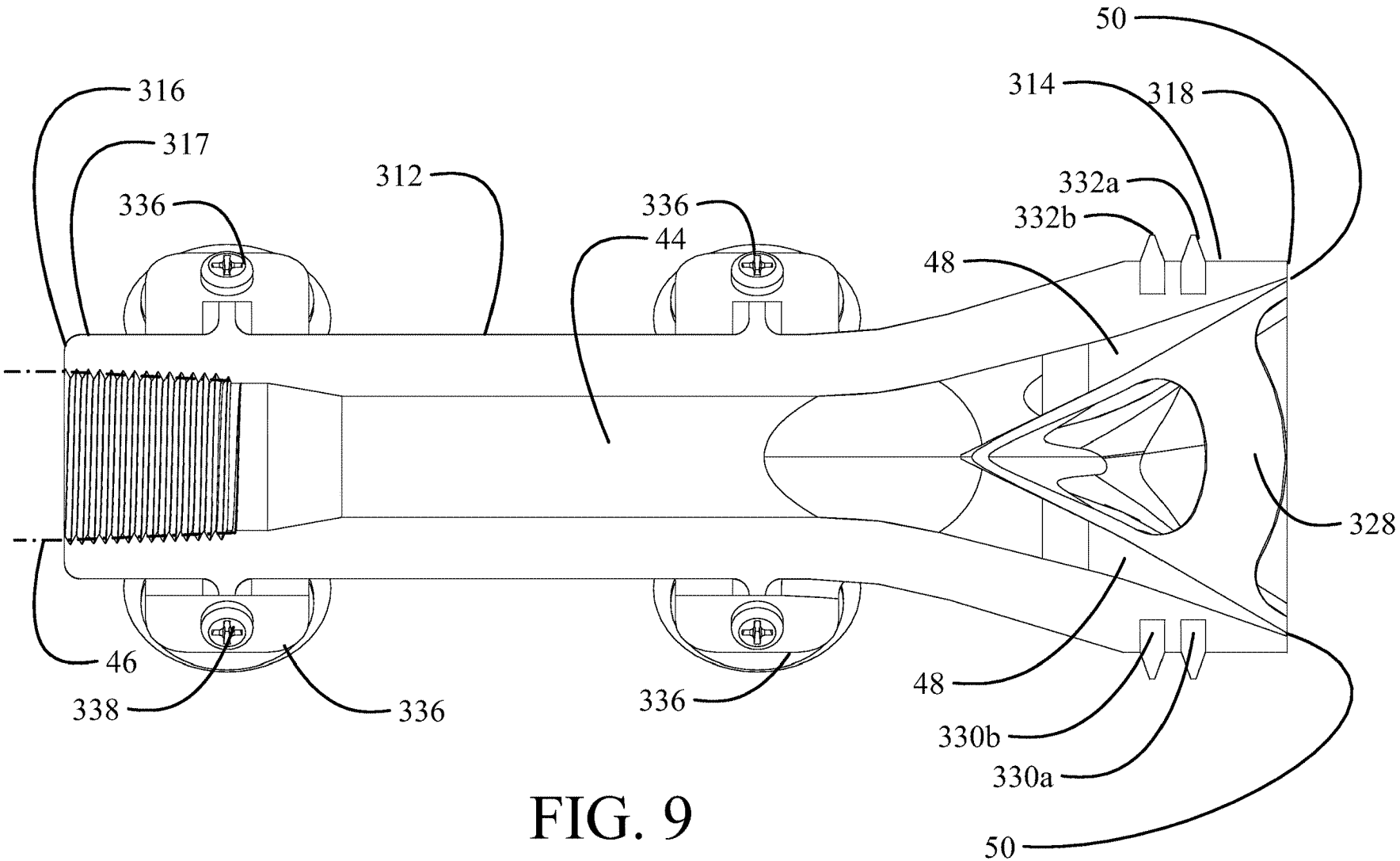
FIG. 9 shows a side section view of the third implementation.
Figure 10A:
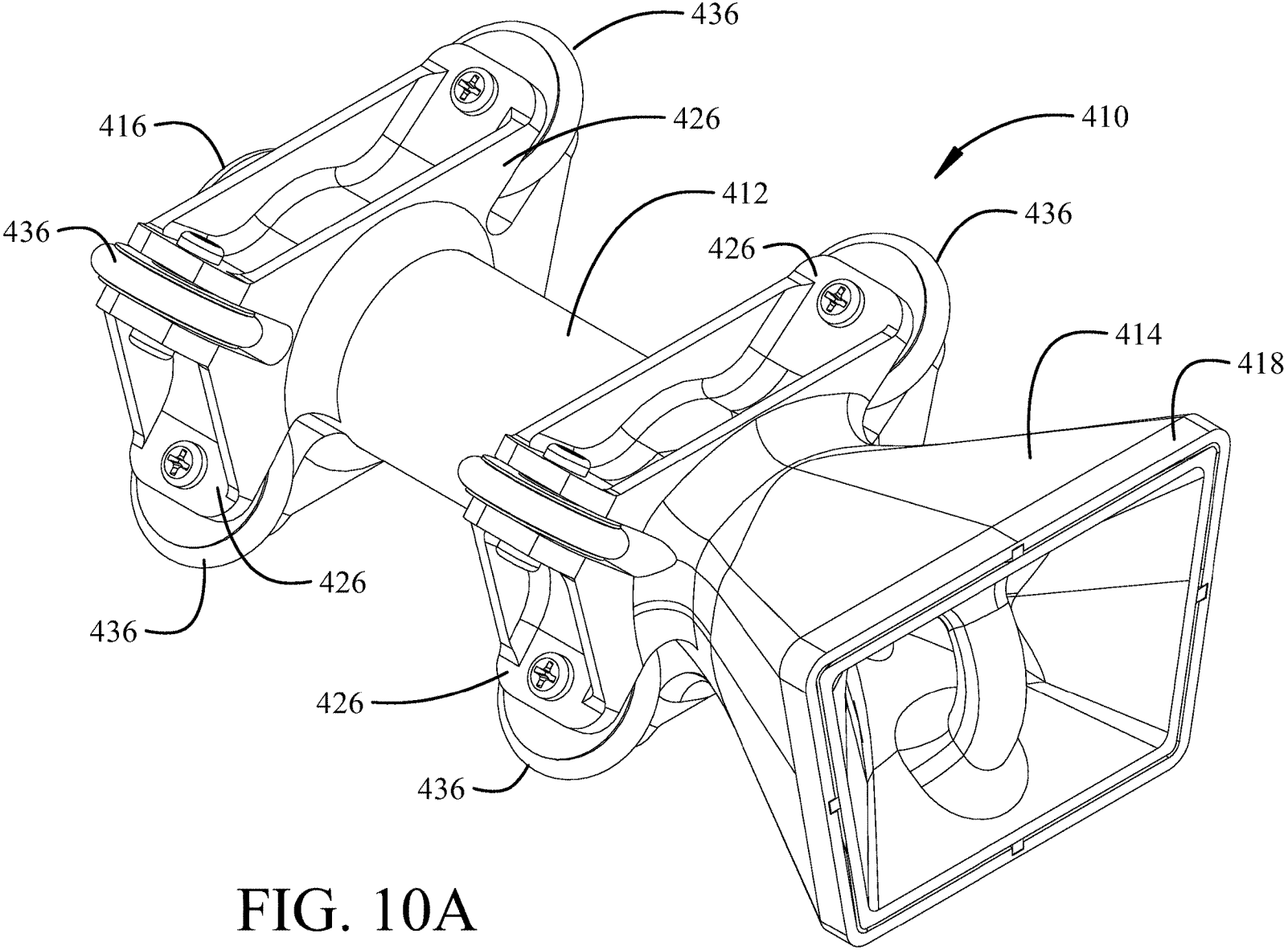
FIGS. 10A and 10B show an upper front pictorial representation and lower rear pictorial representation, respectively, of a fourth disclosed implementation of a tool system for a drying application.
Figure 10B:
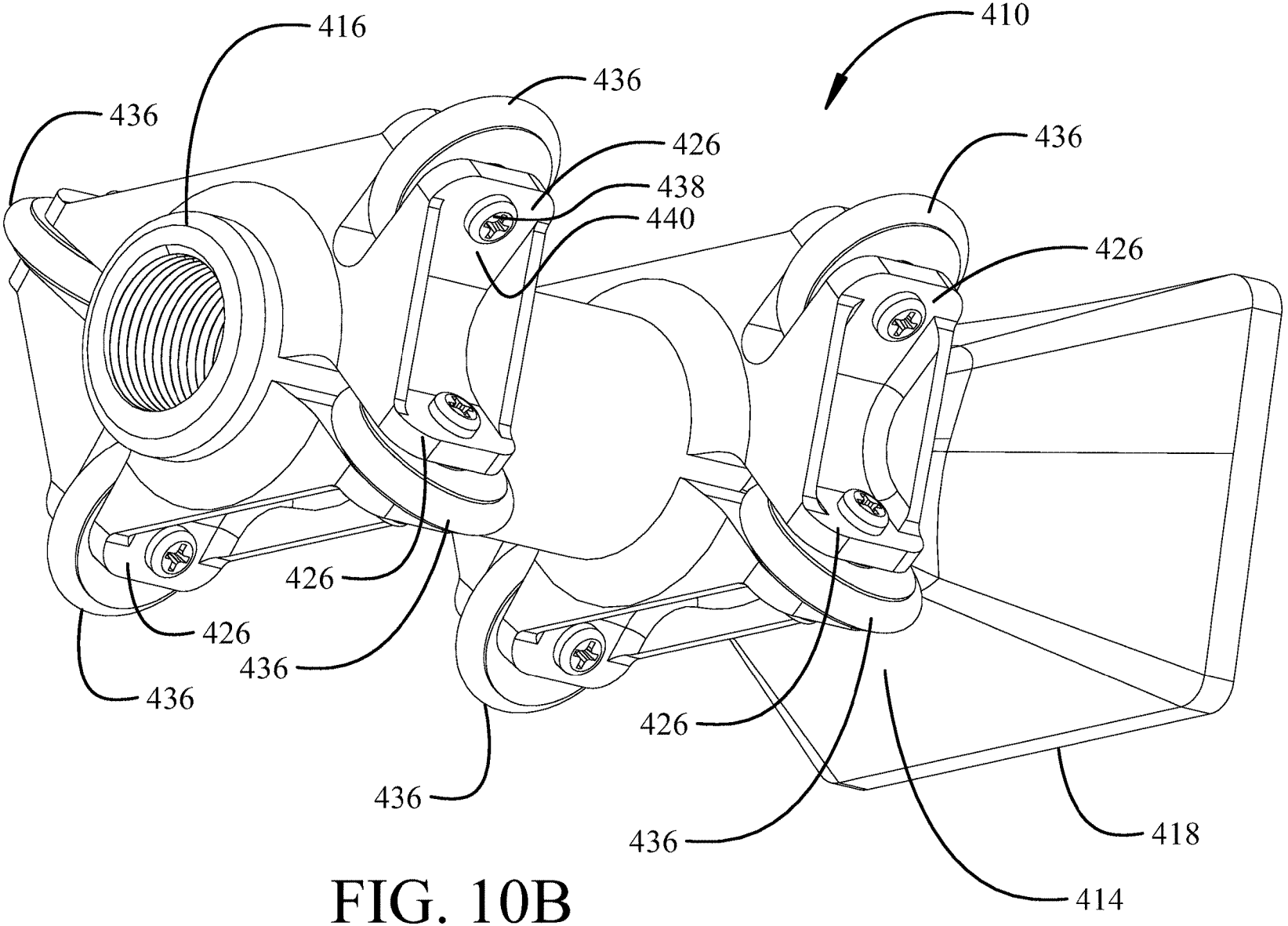
Figure 11A:
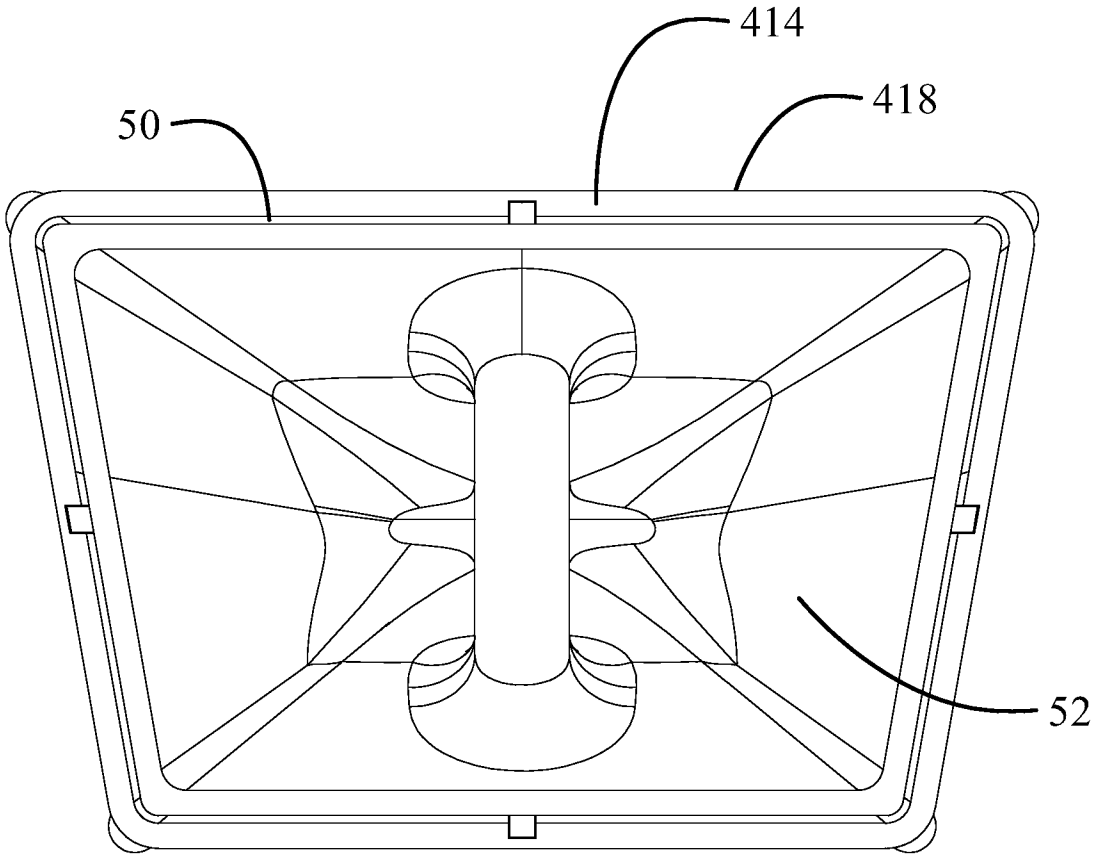
FIGS. 11A-11C show a front view, a side view, and rear view respectively, of the fourth implementation.
Figure 11B:
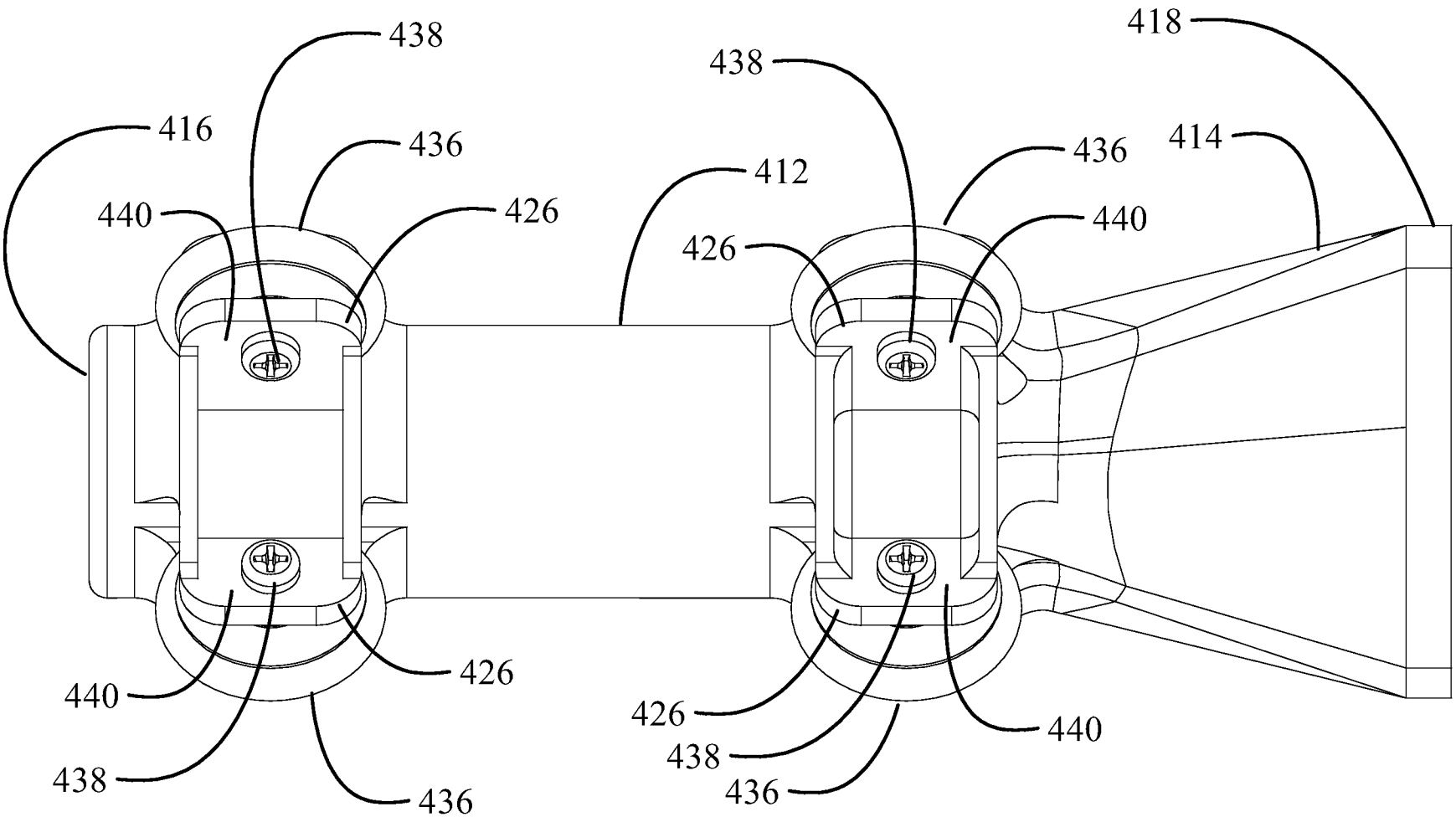
Figure 11C:
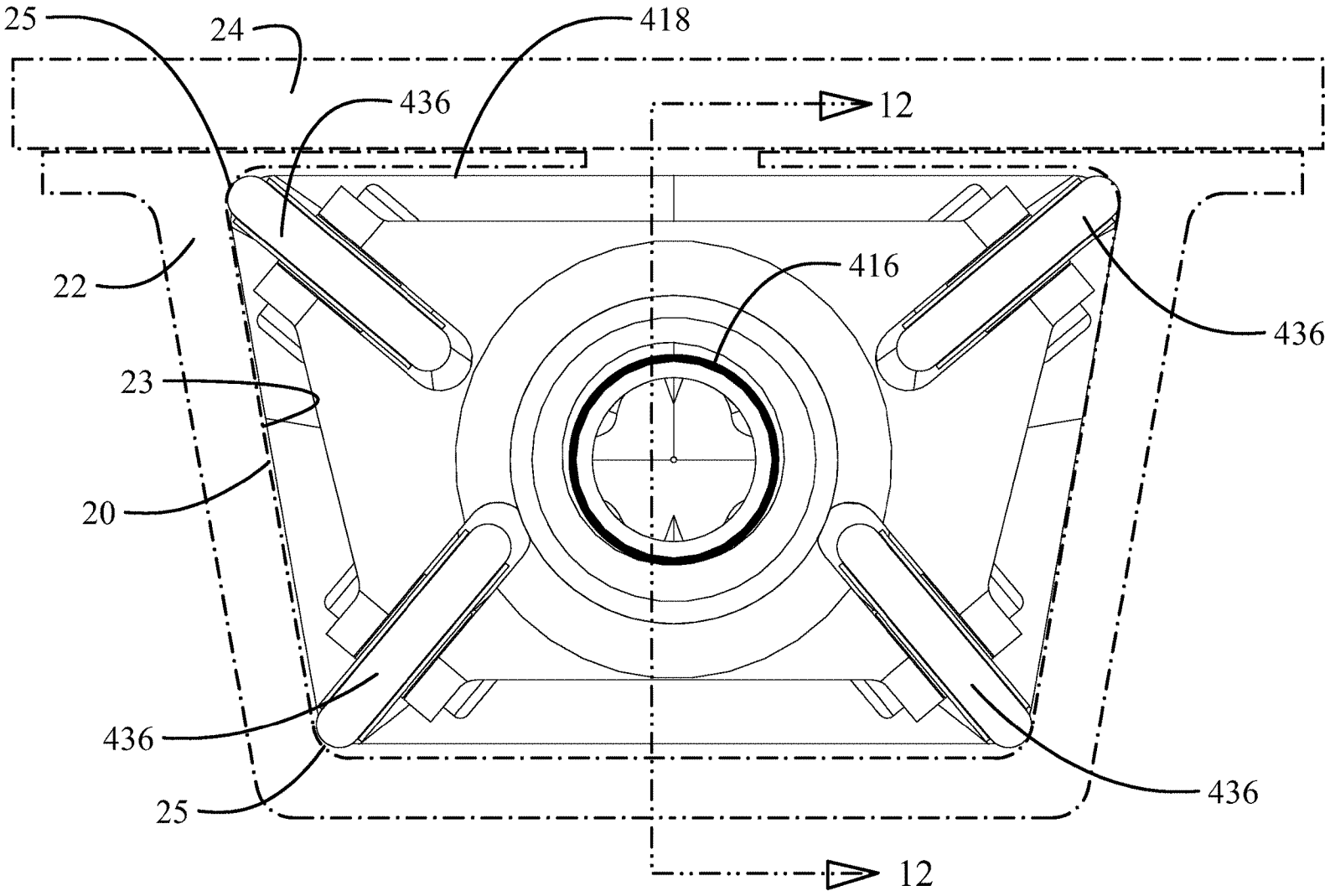
Figure 12:
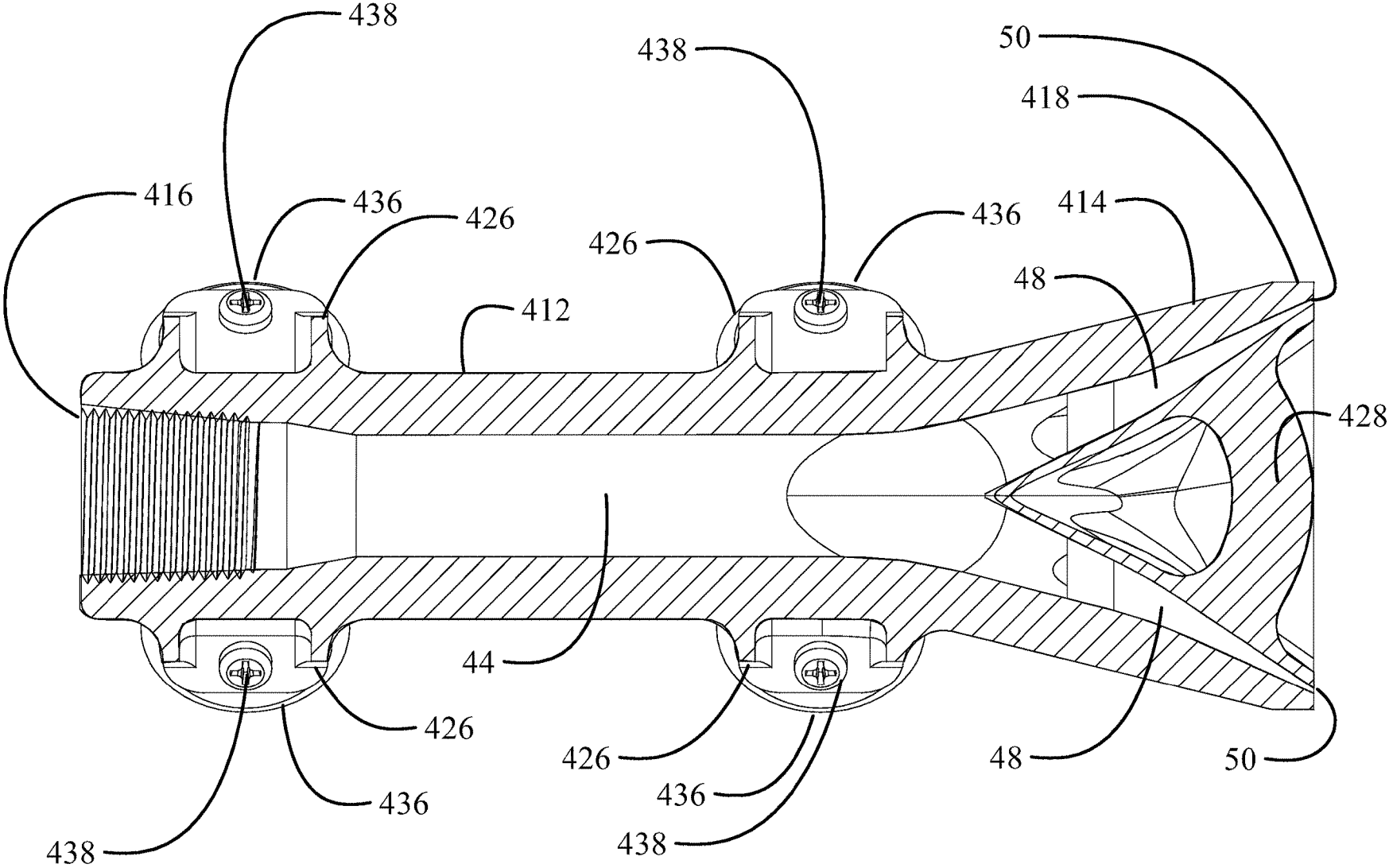
FIG. 12 shows a side section view of the fourth implementation.
Figure 13A:
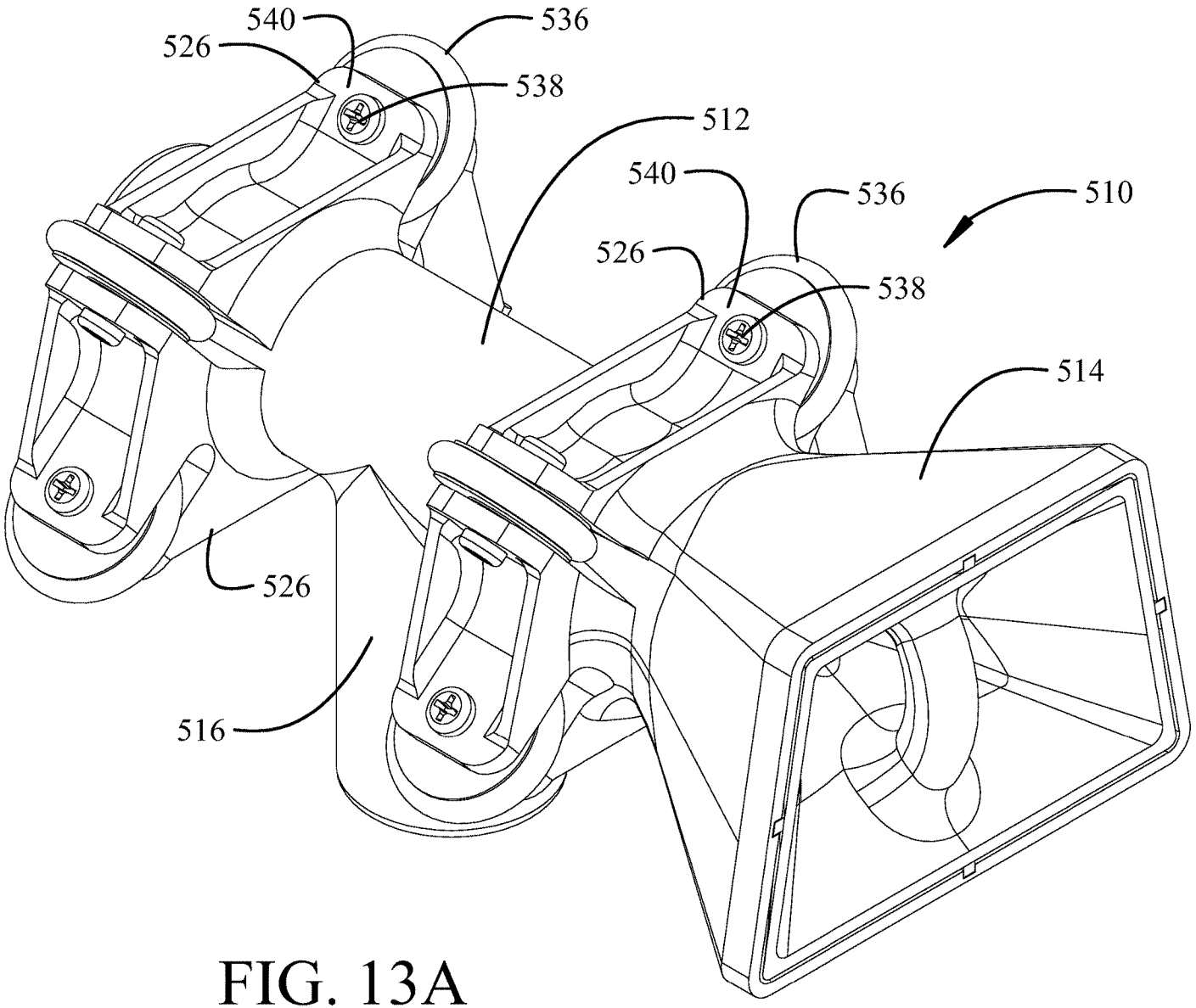
FIGS. 13A and 13B show an upper front pictorial representation and lower rear pictorial representation, respectively, of a fifth disclosed implementation of a tool system for a wash or rinse application.
Figure 13B:
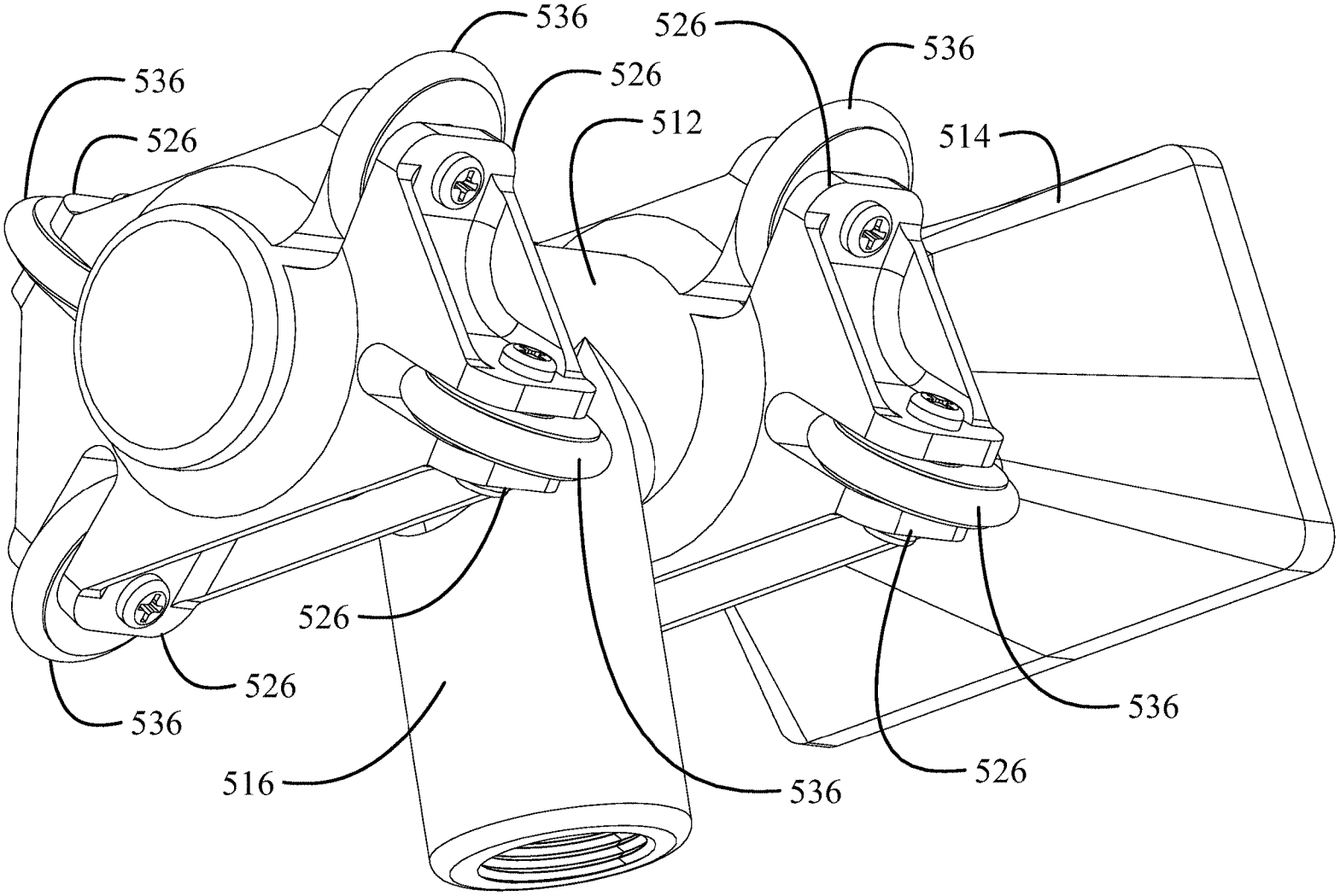
Figure 14A:
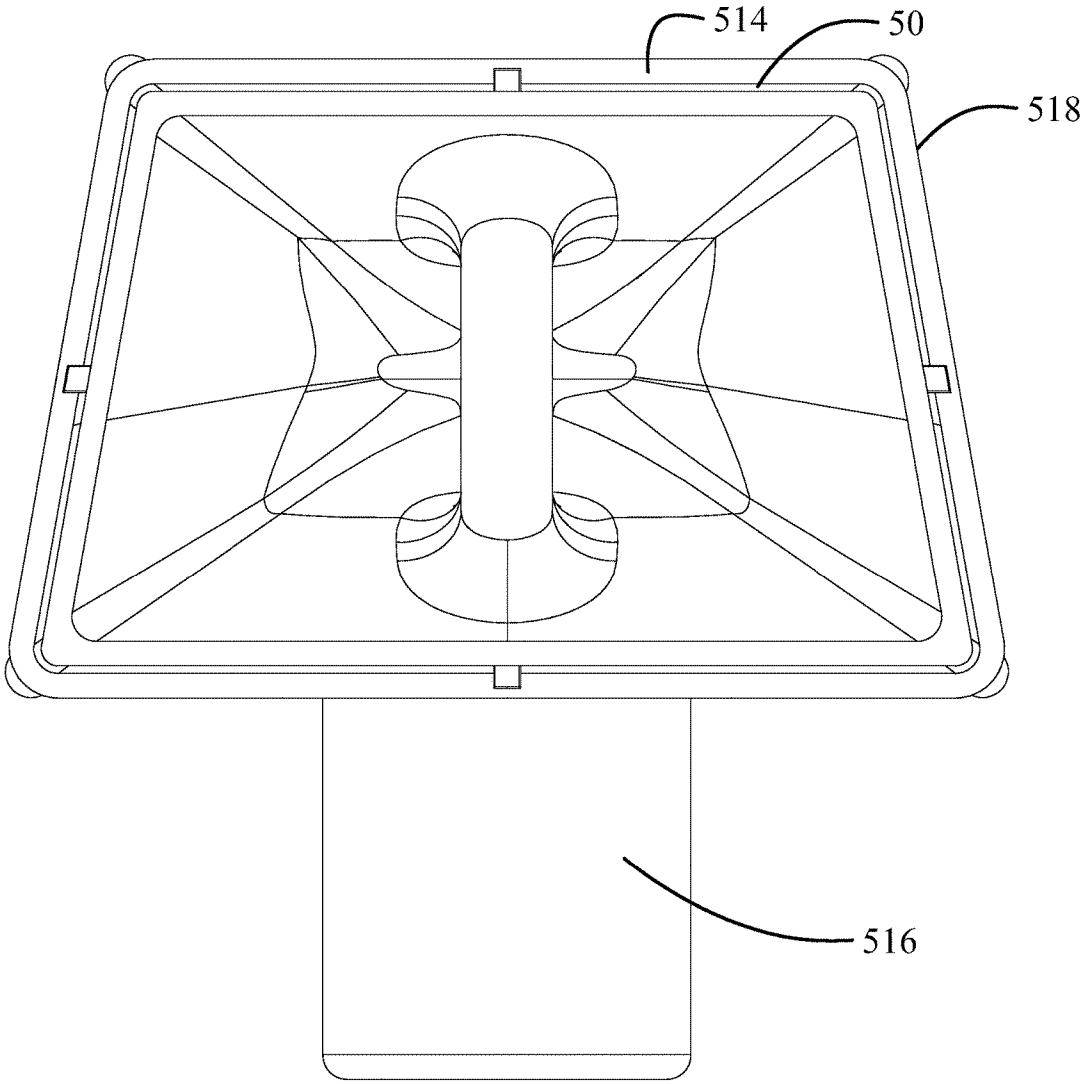
FIGS. 14A-14C show a front view, a side view, and rear view respectively, of the fifth implementation.
Figure 14B:
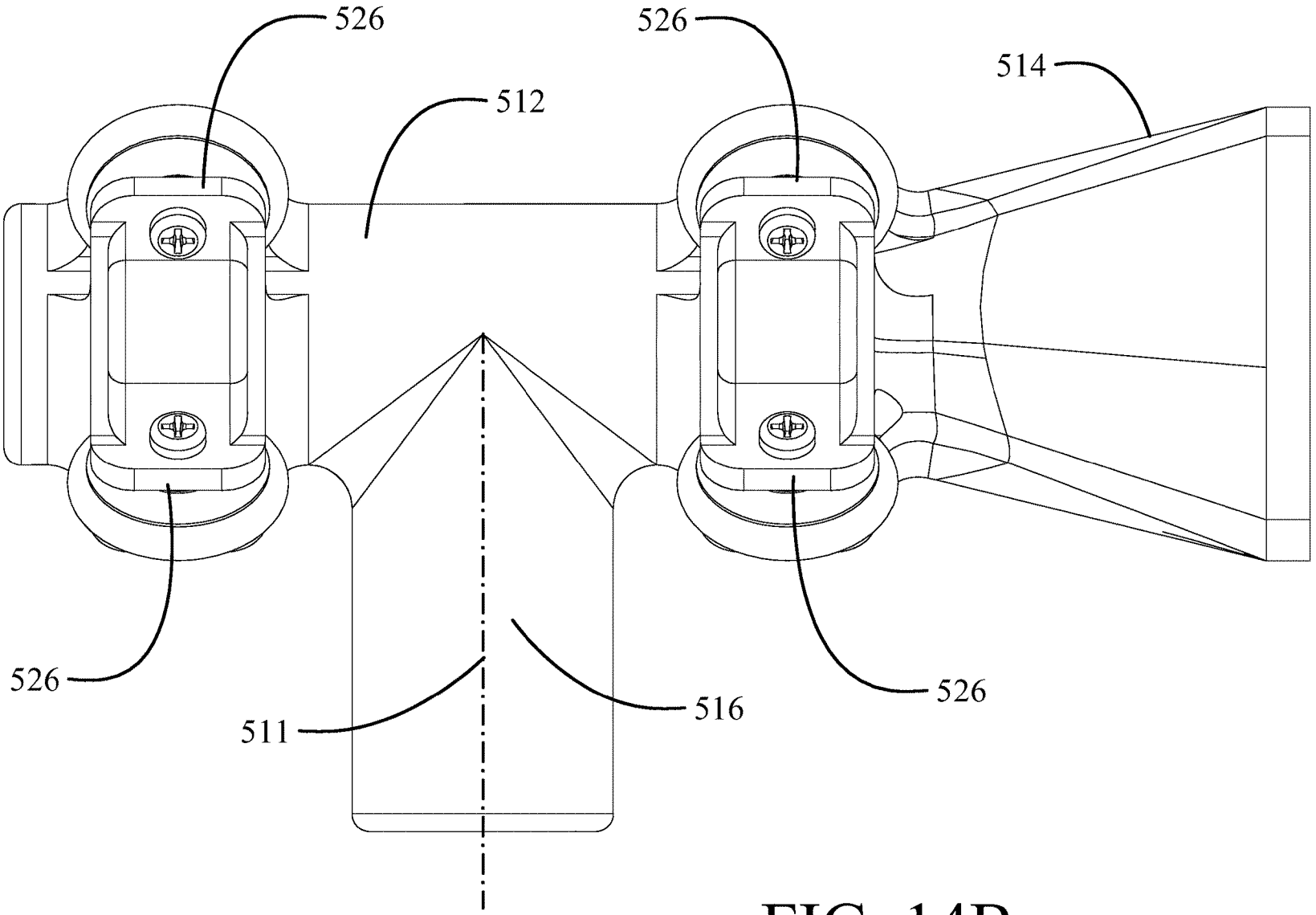
Figure 14C:
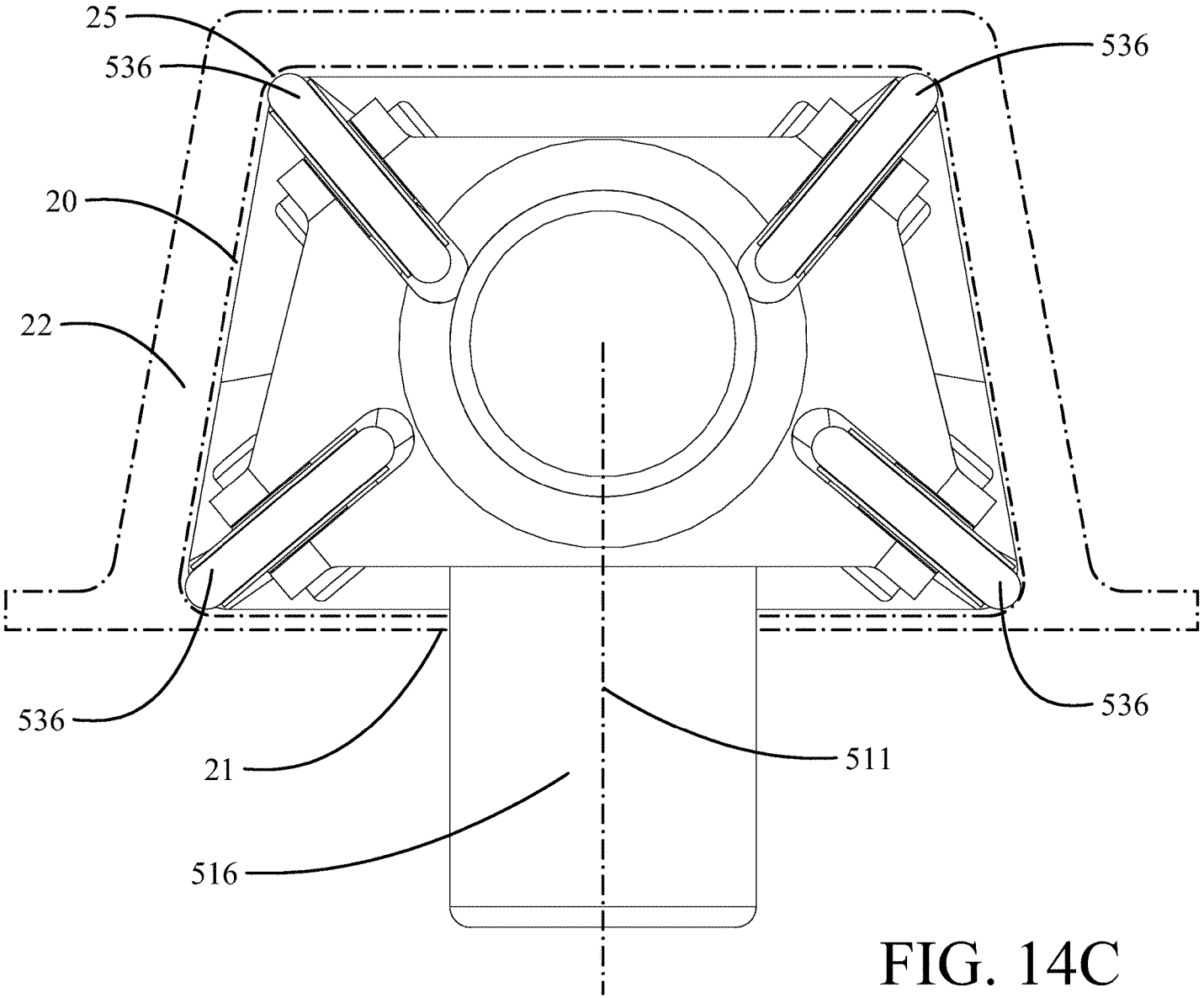
Figure 15:
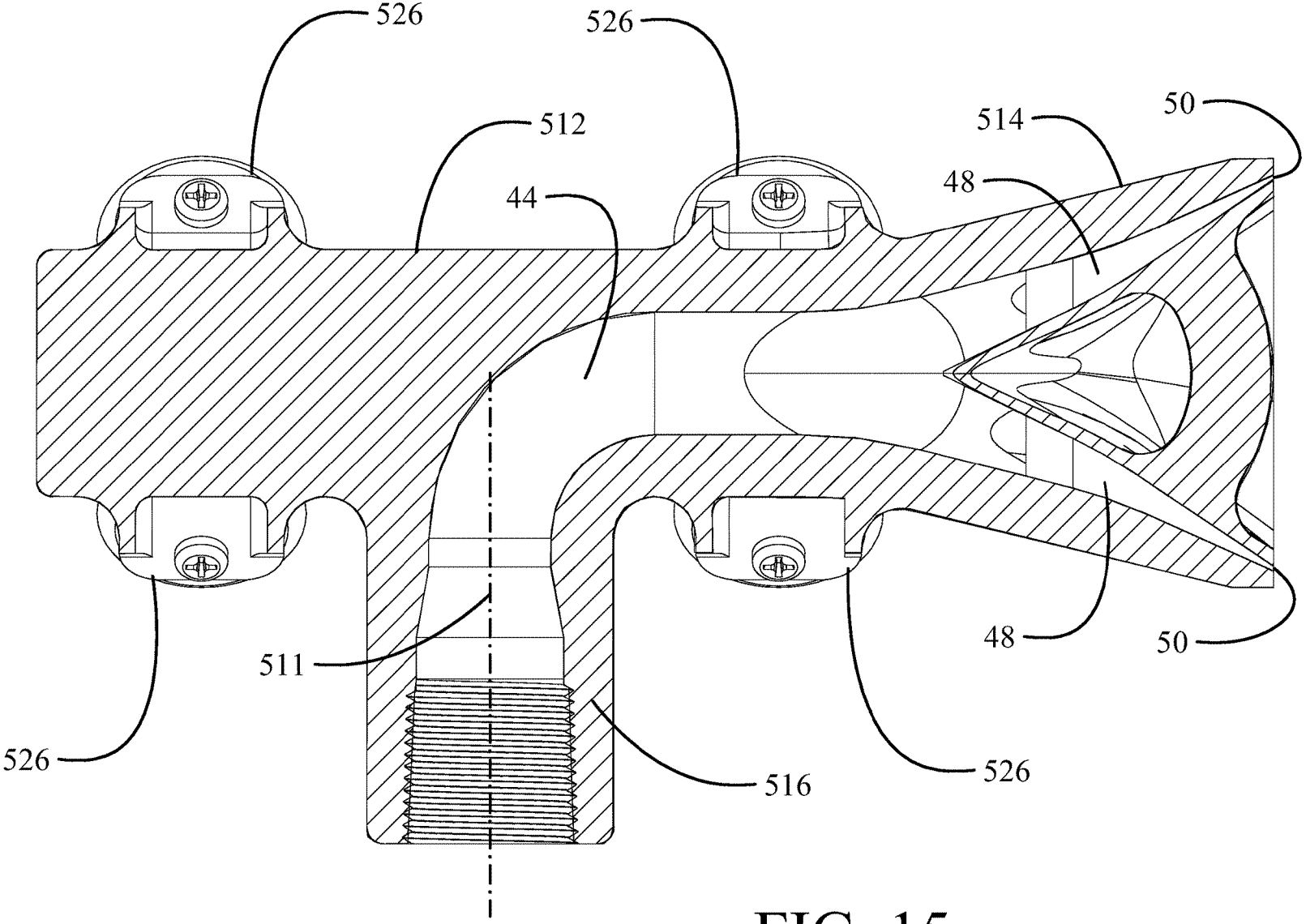
FIG. 15 shows a side section view of the fifth implementation.
Figure 16A:
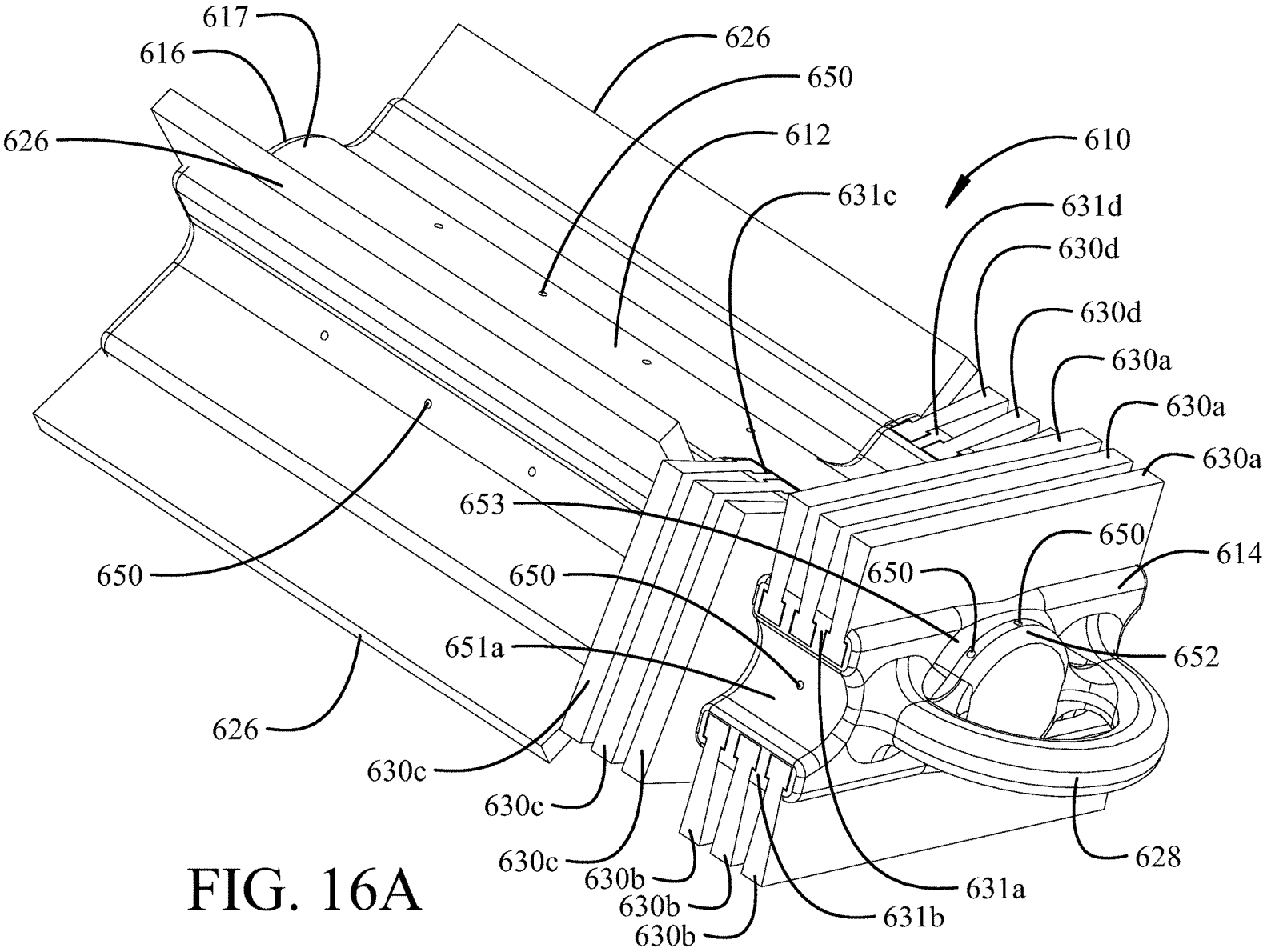
FIGS. 16A and 16B show an upper front pictorial representation and lower rear pictorial representation, respectively, of a sixth disclosed implementation of a tool system for a wash or rinse application.
Figure 16B:
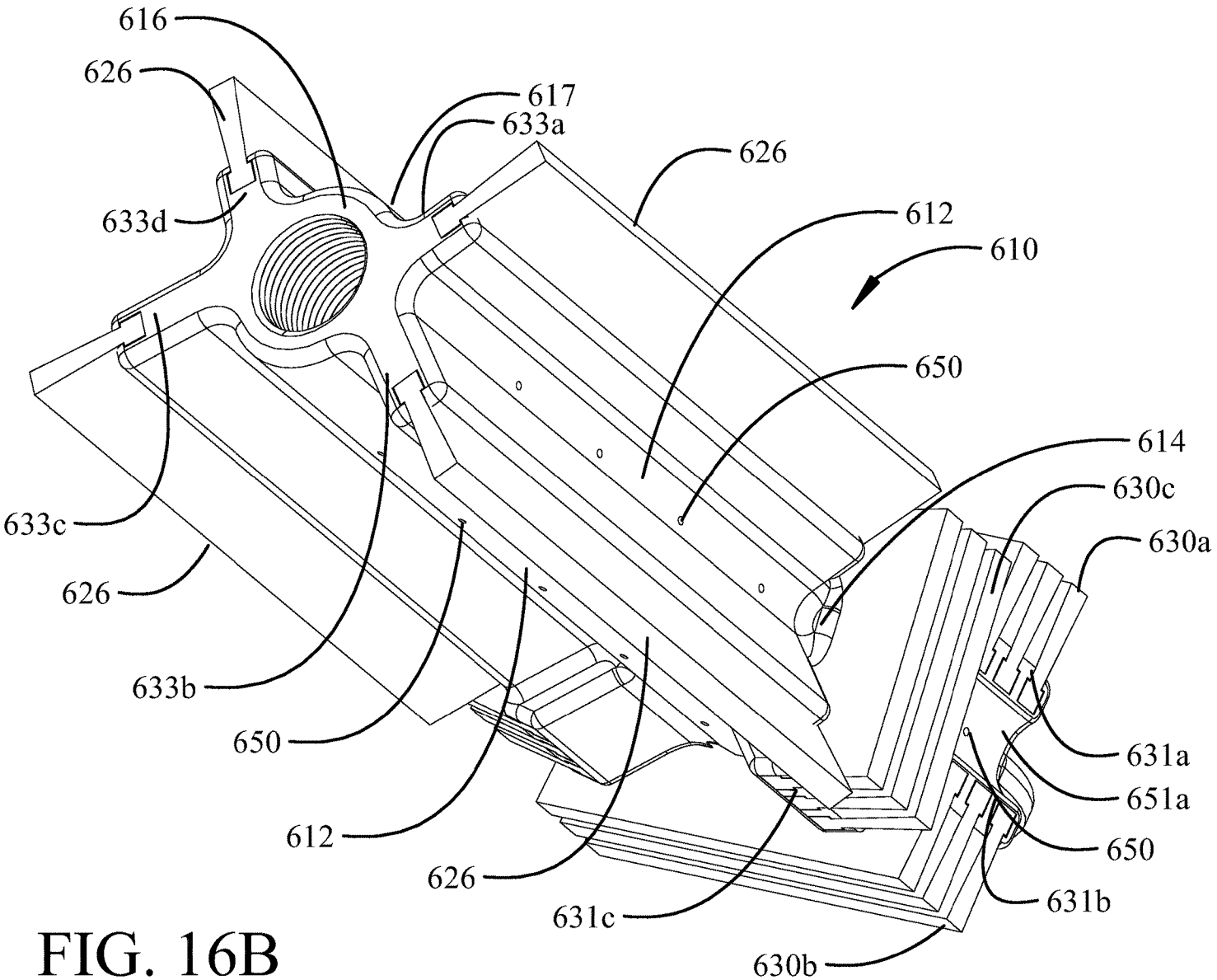

In the third implementation, a plurality of stabilizers 326 extends from the central body 312 to engage corners 25 of the channel 20 to support the cleaning tool system 10 in the channel 20 as seen in FIGS. 8B and 8C. The stabilizers 326 in the third implementation employ wheels 336 supported on axles 338 carried in devises 340 extending from the central body 312. The wheels 336 are rubber or other elastic material to provide flexible support and accommodate varying cross sectional geometry, channel to channel, panel to panel. For the disclosed implementation shown, a forward set 327*a* and an aft set 327*b* of four stabilizers are employed. However, with support provided by the two wipers 330*a* and 330*b*, sufficient yaw and pitch stability for the cleaning tool system 310 is provided by at least one set of four wheeled stabilizers proximate the aft end of the central body 312. Use of either one or two sets of stabilizers for a trapezoidal shape channel 20 allows the roll clock angle needed to place the trapezoidal shaped line of orifices 50 near the surface 23 to be fixed by the stabilizing wheels 336 riding in the internal corners 25. The internal corners 25 act as guide tracks for the wheels for not only longitudinal indexing, but also clocking.

As in the prior implementations the channel 20 has a substantially trapezoidal cross section and the peripheral contours 318, 332*a* and 332*b* have a corresponding trapezoidal shape. As best seen in FIG. 8C, the Clovis 340 are angularly oriented to extend from the central body 312 at angles 337*a* and 337*b* predetermined based on the geometric shape of the channel 20 to provide orientation of the wheels 336 for contact in the channel corners 25. For rectangular or square cross section channels angles 337*a* and 337*b* will be equal. Equal angular orientation of the Clovis also allows the configuration of the third implementation to be employed with circular cross section channels.

As in the prior implementations, plenum 44, vent channels 48 in fluid communication with the plenum 44 and orifices 50 are configured for operation substantially identically to the first implementation. The fore body 314 again employs truncated pyramidal cavity 352, best seen in FIG. 7A, to provide access to the hook 228. A loop hook 328 is connected to opposing sides of the pyramidal cavity 52.

A fourth disclosed implementation of a cleaning tool system 410 is shown in FIGS. 10A and 10B, 11A-C and 12. The configuration and operation of central body 412, connection boss 416 and fore body 414 with plenum 44, vent channels 48, orifices 50 and pyramidal cavity 52 are substantially identical to the prior described implementations. Stabilizers 426 incorporating angularly oriented Clovis 440 with wheels 436 supported on axles 438 are configured as described for corresponding elements in the third implementation. However, the forth implementation does not employ wipers on the fore body 414. Use of two sets of four stabilizers 426 extending from the central body 412, with wheels 436 aligned with internal corners 25 provides sufficient stability in yaw, pitch and roll. Peripheral contour 418 of the fore body 412 is configured with close tolerance to the cross section of the channel 20 to maximize desired directional flow of gas jets emitted by orifices 50 onto the channel surfaces 23. In one implementation, the peripheral contour 418 employs resilient materials in disclosed implementations to be compliant and provide sliding contact the channel surfaces 23.

In various manufacturing scenarios, use of a cleaning tool system as disclosed desirable with a stringer 22 prior to assembly with the skin 24. A fifth disclosed implementation of a cleaning tool 510 is shown in FIGS. 13A and 13B, 14A-C and 15. The configuration and operation of central body 512 and fore body 514 with plenum 44, vent channels 48, orifices 50 and pyramidal cavity 52 are substantially identical to the prior described implementations. Stabilizers 526 incorporating angularly oriented devises 540 with wheels 536 supported on axles 538 are configured as described for corresponding elements in the third and fourth implementations. However, with the stringer 22 unattached, a slot 21 exists along the length of the stringer which allows lateral access to the cleaning tool system 510. A connection boss 516 therefore extends on a lateral axis 511 from the central body 512 and extend through the slot 21 for connection of the supply line 46 thereby avoiding extending the supply line longitudinally through the channel, reducing friction and necessary forces to draw the cleaning tool system 510 through the channel 20 in the stringer 22.

Figure 17A:
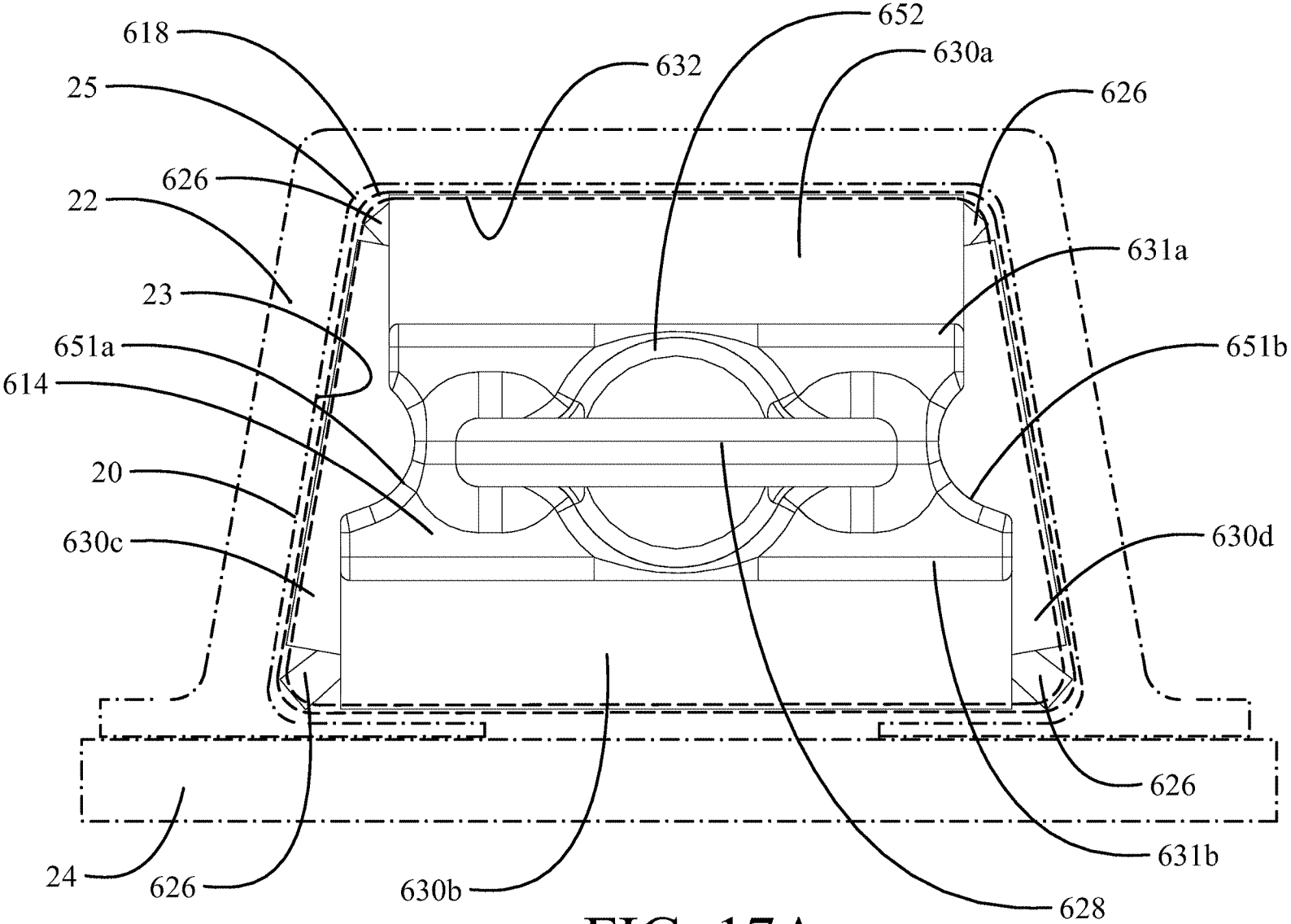
FIGS. 17A-17C show a front view, a side view, and rear view respectively, of the sixth implementation.
Figure 17B:
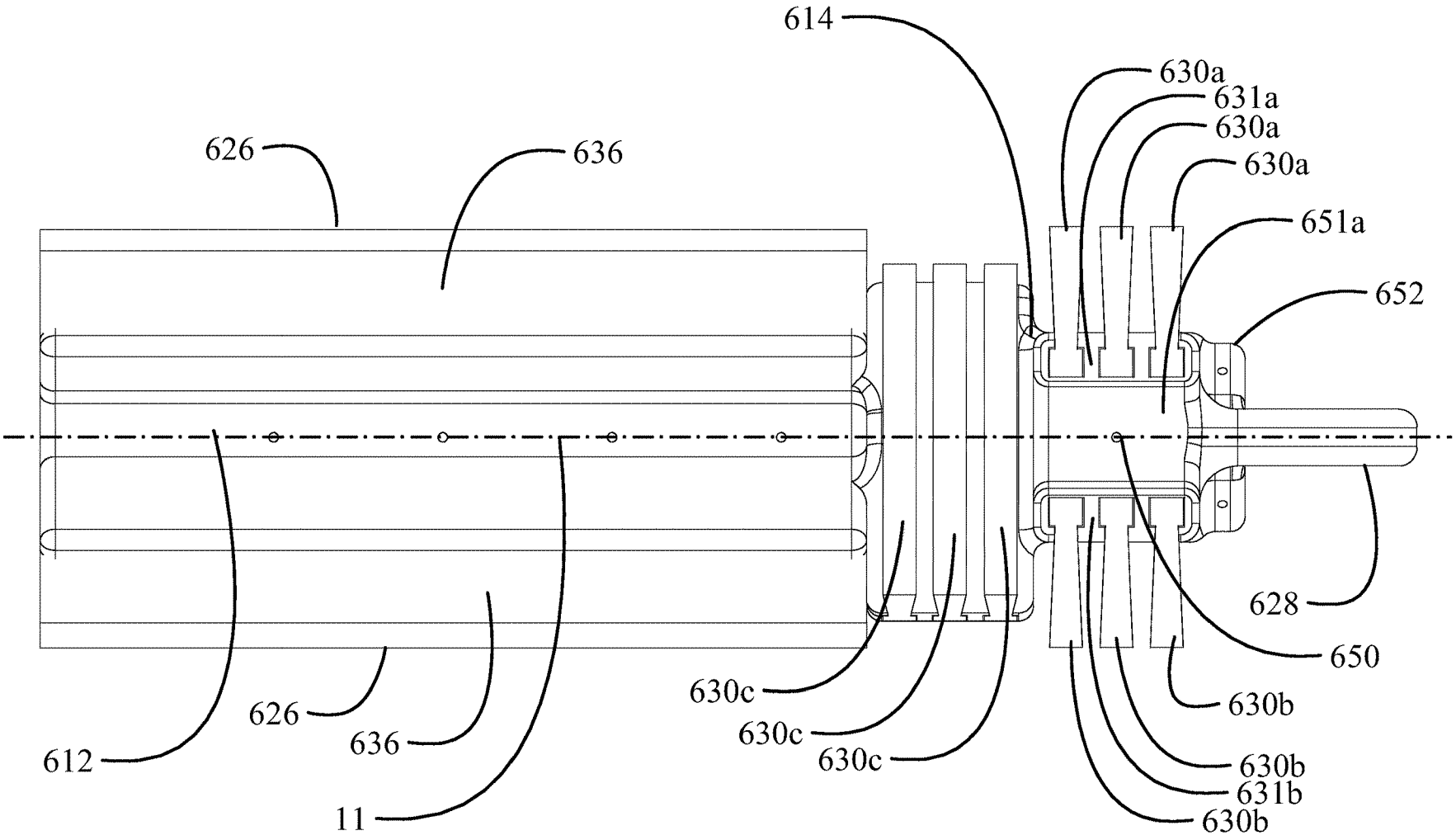
Figure 17C:
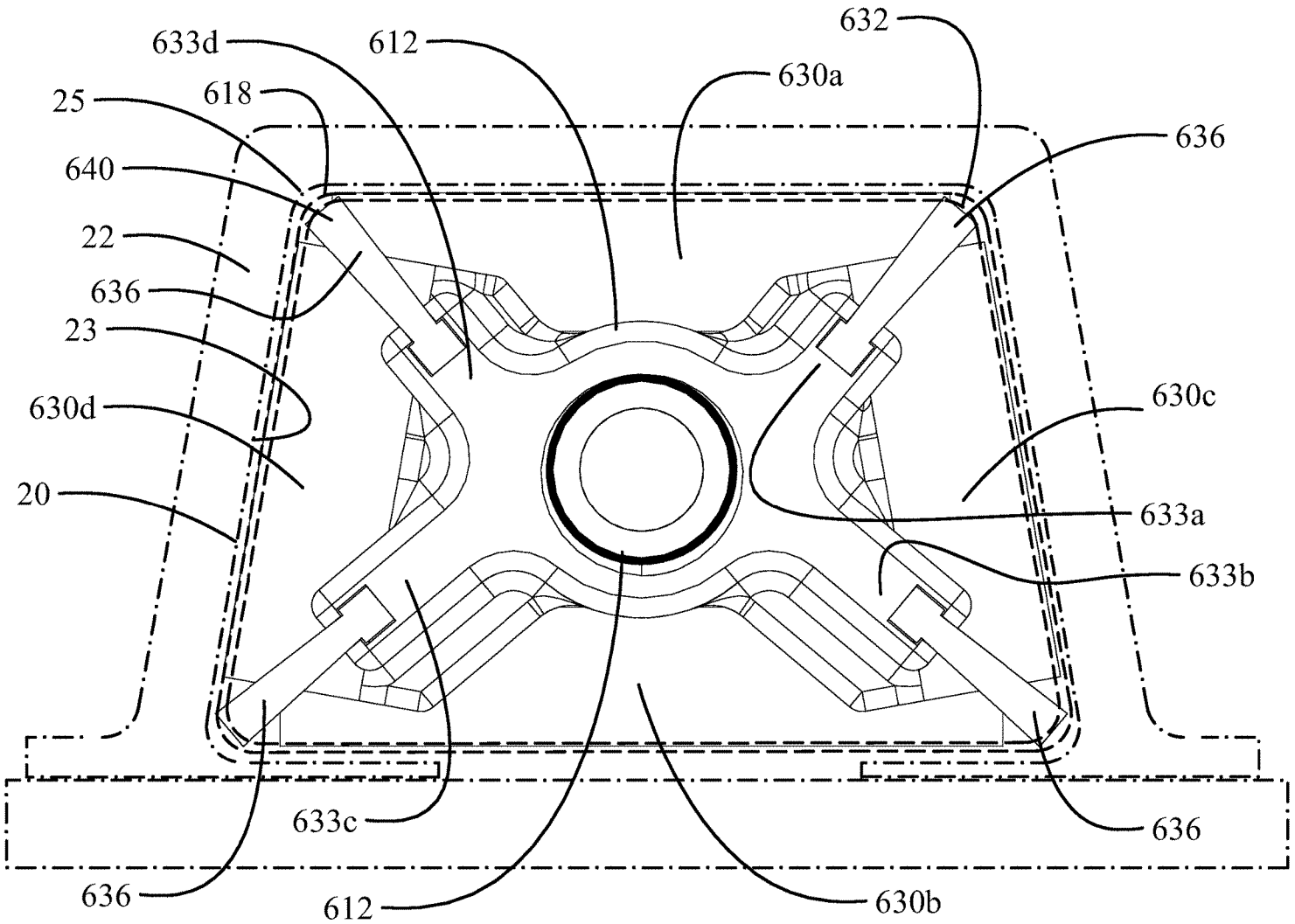

Various implementations of the cleaning tool assembly are also employed for washing and rinsing operations. A sixth disclosed implementation is shown in FIGS. 16A and 16B, 17A-C and 18. A cleaning tool system 610 having a central body 612 and a fore body 614 extending from the central body. A connection boss 616 at an aft end 617 of the central body 612 provides an attachment interface for a cleaning medium supply such as water, solvents, degreased and other liquid cleaning agents. As best seen in FIG. 17A, the fore body 614 is has a peripheral contour 618 (shown in dashed line) shaped to engage the enclosed channel 20 such as stringer 22 attached to skin 24 (shown in phantom with exaggerated spacing for clarity). The overall contour 618 is formed by one or more elements as will be described subsequently. The shaping of the peripheral contour 618 indexes the cleaning tool system 610 within the channel 20 maintaining a desired orientation as the cleaning tool system 610 is drawn through the channel. A plurality of stabilizers 626 extends from the central body 612 to engage corners 25 of the channel 20 to support the cleaning tool system 610 in the channel 20 as seen in FIG. 17A-17C. A loop hook 628 is provided in the fore body 614 for attachment of a draw line to pull the cleaning tool system 610 through the channel along the longitudinal axis 11.

In the sixth implementation, the fore body 614 incorporates a plurality of laterally oriented cleaning elements 630*a*, 630*b*, 630*c* and 630*d* forming elements of a resilient peripheral contour 632 (shown dashed and slightly inset for clarity) concentric with the overall peripheral contour 618. Laterally oriented defined as perpendicular to the longitudinal axis 11. The cleaning elements 630*a*, 630*b*, 630*c* and 630*d* resiliently contact surfaces 23 of the channel 20 to provide a scrubbing effect as the cleaning tool system is drawn through the channel. The cleaning elements 630*a*, 630*b*, 630*c* and 630*d* for the discussed implementation are bristled brushes, resilient foam or sponge pads received in lateral clamping elements 631*a*, 631*b*, 631*c* and 631*d*. The stabilizers 626 in the sixth implementation are longitudinally oriented cleaning elements 636 extending from the central body 612 and received in longitudinal clamping elements 633*a*, 633*b*, 633*c* and 633*d*. A longitudinal orientation defined as parallel to the longitudinal axis 11. For the discussed implementation, the longitudinally oriented cleaning elements 636 are also bristled brushes, resilient foam or sponge pads received in longitudinal clamping elements 633*a*, 633*b*, 633*c* and 633*d*. The longitudinally oriented cleaning elements 636 have outer ends 640 resiliently contacting the corners 25.

The channel 20 has a substantially trapezoidal cross section and the peripheral contour 618 has a corresponding trapezoidal shape.

The resilient peripheral contours 632 formed by the cleaning elements 630*a*, 630*b*, 630*c* and 630*d* and the stabilizers 626 prevent yaw and pitch of the cleaning tool system 610 while being drawn through the channel. As best seen in FIG. 17C, the stabilizers 626 extend from the central body 12 at angles 37*a* and 37*b* predetermined based on the geometric shape of the channel 20 to provide alignment of the stabilizers with the channel corners 25. As described with respect to the third implementation, placement of the stabilizers 626 to engage the corners 25 of the channel 20 allows the roll clock angle needed to place the trapezoidal shaped line of orifices 50 near the surface to be fixed by the stabilizers riding in the internal corners 25. The internal corners 25 act as guide tracks for the stabilizers for not only longitudinal indexing, but also clocking.

Figure 18:
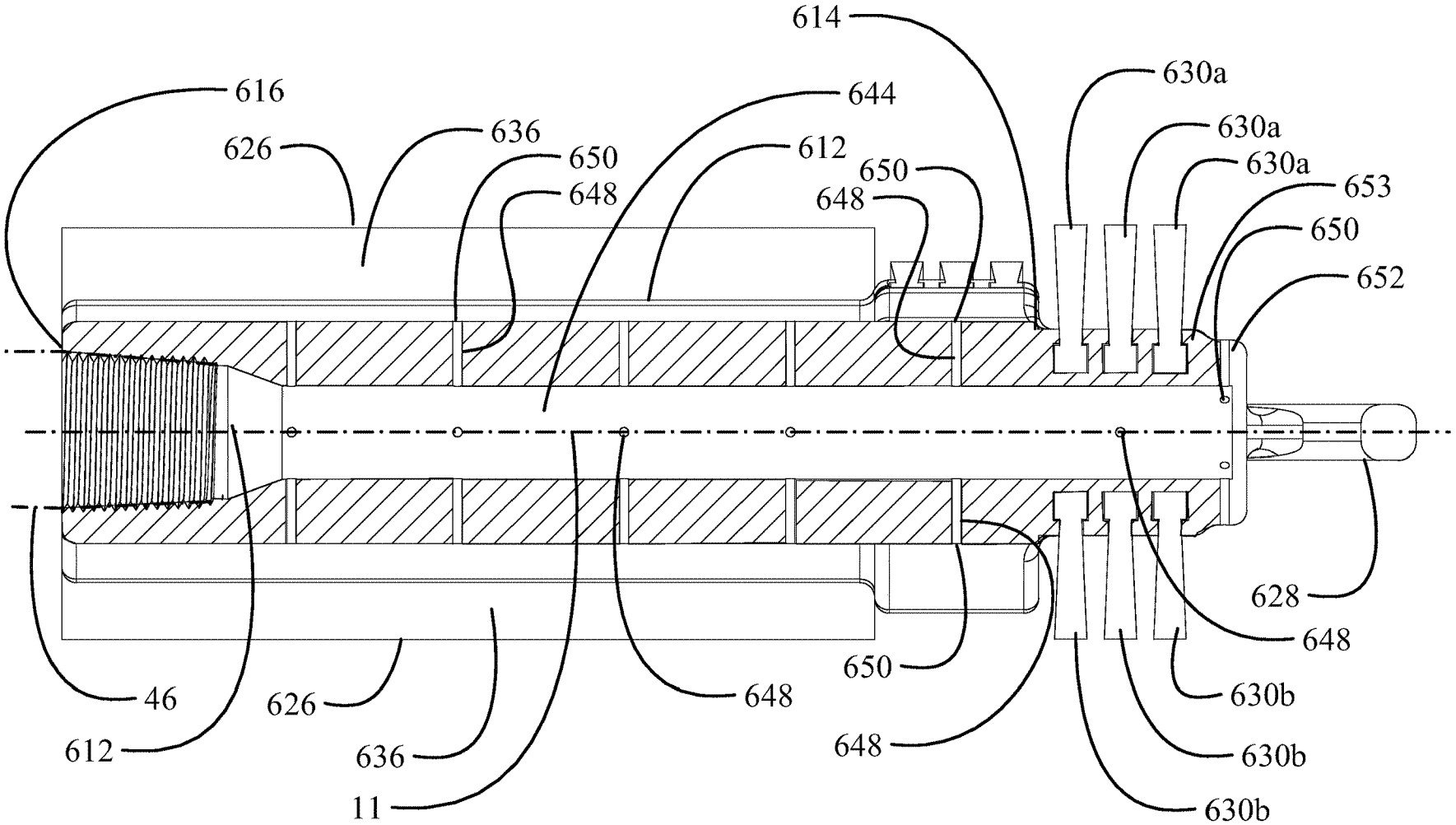
FIG. 18 shows a side section view of the sixth implementation.
Figure 19A:
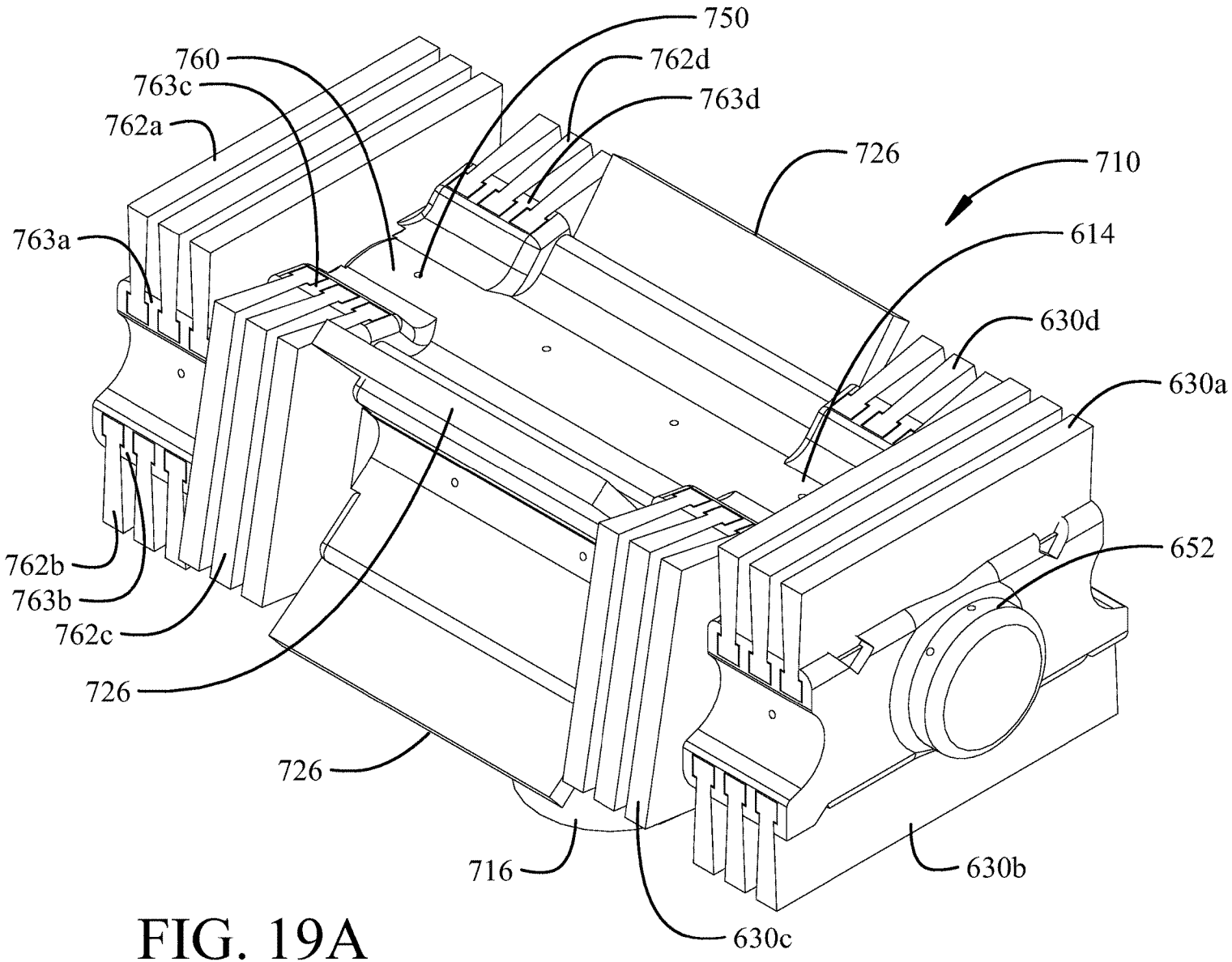
FIGS. 19A and 19B show an upper front pictorial representation and lower rear pictorial representation, respectively, of a seventh disclosed implementation of a tool system for a wash or rinse application.
Figure 19B:
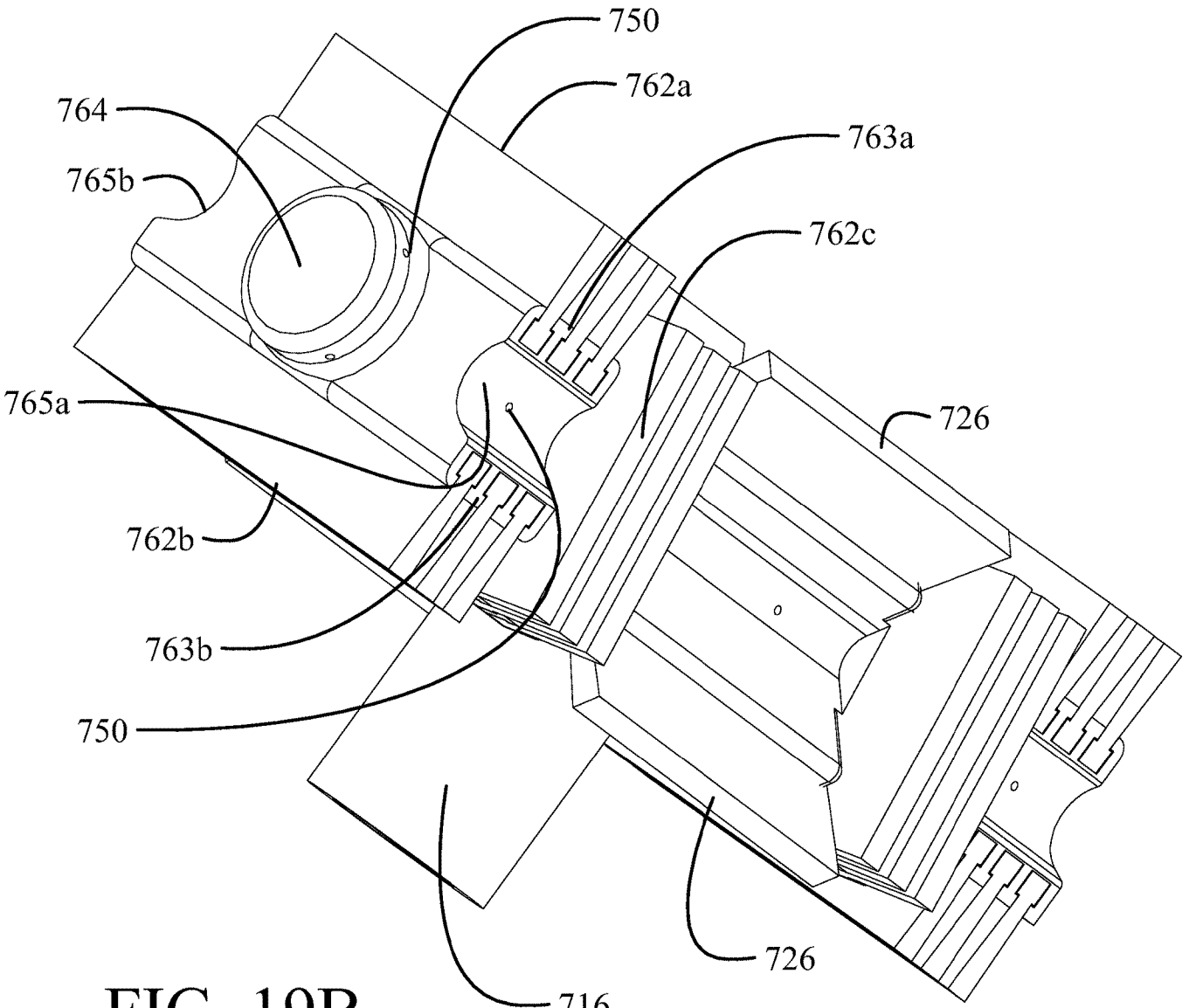

As seen in FIG. 18, the central body 612 incorporates a plenum 644. The sixth implementation is a washing tool and the plenum 644 receives water, solvents, degreased or cleaning agents from the supply line 46 engaged longitudinally in the connection boss 616. The fore body 614 has spray channels 648 in fluid communication with the plenum 644 and terminating in one or more jet orifices 650. In the disclosed implementation the spray channels 648 are sized for maximizing flow velocity for ejection of a cleaning medium from the jet orifices 650, to maximize coverage of the surfaces 23 of the channel 20. The fore body 614 has a spray dome 652 at a forward end 653, best seen in FIG. 16A, which provides multiple radially spaced jet orifices 650. The fore body 614 incorporates jet orifices 650 oriented to spray perpendicular to the peripheral contour 618 in first lateral directions (left and right in the drawing depiction) positioned in curved depressions 651*a* intermediate the lateral clamping elements 631*a* and 631*b* which redirected reflected spray from the channel surfaces 23. The fore body 614 also incorporates jet orifices 650 oriented in second lateral directions (substantially vertically upward and downward in the drawing depiction) in second curved depressions 651*b* intermediate the lateral clamping elements 631*c* and 631*d*. In the disclosed implementation, additional jet orifices 650 connected to the plenum 644 with channels 648 are incorporated longitudinally spaced along the central body intermediate the stabilizers 626.

Spraying of the cleaning medium through the jet orifices 650 with scrubbing of the channel surfaces by the cleaning elements 630*a*, 630*b*, 630*c* and 630*d* provides efficacious cleaning of the channel. In some implementations, multiple rows of cleaning elements are employed, six total for example as shown in the drawings.

As previously described with respect to the fifth implementation, cleaning of the stringer 22 prior to attachment to the skin 24 is desirable. A seventh implementation for a washing tool is shown in FIGS. 19A and 19B, 20A and 20B, and 21. As with the fifth implementation, with the stringer 22 unattached, a slot 21 exists along the length of the stringer which allows lateral access to a cleaning tool system 710. The configuration and operation of central body 712 and fore body 614 with stabilizers 726, plenum 744, spray channels 748, jet orifices 750 and spray dome 652 are substantially identical to comparable elements in the sixth implementation. Slot 21 allows implementation of a lateral connection boss 716 extending on a lateral axis 711 from the central body 712 for connection of the supply line 46 thereby avoiding extending the supply line longitudinally through the channel, reducing friction and necessary forces to draw the cleaning tool system 710 through the channel 20 in the stringer 22. Additionally, in some implementations, the lateral connection boss 716 is employed as a handle for urging longitudinal motion of the cleaning tool system 710 in the channel 20 to facilitate motion in both longitudinal directions.

An aft body 760 is also provided which incorporates a second plurality of laterally oriented cleaning elements 762*a*, 762*b*, 762*c* and 762*d* forming elements of a second resilient peripheral contour 732 concentric with the overall peripheral contour 718. The cleaning elements 762*a*, 762*b*, 762*c* and 762*d* also resiliently contact surfaces 23 of the channel 20 to provide an additional scrubbing effect to supplement the cleaning elements on the fore body as the cleaning tool system is drawn through the channel. In some examples, the cleaning elements 762*a*, 762*b*, 762*c* and 762*d* are selected from a variety of cleaning tools such as bristled brushes, resilient foam or sponge pads received in lateral clamping elements 763*a*, 763*b*, 763*c* and 763*d*.

Figure 20A:
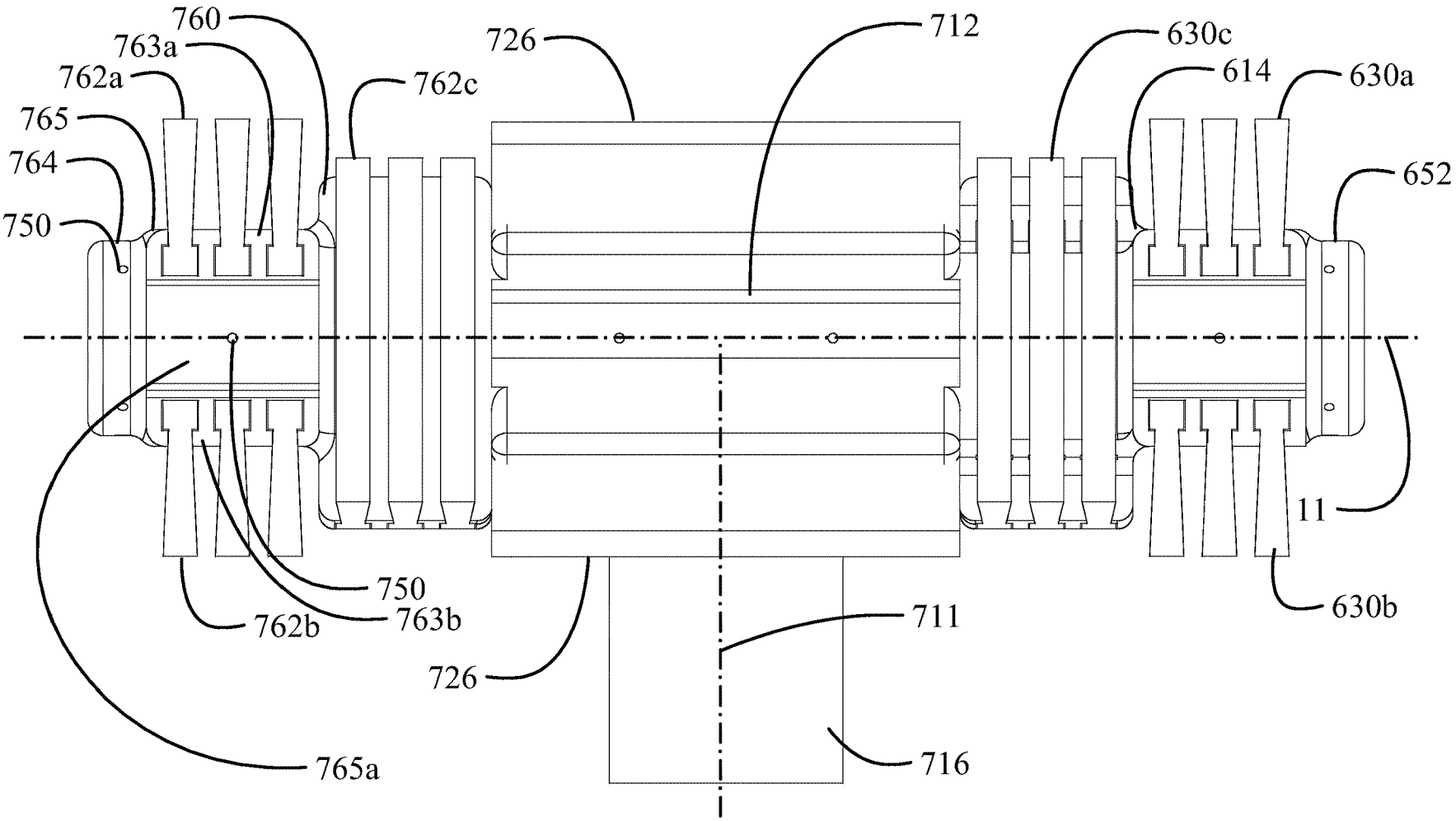
FIGS. 20A-20B show a side view and a rear view, respectively, of the seventh implementation.
Figure 20B:
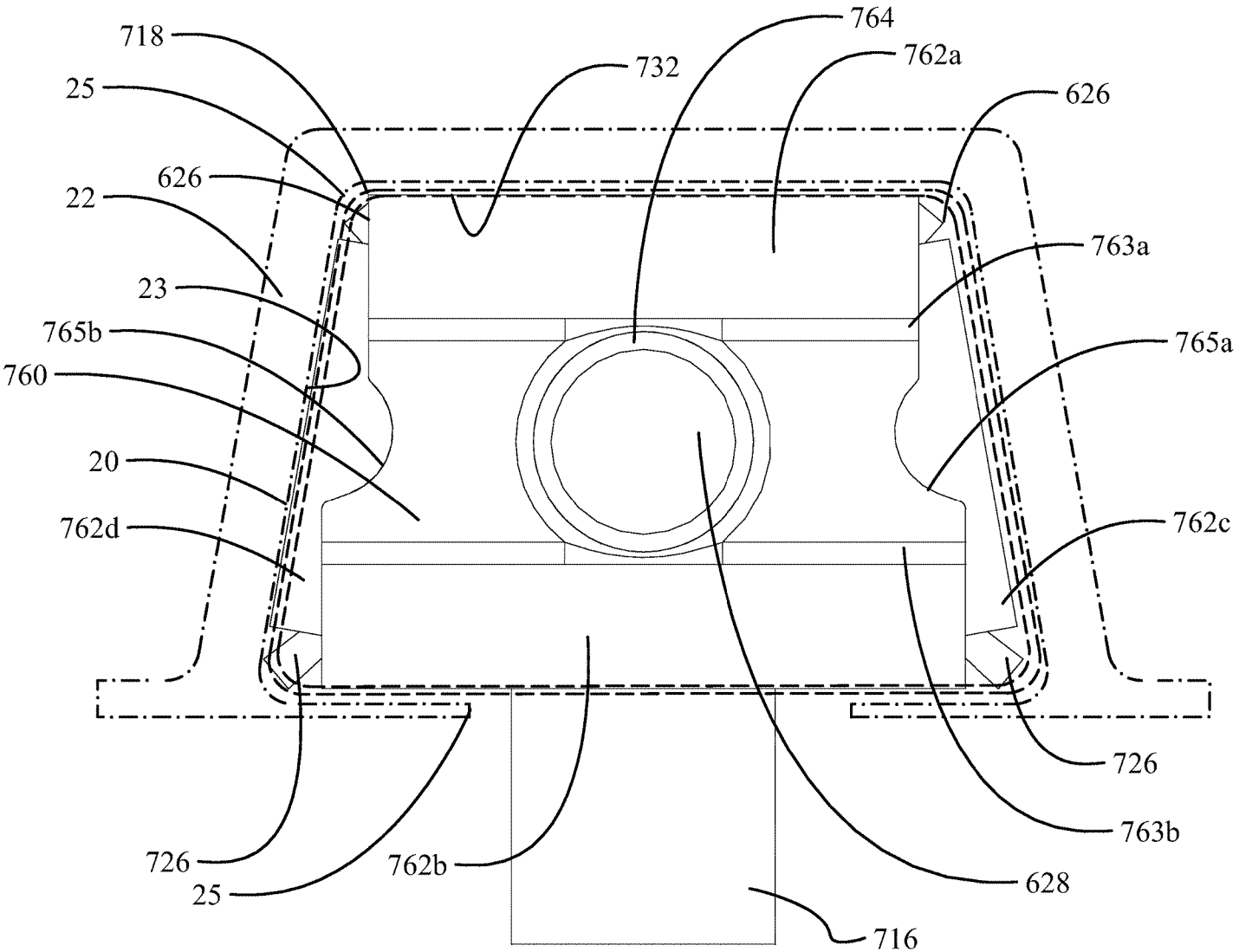
Figure 21:
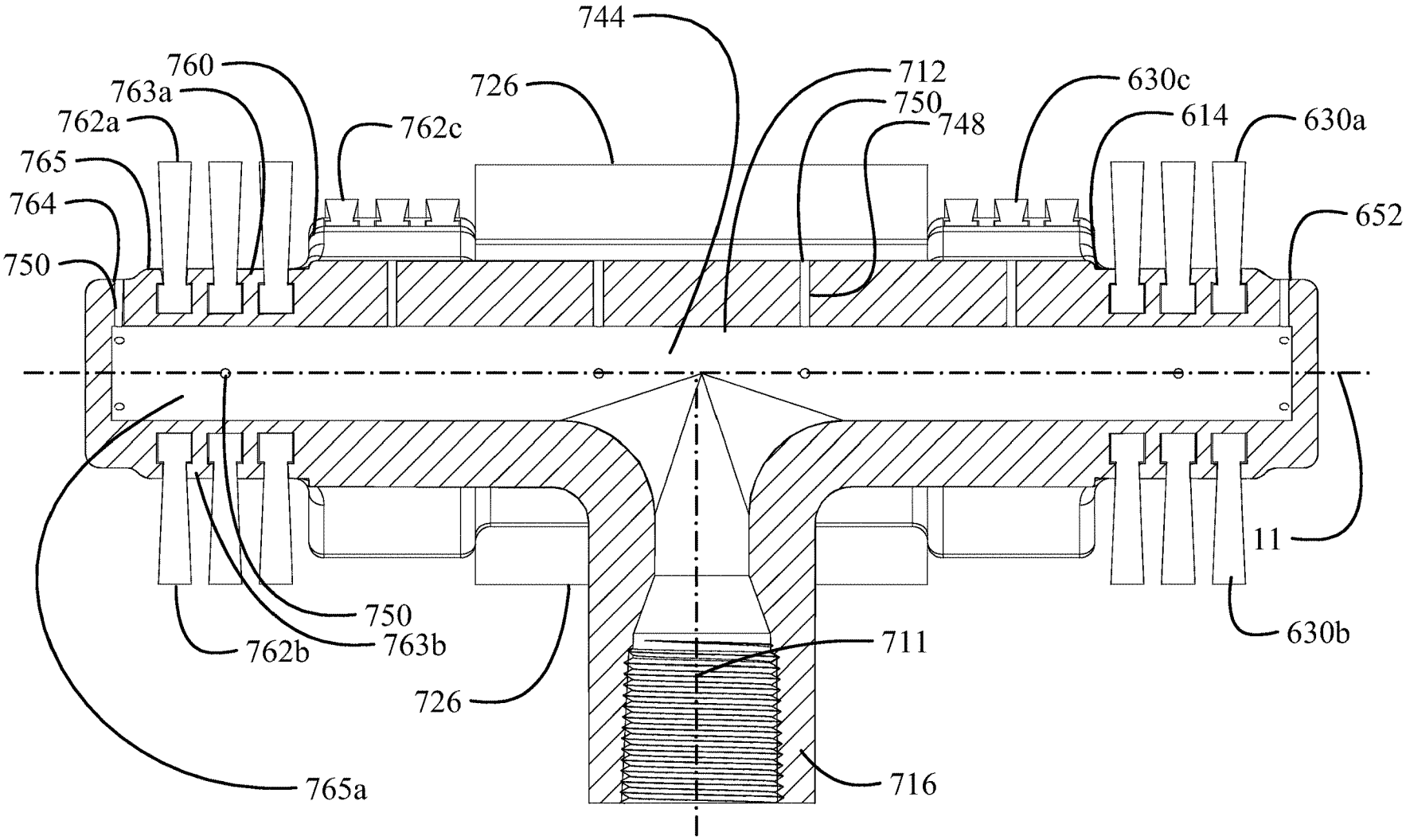
FIG. 21 shows a side section view of the seventh implementation.
Figure 22A:
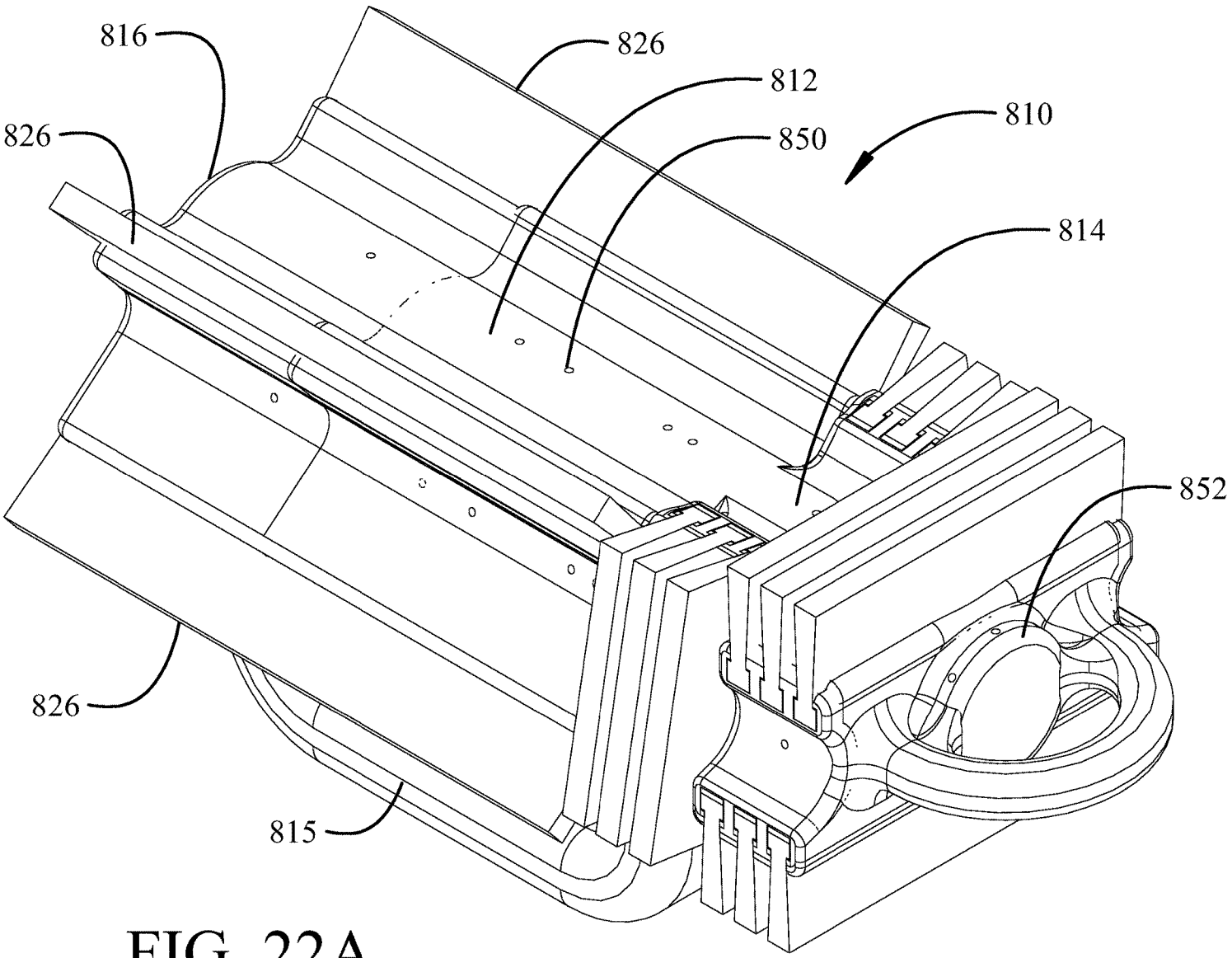
FIGS. 22A and 22B show an upper front pictorial representation and lower rear pictorial representation, respectively, of an eighth disclosed implementation of a tool system for a wash or rinse application.
Figure 22B:
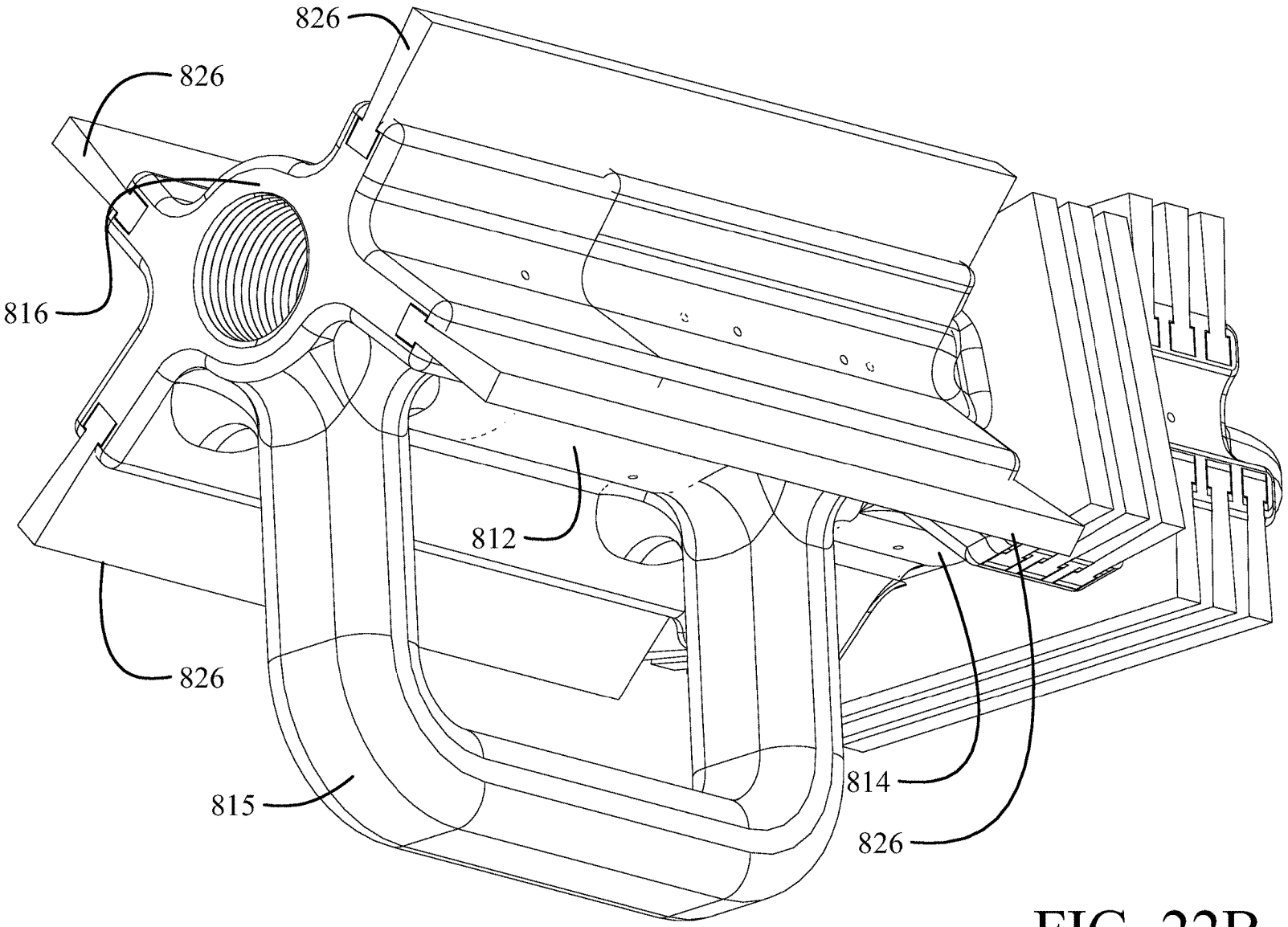
Figure 23:
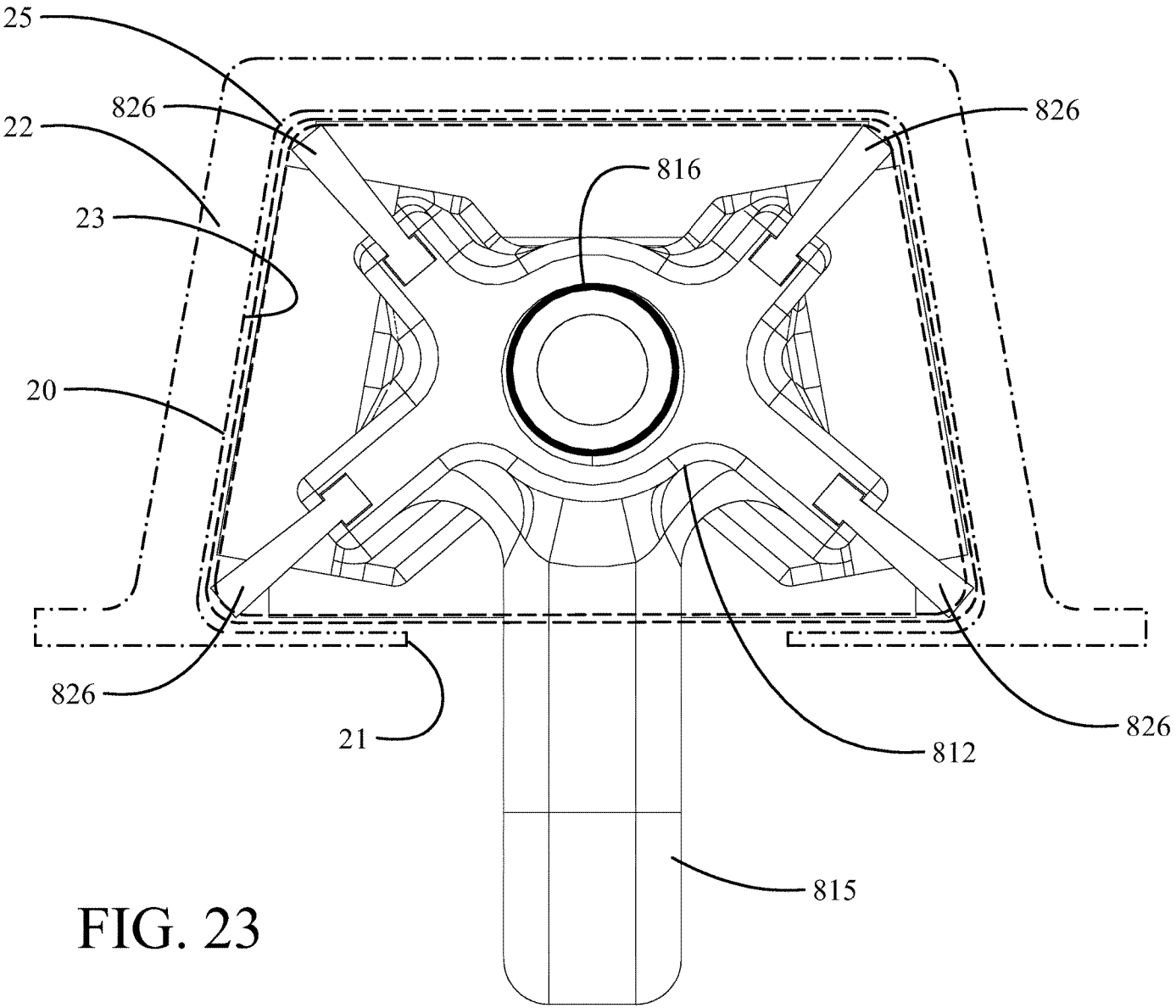
FIG. 23 shows a rear view of the eighth implementation.
Figure 24:
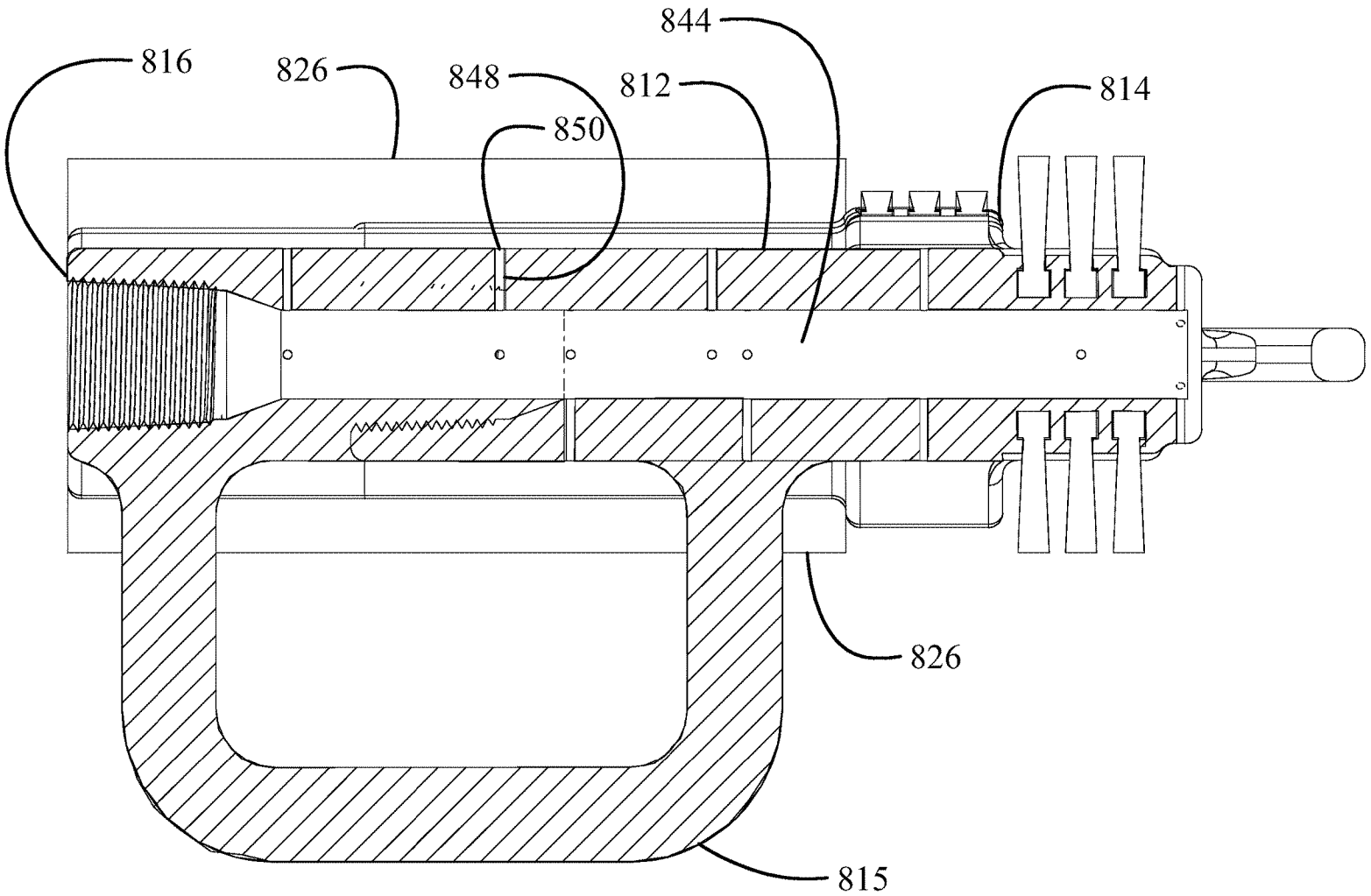
FIG. 24 shows a side section view of the eighth implementation.

The aft body 760 additionally has a second spray dome 764 at an aft end 765, best seen in FIG. 20A, which provides multiple radially spaced jet orifices 750. The aft body 760 incorporates jet orifices 750 oriented to spray perpendicular to the peripheral contour 718 in first lateral directions (left and right in the drawing depiction) positioned in third curved depressions 765*a* intermediate the lateral clamping elements 763*a* and 763*b* which redirected reflected spray from the channel surfaces 23. The aft body 760 also incorporates jet orifices 750 oriented in second lateral directions (substantially vertically upward and downward in the drawing depiction) in fourth curved depressions 765*b* intermediate the lateral clamping elements 763*c* and 763*d*.

As an alternative configuration for cleaning of the stringer 22 prior to attachment to the skin 24, an eighth implementation of a cleaning tool system 810 is shown in FIGS. 22A and 22B, 23 and 24. As with the seventh implementation, with the stringer 22 unattached, a slot 21 exists along the length of the stringer which allows lateral access to a cleaning tool system 810. The configuration and operation of central body 812 and fore body 814, connection boss 816, stabilizers 826, plenum 844, spray channels 848, jet orifices 850 and spray dome 852 are substantially identical to comparable elements in the sixth implementation. Slot 21 allows addition of a laterally extending handle 815 attached to central body 812 for urging longitudinal motion of the cleaning tool system 810 in the channel 20 and to facilitate motion in both longitudinal directions. Connection boss 816 is retained in an aft end of the central both 812 for connection of supply line 46.

Figure 25:
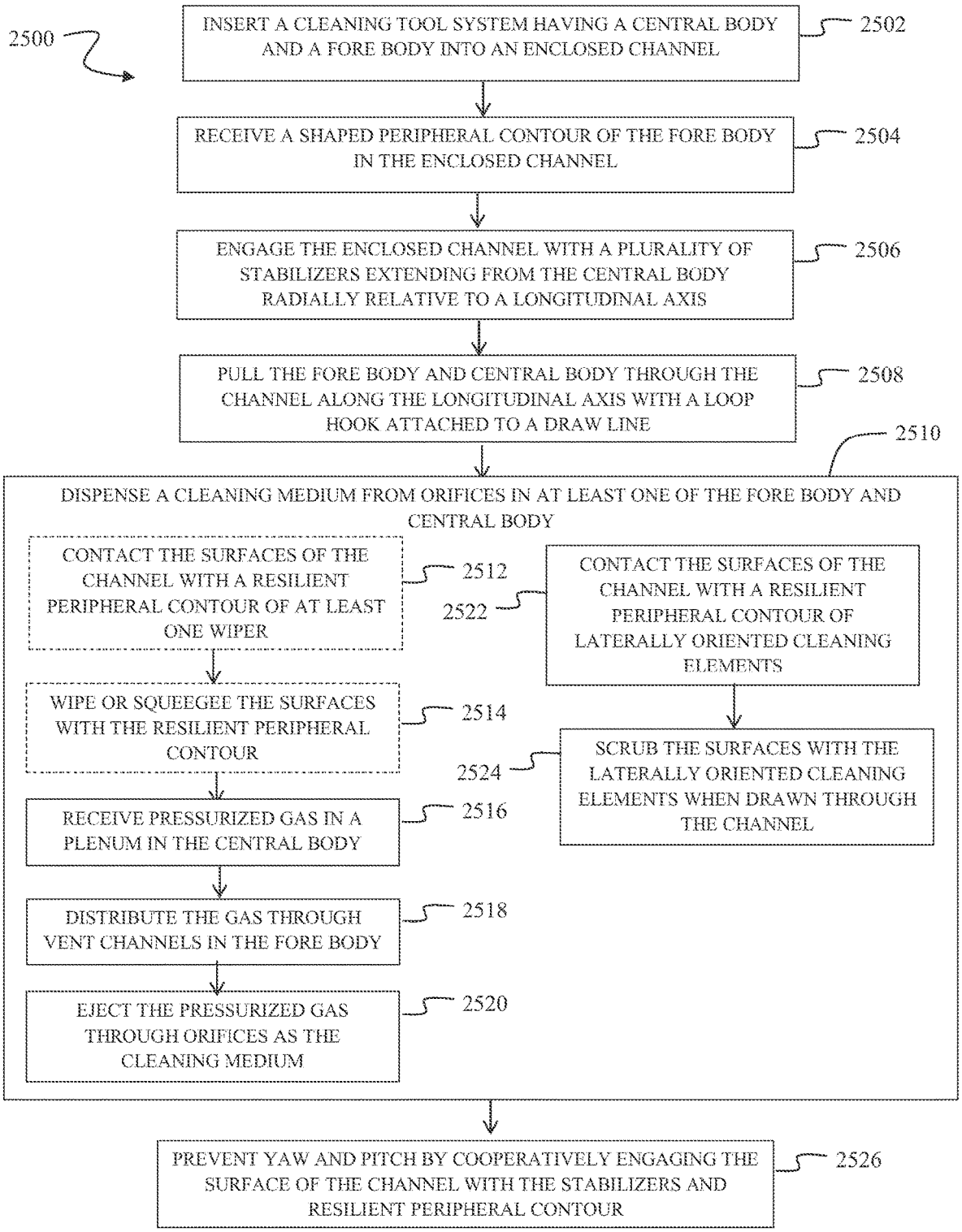
FIG. 25 is a flow chart showing a method for operation of a torque reactor employing the disclosed implementations.

The implementations disclosed provide a method 2500 for cleaning an enclosed channel as shown in FIG. 25. A cleaning tool system 10 having a central body 12 and a fore body 14 extending from the central body is inserted into an enclosed channel, step 2502. A peripheral contour 18 of the fore body is shaped to be received into the enclosed channel 20 consistent with indexing of the cleaning tool system, step 2504. The enclosed channel is engaged with a plurality of stabilizers 26 extending from the central body 12 radially relative to a longitudinal axis 11, step 2506.

In varying implementations the plurality of stabilizers each comprise a longitudinally oriented cleaning element 636 extending from the central body 612. The longitudinally oriented cleaning elements 636 have outer ends 640 and the enclosed channel is engaged by resiliently contacting the corners 25 of the channel with the outer ends. As a first alternative, the plurality of stabilizers each comprise a Clovis 340 extending from the central body 312 and a wheel 336 supported on an axle 338 carried in the Clovis 340 and the enclosed channel is engaged by resiliently contacting the corners 25 of the channel with the wheels. As a second alternative, the plurality of stabilizers each comprise a curved flexing arm 236 extending from the central body 212 proximate the fore body 214 and curving aft and the enclosed channel is engaged by resiliently contacting a surface of the channel with the curved flexing arm. As an additional alternative, the plurality of stabilizers each comprise a support post 36 extending from the central body 12 and a roller ball 38 exposed at an outer end 40 of the support post 36 and the enclosed channel is engaged by resiliently contacting a surface of the channel with the roller ball.

The fore body and central body are pulled through the channel along the longitudinal axis 11 with a loop hook 28 in the fore body 14 attached to a draw line, step 2508. In one implementation, additional force is applied by manipulating the supply line 46 and the tool is reciprocated back and forth by alternately pulling on the draw line and supply line. In implementations for cleaning a stringer 22 prior to attachment to the skin, the connection boss for the supply line extends laterally from the central body through the slot 21 in the stringer to allow attachment of the supply line without running longitudinally through the stringer. The lateral connection boss is then additionally used as a handle for manipulating the tool. Alternatively a handle 815 laterally extends from the central body through the slot 21. A cleaning medium is dispensed from orifices in at least one of the fore body and central body, step 2510.

In one implementation, the fore body incorporates at least one wiper 30 having a resilient peripheral contour 32 concentric with the peripheral contour 18 and the surfaces 23 of the channel 20 is contacted with the resilient peripheral contour 32, step 2512. The surfaces are then wiped or squeegeed with the resilient peripheral contour when drawn through the channel, step 2514. In certain embodiments such as the fourth and fifth embodiments described above, operation is accomplished without a wiper and without any squeegee effect.

Where the cleaning medium is pressurized gas from a supply line 46 engaged in a connection boss 16 in the central body, the pressurized gas is received in a plenum in the central body, step 2516, and distributed through vent channels 48 the fore body 14 in fluid communication with the plenum 44 and terminating in one or more orifices 50, step 2518. The pressurized gas is the ejected through the orifices, step 2520.

When the cleaning medium is water, degreased, solvents or other liquid cleaning agents, the fore body incorporates, in one implementation, a plurality of laterally oriented cleaning elements 630*a*, 630*b*, 630*c*, 630*d* forming elements of a resilient peripheral contour 632 concentric with the peripheral contour. The surfaces 23 of the channel 20 are then resiliently contacted with said cleaning elements 630*a*, 630*b*, 630*c*, 630*d*, step 2522 and the cleaning elements scrub the surfaces when drawn through the channel, step 2524.

Yaw, pitch and roll are prevented by cooperatively engaging the surfaces of the channel with the stabilizers and the resilient peripheral contour of either the wiper or the laterally oriented cleaning elements, step 2526.

Figure 26:
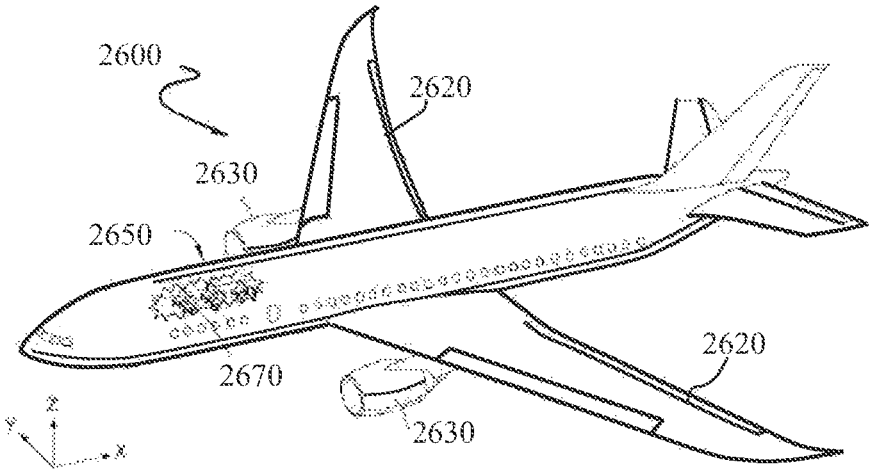
FIG. 26 is a block diagram representative of an aircraft with which the presently disclosed implementations are employed; and, FIG. 27 is a block diagram of a representative aircraft manufacturing and service method in which the presently disclosed implementations are employed.
Figure 27:
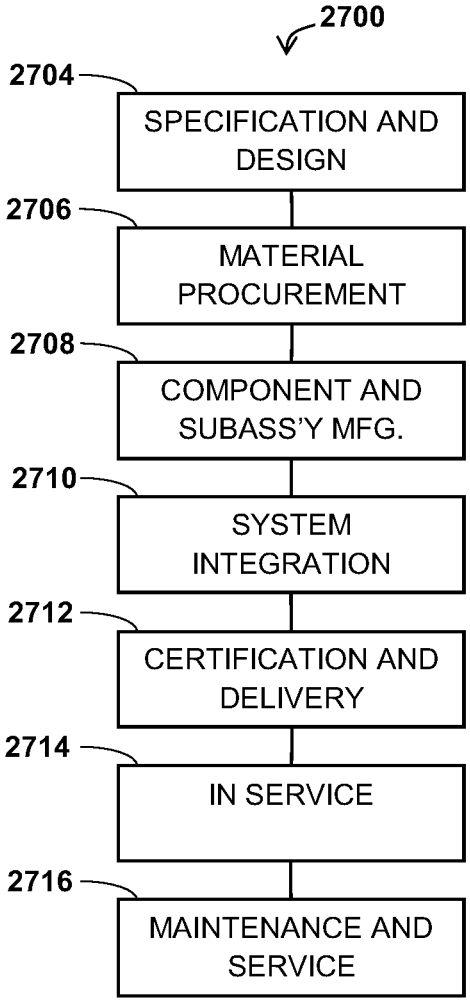

Examples of the present disclosure are described in the context of aircraft 2600 as shown in FIG. 26 and aircraft manufacturing and service method 2700 as shown in FIG. 27. FIG. 26 is a schematic illustration of an aircraft 2600 that employs the cleaning tool system 10, 210, 310, 410, 510, 610, 710, 810 as described herein, in accordance with one or more implementations, for manufacturing or maintenance operations. As depicted in FIG. 26, aircraft 2600 comprises air frame 2650 with interior 2670. Aircraft 2600 includes wings 2620 coupled to air frame 2650. Aircraft 2600 may also include engines 2630 supported by wings 2620. Aircraft 2600 is one example of a vehicle in which structural elements, such as stringers 22 attached to skins 24, are implemented and the cleaning tool system operated in accordance with the illustrated implementations. Although an aerospace example is shown, the principles disclosed herein also applies to other industries, such as the automotive industry. Accordingly, in addition to aircraft 2600, the principles disclosed herein may apply to other vehicles, e.g., land vehicles, marine vehicles, space vehicles, unmanned aircraft, hybrid ground and aerial vehicles, etc.

FIG. 27 is a block diagram of aircraft production and service methodology that utilizes the methods and assemblies described herein. During pre-production, illustrative method 2700 may include specification and design (block 2704) of aircraft 2600 and material procurement (block 2706). During production, component and subassembly manufacturing (block 2708) and inspection system integration (block 2710) of aircraft 2600 may take place. The cleaning tool system, and corresponding methods of operation, implemented in any of specification and design (block 2704) of aircraft 2600, material procurement (block 2706), component and subassembly manufacturing (block 2708), and/or inspection system integration (block 2710) of aircraft 2600.

Thereafter, in one embodiment, aircraft 2600 goes through certification and delivery (block 2712) to be placed in service (block 2714). While in service, aircraft 2600 may be scheduled for routine maintenance and service (block 2716). Routine maintenance and service may include modification, reconfirmation, refurbishment, etc. Of one or more inspection systems of aircraft 2600. The cleaning tool system, and corresponding methods of operation, are implemented in any of certification and delivery (block 2712), service (block 2714), and/or routine maintenance and service (block 2716).

In one implementation, each of the processes of illustrative method 2700 are performed or carried out by an inspection system integrator, a third party, and/or an operator (e.g., a customer). For the purposes of this description, an inspection system integrator may include, without limitation, any number of aircraft manufacturers and major-inspection system subcontractors; a third party may include, without limitation, any number of vendors, subcontractors, and suppliers; and an operator may be an airline, leasing company, military entity, service organization, and so on.

Having now described various implementations in detail as required by the patent statutes, those skilled in the art will recognize modifications and substitutions to the specific implementations disclosed herein. Such modifications are within the scope and intent of the present invention as defined in the following claims.

What is claimed is:

1. A cleaning tool system comprising:

a central body having a longitudinal axis;

a fore body extending from the central body and having a peripheral contour shaped to be received in an enclosed non-circular channel, said peripheral contour shaped to index the cleaning tool system within the channel and maintain an orientation as the cleaning tool system is drawn through the channel, said fore body having orifices to dispense a cleaning medium into the channel;

the central body having a connection boss configured for connection of a supply line for the cleaning medium;

a plurality of stabilizers extending from the central body radially relative to the longitudinal axis to engage surfaces of the channel; and, a loop hook in the fore body configured to attach a draw line to pull the fore body and central body through the channel along the longitudinal axis.

2. The cleaning tool system as defined in claim 1 wherein the fore body further comprises at least one wiper having a resilient peripheral contour concentric with the peripheral contour, the resilient peripheral contour resiliently contacting the surfaces of the channel to provide a wiping or squeegee effect when drawn through the channel.

3. The cleaning tool system as defined in claim 2 wherein the resilient peripheral contour and the plurality of stabilizers cooperatively prevent yaw, pitch and roll.

4. The cleaning tool system as defined in claim 1 wherein the plurality of stabilizers each comprise:

a clevis extending from the central body;

a wheel supported on an axle carried in the clevis.

5. The cleaning tool system as defined in claim 4 wherein the plurality of stabilizers extend from the central body and are configured to engage corners of the channel.

6. The cleaning tool system as defined in claim 5 wherein the clevises are angularly oriented to extend from the central body at angles predetermined based on the geometric shape of the channel to provide orientation of the wheels for contact in the channel corners.

7. The cleaning tool system as defined in claim 1 wherein the cleaning medium is pressurized gas from a supply line engaged in the connection boss;

the central body includes a plenum receiving the pressurized gas;

the fore body has vent channels in fluid communication with the plenum and terminating in the orifices to distribute the pressurized gas.

8. The cleaning tool system as defined in claim 7 wherein the vent channels are constricting nozzles to increase gas flow velocity for ejection from the orifices, said orifices having an elongated rectangular shape to enhance drying or blowing effect on the surfaces of the channel.

9. The cleaning tool system as defined in claim 1 wherein the cleaning medium is one of water, solvent, degreaser or other liquid cleaning agent from a supply line engaged in the connection boss;

the central body includes a plenum; and the fore body further comprises a plurality of spray channels in fluid communication with the plenum and terminating in one or more of the orifices and, a plurality of laterally oriented cleaning elements forming elements of a resilient peripheral contour concentric with the peripheral contour, said cleaning elements configured to resiliently contact surfaces of the channel to provide a scrubbing effect as the fore body is drawn through the channel.

10. The cleaning tool system as defined in claim 9 wherein the cleaning elements comprise bristled brushes, resilient foam or sponge pads received in lateral clamping elements.

11. The cleaning tool system as defined in claim 1 wherein the connection boss is concentric with a longitudinal axis of the central body for connection of the supply line.

12. A cleaning tool system comprising:

a central body having a longitudinal axis and including a plenum, the central body having a connection boss configured to receive a supply line for a cleaning medium comprising one of water, solvent, degreaser or other liquid cleaning agent from a supply line engaged in the connection boss;

a fore body extending from the central body and having a peripheral contour shaped to be received in an enclosed channel, said peripheral contour shaped to index the cleaning tool system within the channel and maintain an orientation as the cleaning tool system is drawn through the channel, said fore body having orifices to dispense the cleaning medium, the forebody further comprising a plurality of spray channels in fluid communication with the plenum and terminating in one or more of the orifices and, a plurality of laterally oriented cleaning elements forming elements of a resilient peripheral contour concentric with the peripheral contour, said cleaning elements configured to resiliently contact surfaces of the channel to provide a scrubbing effect as the fore body is drawn through the channel;

a plurality of stabilizers extending from the central body radially relative to the longitudinal axis to engage surfaces of the channel wherein the stabilizers comprise longitudinally oriented cleaning elements extending from the central body, the longitudinally oriented cleaning elements having outer ends resiliently contacting the corners of the channel; and, a loop hook in the fore body configured to attach a draw line to pull the fore body and central body through the channel along the longitudinal axis.

13. The cleaning tool system as defined in claim 12 wherein the longitudinally oriented cleaning elements comprise bristled brushes, resilient foam or sponge pads received in longitudinal clamping elements.

14. The cleaning tool system as defined in claim 13 wherein the fore body further comprises:

a spray dome at a forward end, said spray dome having multiple radially spaced jet orifices;

a first set of at least two jet orifices oriented to spray in a first lateral direction perpendicular to the peripheral contour, said first set of jet orifices positioned in curved depressions intermediate a first pair of the lateral clamping elements;

a second set of at least two jet orifices oriented to spray in a second lateral direction perpendicular to the peripheral contour, said second set of jet orifices positioned in second curved depressions intermediate a second pair of the lateral clamping elements.

15. The cleaning tool system as defined in claim 14 wherein the central body further comprises a plurality of jet orifices longitudinally spaced intermediate the stabilizers.

16. The cleaning tool system as defined in claim 14 wherein the connection boss is concentric with a longitudinal axis of the central body for connection of the supply line and further comprises:

an aft body comprising a plurality of spray channels in fluid communication with the plenum and terminating in one or more jet orifices and, a second plurality of laterally oriented cleaning elements forming elements of a second resilient peripheral contour concentric with the peripheral contour, said second plurality of laterally oriented cleaning elements configured to resiliently contact surfaces of the channel to provide a scrubbing effect as fore body is drawn through the channel.

17. A method for cleaning an enclosed channel, said method comprising:

inserting a cleaning tool system having a central body having a longitudinal axis and a fore body having a peripheral contour extending from the central body into an enclosed channel, said peripheral contour shaped to be received in the enclosed channel, and shaped to index the cleaning tool system within the channel and maintain an orientation as the cleaning tool system is drawn through the channel, the central body having a connection boss configured to receive a supply line for a cleaning medium and the fore body having orifices to dispense the cleaning medium into the channel;

receiving the peripheral contour of the fore body into the enclosed channel to index the cleaning tool system in the channel, engaging the enclosed channel with a plurality of stabilizers extending from the central body radially relative to the longitudinal axis;

pulling the fore body and central body through the channel along the longitudinal axis with a loop hook in the fore body configured to attach a draw line to pull the fore body and central body through the channel along the longitudinal axis; and dispensing the cleaning medium into the channel from the orifices in the fore body.

18. The method as defined in claim 17 wherein the fore body further comprises at least one wiper having a resilient peripheral contour concentric with the peripheral contour and further comprising:

contacting the surfaces of the channel with the resilient peripheral contour;

wiping or squeegeeing the surfaces with the resilient peripheral contour when drawn through the channel.

19. The method as defined in claim 18 wherein the cleaning medium is pressurized gas from a supply line engaged in a connection boss in the central body and further comprising:

receiving the pressurized gas in a plenum in the central body;

distributing the pressurized gas through vent channels in the fore body in fluid communication with the plenum and terminating in one or more orifices; and, ejecting the pressurized gas through the orifices.

20. The method as defined in claim 17 wherein cleaning medium is water, solvent, degreaser or other liquid cleaning agent and the fore body further comprises a plurality of laterally oriented cleaning elements forming elements of a resilient peripheral contour concentric with the peripheral contour, and further comprising:

resiliently contacting the surfaces of the channel with said cleaning elements;

scrubbing the surfaces with the cleaning elements when drawn through the channel.

* * * * *